US011518596B2

(12) United States Patent
Komann

(10) Patent No.: US 11,518,596 B2
(45) Date of Patent: Dec. 6, 2022

(54) HOLDING STRUCTURE FOR HOLDING A PLURALITY OF CONTAINERS FOR PHARMACEUTICAL, MEDICAL OR COSMETIC PURPOSES AND TRANSPORT OR PACKAGING CONTAINER COMPRISING THE SAME

(71) Applicant: SCHOTT Schweiz AG, St. Gallen (CH)

(72) Inventor: Christian Komann, Speicher (CH)

(73) Assignee: SCHOTT Schweiz AG, St. Gallen (CH)

( * ) Notice: Subject to any disclaimer, the term of this patent is extended or adjusted under 35 U.S.C. 154(b) by 479 days.

(21) Appl. No.: 16/400,099

(22) Filed: May 1, 2019

(65) Prior Publication Data

US 2019/0256266 A1 Aug. 22, 2019

Related U.S. Application Data

(63) Continuation of application No. PCT/EP2017/076634, filed on Oct. 18, 2017.

(30) Foreign Application Priority Data

Nov. 4, 2016 (DE) ..... 10 2016 121 086.2

(51) Int. Cl.
*A61J 1/16* (2006.01)
*B65D 71/62* (2006.01)
(Continued)

(52) U.S. Cl.
CPC ..... *B65D 71/0037* (2013.01); *A61J 1/16* (2013.01); *B01L 9/06* (2013.01); *B01L 9/50* (2013.01);
(Continued)

(58) Field of Classification Search
CPC ..... B65D 71/0037; B65D 25/101; B65D 25/108; B65D 71/0055; A61J 1/16; A61J 1/062
(Continued)

(56) References Cited

U.S. PATENT DOCUMENTS 3,532,213 A 10/1970 Schulz et al.
5,251,750 A 10/1993 Gelardi et al.
(Continued)

FOREIGN PATENT DOCUMENTS

CN 101932235 A 12/2010
CN 104272049 A 1/2015
(Continued)

OTHER PUBLICATIONS

Chinese Office Action dated Oct. 19, 2020 for Chinese Application No. 201780068499.1 (7 pages).
(Continued)

*Primary Examiner* — Steven A. Reynolds
(74) *Attorney, Agent, or Firm* — Taylor IP, P.C.

(57) ABSTRACT

A holding structure for holding a plurality of containers for pharmaceutical, medical or cosmetic purposes includes a carrier having openings or receptacles for accommodating the containers. Holding devices for holding the containers are provided at the openings or receptacles. The holding devices can selectively assume two different stable positions, namely a first stable position in which the containers can be inserted without friction into the openings or receptacles and a second stable position in which the containers are held in the respective opening or receptacle by frictional engagement or by positive locking. The containers can be reliably inserted into the openings or receptacles without material abrasion. In the open insertion position of the holding devices, a large number of containers can be
(Continued)

inserted concurrently into the openings or receptacles without high forces acting on the holding structure.

18 Claims, 44 Drawing Sheets

(51) Int. Cl.

| | |
|---|---|
| ***B65D 25/10*** | (2006.01) |
| ***B65D 71/64*** | (2006.01) |
| ***B65D 1/34*** | (2006.01) |
| ***B65D 81/38*** | (2006.01) |
| ***B01L 9/00*** | (2006.01) |
| ***B65D 5/50*** | (2006.01) |
| ***B01L 9/06*** | (2006.01) |

(52) U.S. Cl.
CPC ..... *B65D 1/34* (2013.01); *B65D 5/503* (2013.01); *B65D 25/101* (2013.01); *B65D 25/103* (2013.01); *B65D 25/108* (2013.01); *B65D 71/0055* (2013.01); *B65D 81/3813* (2013.01); *B01L 2300/0609* (2013.01); *B01L 2300/0858* (2013.01); *B65D 25/105* (2013.01)

(58) Field of Classification Search
USPC ..... 206/438
See application file for complete search history.

(56) References Cited

U.S. PATENT DOCUMENTS

| | | | | |
|---|---|---|---|---|
| 5,829,594 | A | 11/1998 | Warder | |
| 5,857,657 | A | 1/1999 | Yamamoto | |
| 5,904,899 | A | 5/1999 | Hayashi | |
| 8,727,124 | B2 | 5/2014 | Franciskovich et al. | |
| 9,403,619 | B2 | 8/2016 | Deutschle et al. | |
| 9,522,752 | B2 | 12/2016 | Wissner et al. | |
| 9,963,259 | B2 | 5/2018 | Deutschle et al. | |
| 2010/0200441 | A1* | 8/2010 | Choi | G11B 33/045 206/308.1 |
| 2011/0226662 | A1* | 9/2011 | Nicoletti | B65D 5/503 206/562 |
| 2014/0027332 | A1* | 1/2014 | Pawlowski | A61M 5/008 206/438 |
| 2014/0027333 | A1 | 1/2014 | Pawlowski et al. | |
| 2015/0089830 | A1* | 4/2015 | Wissner | B65B 7/2892 34/284 |
| 2015/0108034 | A1* | 4/2015 | Deutschle | A61J 1/16 206/562 |
| 2015/0114871 | A1 | 4/2015 | Fitzpatrick et al. | |
| 2015/0166212 | A1 | 6/2015 | Wissner et al. | |
| 2017/0183113 | A1* | 6/2017 | Deutschle | F26B 5/06 |
| 2017/0197745 | A1 | 7/2017 | Deutschle et al. | |

FOREIGN PATENT DOCUMENTS

| | | | |
|---|---|---|---|
| CN | 204746382 | U | 11/2015 |
| DE | 42 08 503 | C1 | 7/1993 |
| DE | 10 2012 103 899 | A1 | 11/2013 |
| EP | 0 872 846 | A1 | 10/1998 |
| EP | 2 266 824 | A1 | 12/2010 |
| JP | 2014-68906 | A | 4/2014 |

OTHER PUBLICATIONS

English translation of Chinese Office Action dated Oct. 19, 2020 for Chinese Application No. 201780068499.1 (9 pages).
India Office Action dated Feb. 26, 2021 for Indian Patent Application No. 201917015628 (7 pages).
International Search Report and Written Opinion dated Dec. 6, 2017 for International Application No. PCT/EP2017/076634 (11 pages).
English translation of International Search Report and Written Opinion dated Dec. 6, 2017 for International Application No. PCT/EP2017/076634 (5 pages).
Response to International Search Report, including an English translation thereof, dated Mar. 5, 2018 for International Application No. PCT/EP2017/076634 (5 pages).
Notification Concerning Transmittal of International Preliminary Report on Patentability, including an English translation of the document, dated May 16, 2019 for International Application No. PCT/EP2017/076634 (13 pages).

* cited by examiner

HOLDING STRUCTURE FOR HOLDING A PLURALITY OF CONTAINERS FOR PHARMACEUTICAL, MEDICAL OR COSMETIC PURPOSES AND TRANSPORT OR PACKAGING CONTAINER COMPRISING THE SAME

CROSS REFERENCE TO RELATED APPLICATIONS

This is a continuation of PCT application No. PCT/EP2017/076634, entitled "HOLDING STRUCTURE FOR HOLDING A PLURALITY OF CONTAINERS FOR PHARMACEUTICAL, MEDICAL OR COSMETIC PURPOSES AND TRANSPORT OR PACKAGING CONTAINER HAVING SAME", filed Oct. 18, 2017, which is incorporated herein by reference.

BACKGROUND OF THE INVENTION

1. Field of the Invention

The present invention relates to a holding structure for holding a plurality of containers for pharmaceutical, medical or cosmetic purposes, in particular vials, cartridges or syringes, such as vials made of glass.

2. Description of the Related Art

Large quantities of medical containers, such as vials, ampoules or cartridges, are used as containers for the storage of medical, pharmaceutical or cosmetic preparations to be administered in liquid form, in particular in pre-dosed quantities. These generally have a cylindrical shape, can be made of plastics or glass and are available in large quantities at low cost. To fill the containers as economically as possible under sterile conditions, concepts are increasingly being used in which the containers are placed in a holding structure directly at the manufacturer of the containers, these are then sterilely packed in a transport and packaging container together with the containers held on them and the containers are then unpacked at a pharmaceutical company under sterile conditions and then processed further.

For this purpose, various holding structures are known, on which a plurality of medical containers are arranged and held concurrently in a regular arrangement. This has advantages for the automated further processing of the containers, as the containers can be transferred to processing stations at controlled positions and in a specified arrangement, for example to processing machines, robots or the like. For transfer to a processing station, the transport and packaging container simply needs to be suitably positioned and opened. The downstream processing station then knows in which position and arrangement the containers to be further processed are arranged in the holding structure.

U.S. Patent Application Publication No. 2014/0027333 A1 discloses a holding structure. The holding structure includes a planar carrier having a plurality of openings or receptacles formed and arranged in a regular two-dimensional array and each configured to accommodate a container. A plurality of holding devices is assigned to each of the openings or receptacles of the carrier which hold the containers in the regular arrangement on the carrier. The holding devices hold the containers on the carrier by frictional engagement. During the insertion or removal of the containers into or out of the openings or receptacles of the carrier, the holding devices rub against the surface of the containers. This causes a certain degree of contamination of the containers and of the process environment due to abraded particles. In the worst case, the abrasion is so strong that a subsequent optical inspection detects it and containers have to be sorted out.

U.S. Patent Application Publication No. 2014/0027332 A1 discloses another holding structure in which the holding devices hold the containers by positive locking. However, a certain amount of material abrasion also occurs when the containers are inserted into or removed from the openings or receptacles of the carrier.

In order to further reduce such material abrasion on the holding devices, International Patent Application Publication No. WO 2014009037 A1 (corresponding to U.S. Patent Application Publication No. 2015/0166212 A1) discloses another holding structure as shown in FIGS. 7A and 7B. The holding structure is formed by a planar carrier 210, wherein several elastic holding arms 212 are arranged as holding devices at the edge of a respective opening or receptacle of the carrier 210, which project from the upper side of the carrier 210. The holding arms 212 are configured in such a manner that they are elastically pivoted away or folded away when the containers 220 are inserted into the openings or receptacles. The elastic holding arms 212 are matched to the containers 220 in such a manner that these are held by the holding arms 212 with radial clearance. As shown in FIG. 7B, holding projections 213 are formed at the front free ends of the holding arms 212, each of which having an upper insertion bevel 215, a horizontal support bevel 214 and a lower insertion bevel 216. When held, the underside of the upper rim 212 of the vial 220 rests loosely on the upper insertion bevel 215 of a holding projection 213. To insert a vial 220 into an opening of the carrier 210, the vial 220 is moved towards the carrier 210 from above until the bottom 222 comes in contact with the upper insertion bevel 215. As the vial 220 is lowered further, the side wall 223 slides off at the front end of the supporting nose 214, which causes the holding arms 212 to spread elastically.

The material abrasion is significantly lower here; however, it is not vanishing. Furthermore, the holding arms 212 must be formed with high precision and configured with relatively tight tolerances so that the containers 220 can be held with clearance as intended. However, the carrier 210 may warp during use or shrink due to process parameters such as temperature or humidity, so that the relatively tight tolerances may not be maintained and a relatively large, unwanted material abrasion may occur.

A further holding structure of the type mentioned above is disclosed in International Patent Application Publication No. WO 2014/072019 A2 (corresponding to U.S. Pat. No. 9,963,259).

The containers are automatically removed from or inserted into the holding structure for further processing by means of robots or grippers. However, since there is a certain friction between the containers and the holding devices of the holding structure, it is difficult to remove or insert all the containers at the same time, as relatively large forces act on the holding structure, which can, for example, lead to uncontrolled bending of the holding structure or even to the containers accidentally falling out of the holding structure. Therefore, usually only a subset of the containers is removed or inserted concurrently by means of a robot or gripper, the total number of containers of a respective subset depending on the forces which the holding structure can absorb without excessive deformation. This leads to delays and higher costs for the further processing of the containers.

SUMMARY OF THE INVENTION

According to a first aspect of the present invention, the holding devices of the holding structure are configured to be able to selectively assume two different stable positions, wherein, in a first stable position, the distance between the holding devices is sufficiently large so that in the first stable position of the holding devices the containers can be inserted into or removed from the respective opening or receptacle, and, in a second stable position of the holding devices, the distance between the holding devices is sufficiently small so that in the second stable position the containers are held by the holding devices in the respective opening or receptacle by frictional engagement or by positive locking.

The adjustment of the holding devices from one to the other stable position may be effected either by actuating an actuating element provided on the holding structure, such as provided inside or in the immediate vicinity of the respective opening or receptacle, or by an external actuating element, separate from the carrier, which is adjusted relative to the carrier, for example moved perpendicularly towards or away from the carrier, thereby activating the adjustment of the holding devices. Or the adjustment of the holding devices from one to the other stable position can be effected directly by active displacement of the containers themselves relative to the respective opening or receptacle.

In the first stable position, the distance between the holding devices may be so large that the containers can be inserted into or removed from the respective opening or receptacle without hindrance, taking into account the movement path of the containers for insertion or removal. If only an adjustment perpendicular to the carrier is intended for the insertion or removal of the containers into or from the respective opening or receptacle, it is sufficient for this purpose if the distance between the holding devices in the first stable position is greater than a maximum outer dimension of the containers, i.e. in particular greater than a maximum outer diameter of the containers. If the movement path of the containers for inserting or removing the containers into or from the respective opening or receptacle is not vertical but inclined relative to the carrier, the distance between the holding devices in the first stable position is suitably larger. In other words, in the open first position (insertion position), the holding devices unblock a larger diameter than the maximum outer diameter of the containers, so that the containers can be inserted into and removed from the respective opening or receptacle without friction. According to the present invention, normal forces acting on the outer wall of the containers can thus be avoided, so that a lower radial load acts on the containers and, in particular, material abrasion can be completely prevented. When the containers are inserted or removed, practically no vertical forces act on the holding structure. Thus, according to the present invention, all containers can also be inserted concurrently into and removed from the openings or receptacles of a holding structure, making further processing of the containers according to the present invention more economical and faster. Furthermore, the holding devices can be provided with less tight tolerances, so that the holding structure according to the present invention can be produced more easily and cost-effectively. Any deformations or twisting of the holding structure during use can also be considerably reduced according to the present invention.

According to the present invention, the holding devices are elastically biased into the first stable position and into the second stable position. The holding devices are therefore configured to be bi-stable and can assume two stable end positions from where the holding devices can be transferred to the other end position only by applying a force exceeding a certain threshold value which is sufficiently higher than the forces normally occurring during further processing of the containers due to displacement or handling (lifting, lowering, turning, tilting, vibrating) of the holding structure. An inadvertent adjustment of the holding devices to the other end position can thus be reliably eliminated. Particularly, the aforementioned two stable end positions can be assumed by the holding devices regardless of whether these holding devices are actually holding containers or not.

In some embodiments, the holding devices are connected by hinges, such as by film hinges, to an actuating element, wherein in the first stable position the hinges press the holding devices apart by an elastic restoring force, wherein the elastic restoring force can be pressed over by actuating the actuating element for transferring the holding devices into the second stable position. For the purposes of the present application the term "hinge," in particular "film hinge," shall mean any pivoting connection between two structural parts which is either integral with these parts or permanently connected to these parts, for example by adhesion or fusion. Examples of similar film hinges are the connections of caps of dishwasher detergent bottles, which in this way are undetachably connected to the bottles. Such film hinges can be formed in a simple and cost-effective manner, in particular using plastic injection molding techniques such as two-component (2K) injection molding techniques.

In some embodiments, the holding devices are formed as holding arms projecting from the carrier and holding the containers in the second stable position clamped in the region of a cylindrical side wall or of a constricted neck portion or engaging behind a widened upper rim in order to hold the containers axially secured on the carrier. For this purpose, the holding arms can each be wing-shaped in order to cooperate with the outer surface of the containers in a suitable frictional or positive-locking manner. The opening width of the holding arms, such as of pairs of holding arms, can be suitably adjusted between the first and second stable end position by an actuating element. The holding arms may be made of a plastic material with a suitable friction pairing with the material of the containers (glass or plastic), or a coating having a suitable friction coefficient is provided on the holding arms.

In some embodiments, the holding devices are each connected to the actuating element by a first hinge so that they can pivot and at the same time they are each connected to the carrier by a second hinge so that the holding devices can be automatically transferred from the first stable position into the second stable position by adjustment of the actuating element relative to the carrier. The holding devices, in particular the holding arms, and the actuating element are coupled to one another by the two hinges in such a manner that the adjustment of one element (actuating element or holding arms) automatically causes a corresponding adjustment of the other element (holding arms or actuating element). The actuating element thus acts as a control element for controlling the position of the holding arms, i.e. whether the holding arms are arranged in the first stable end position or in the second stable end position. Such a control of the position of the holding arms, such as the simultaneous control of the positions of all holding arms, is particularly suitable for automated processing of the containers, for example using robots or grippers in processing stations.

In some embodiments, the actuating element is configured and arranged in such a manner that it is adjustable in the radial direction of the respective opening or receptacle and within a plane spanned by the carrier for transferring the holding devices from the first stable position into the second stable position. This embodiment is particularly suitable for controlling the positions of the holding arms directly above the container interacting with the actuating element during its radial adjustment. If a container is adjusted radially in the opening or receptacle to a sufficient extent, for example if the container comes in contact with a control cam or the like, then the adjustment of the associated holding arm to the other stable end position is carried out automatically.

In some embodiments, the actuating element comprises a base body having a projection projecting radially therefrom, wherein two holding arms connected to the base body are moved towards one another from the first stable position and transferred into the second stable position by radial adjustment of the base body. The radial projection acts in particular as a control cam when it comes in contact with the associated container. For radial adjustment of the base body, however, an external control cam or an external control device generally may also be used.

In both the first and second stable position, a gap is formed between the base body and an edge of the opening or receptacle so that the adjustment of the actuating element is not hindered by the edge of the opening or receptacle. The gap can also be used to access the rear of the base body, for example by an external adjustment device, in order to adjust the base body in radial direction and thus effect the aforementioned adjustment of the holding elements from one stable position into the other stable position.

In order to achieve suitable tensioning or elastic biasing of the actuating element in a simple manner, in some embodiments the actuating element is mirror-symmetrical, for example by arranging the holding arms mirror-symmetrically in relation to the actuating element in the respective opening or receptacle. For this purpose, the actuating element may comprise a base body to which the two holding arms are connected in an articulated or pivotable manner, the base body being elastically biased against the carrier in at least one of the two stable positions, for example by connecting the base carrier to the edge of the associated opening or receptacle of the carrier by laterally projecting hinges. In each of the two stable end positions, the hinges are elastically biased to a sufficient extent, for securing the respective end position and reliably preventing accidental transfer of the holding arms to the other stable position.

An elastic biasing can be accomplished in a simple and reliable manner by forming the hinges using two-component injection molding technology in order to cause two elastically biased stable end positions of the holding arms. Here, the unstable intermediate position between these two end positions is the state under highest tension, the energy of which must be overcome for transferring the holding arms from one stable end position into the other stable end position.

For this purpose, the hinges may be formed as film hinges, in particular as elastic, flexible connecting webs, which are curved or bent in each of the two stable end positions to a sufficient extent. The aforementioned radial adjustment of the actuating element causes the hinges to bend into the respective oppositely curved or bent state. This bending requires a certain adjustment force which is sufficient to prevent accidental adjustment of the base body and of the holding arms connected to it and which does not act vertically on the carrier but within the plane spanned by the carrier. Any deformation or twisting of the carrier due to vertical forces acting on it can thus be eliminated.

In some embodiments, the aforementioned projection projects radially from the base body to such an extent that in the second stable position it is in direct contact with a cylindrical side wall or with a constricted neck portion of the respective container. The projection may thus be used directly as a control cam for controlling the position of the holding arms, so that the respective position of the holding arms can be easily controlled directly by radial adjustment of the containers or by radial adjustment of an external control device.

In some embodiments, the holding arms are concavely curved in sections, having a radius of curvature which is matched to the radius of the respective container in the region of the cylindrical side wall or of the constricted neck portion. The containers can thus be held on the holding structure reliably secured in axial direction.

For this purpose, the holding devices are elastically biased against one another in the second stable position, such as by an elastic restoring force exerted by the hinges, wherein the elastic restoring force can be exceeded or pressed over by displacement of the respective container in a direction perpendicular to the direction of extension of the projection, for transferring the holding devices back into the first stable position. If the preload force is exceeded when the aforementioned actuating element is adjusted in the radial direction, the holding arms switch over to the other of the bi-stable end positions automatically and with little force.

In some embodiments, the actuating element is configured and arranged so as to be adjustable in the respective opening or receptacle perpendicular to a plane spanned by the carrier, the adjustment of the actuating element causing the holding devices to be transferred from one stable position to the other stable position. The adjustment of the actuating element in the axial direction of the containers can be carried out by an external actuating element separate from the holding structure (for example by an external control device or a control cam) or directly by axial displacement of the containers themselves in the openings or receptacles. Here, the upper side of the actuating element may also be used as a supporting surface to prevent the containers from slipping through accidentally. The holding devices, which may be configured as holding arms, are distributed appropriately along the periphery of the actuating element, such as at uniform angular distances from each other, and are suitably connected to the actuating element in an articulated manner, in particular by the aforementioned film hinges.

In some embodiments, the actuating element is formed as a cylindrical body having a closed top side, wherein an annular gap, which is bridged by the first hinge, by a portion of the holding devices and by the second hinge, is formed between an edge of the respective opening or receptacle and the actuating element. This allows an adjustment of the actuating element in axial direction with advantageously low forces.

The cylindrical body may be centered in relation to an axis of symmetry of the respective opening or receptacle of the carrier, which enables a symmetrical adjustment of all holding devices when the actuating element is actuated and thus an advantageously symmetrical holding of the containers with advantageously low radial forces is possible.

In some embodiments, the holding devices are formed as holding arms having holding claws, the length of the holding arms being matched to the axial length of the containers in such a manner that, in the second stable position, the containers are held clamped at the upper end of the cylindrical side wall or in the region of the constricted neck portion of a container or that the widened upper rim of a container is positively engaged to hold the container axially secured to the carrier. In particular, this allows all containers to be held on the holding structure at the same distance from the upper side of the carrier. The bottoms or lower ends of the containers are then also automatically kept at the same distance from the underside of the carrier, which has considerable advantages, for example, in freeze-drying the contents of the containers, because a uniform contact of the bottoms or lower ends of all containers with a cooling surface of a freeze-dryer can be ensured easily and hence freeze-drying (or further processing) of all containers is possible concurrently while they are held by the holding structure.

In some embodiments, the actuating element, the holding devices and the hinges are formed integrally with the carrier, such as by a plastic injection molding process. This enables a simple and cost-effective production of the holding structure as well as an adjustment of the holding devices with advantageously low forces.

In some embodiments, a side wall is provided at least in sections on the underside of the carrier along the edge of the respective opening or receptacle. This may either be circumferential or, in other extreme cases, may only be provided in the form of a few pins or projections which project from the underside of the carrier and are distributed around the respective opening or receptacle. This allows a simple and effective way of preventing collision between containers accommodated in adjacent openings or receptacles of the carrier. The respective side wall may also be used at the same time as a spacer, for example if several holding structures are to be stacked on top of each other to save space or passed on in a processing plant. The length of the respective side wall in a direction perpendicular to the upper side of the carrier may be selected so that the bottoms or lower ends project beyond the lower edge of the respective side wall when the containers are held by the holding devices on the holding structure, so that the bottoms or lower ends are readily accessible for further processing, for example for a direct contact with a cooling surface as part of a freeze-drying process.

According to another aspect of the present invention, the holding devices are biased by an elastic restoring force into an open insertion position, in which the containers can be inserted axially between or removed from the holding devices, or into a closed holding position, in which the containers are held by the holding devices by frictional engagement or by positive locking, wherein, in the open insertion position, the distance between the holding devices is sufficiently large so that the containers can be inserted into or removed from the respective opening or receptacle in the open insertion position of the holding devices, in the closed holding position, the distance between the holding devices is sufficiently small so that in the closed holding position the containers are held in the respective opening or receptacle by the holding devices by frictional engagement or by positive locking, and the holding devices of a respective opening or receptacle, such as the holding devices of all openings or receptacles of the carrier, can be transferred in a coordinated manner by an actuating device from the open insertion position into the closed holding position and/or from the closed holding position into the open insertion position.

In some embodiments, the distance between the holding devices in the open insertion position is so large that the containers can be inserted into or removed from the respective opening or receptacle unhindered and without collision or friction with the holding devices.

In some embodiments, the holding devices are elastically biased into a first and/or a second stable position, i.e. into the open insertion position and/or into the closed holding position. The holding devices are therefore also mounted or arranged on the carrier in such a manner that they can assume at least one stable end position or two stable end positions from which the holding devices can be transferred to the other end position only by applying a force exceeding a certain threshold value which is sufficiently higher than the forces normally occurring during further processing of the containers due to displacement or handling (lifting, lowering, turning, tilting, vibrating) of the holding structure. An inadvertent adjustment of the holding devices to the other position can thus be reliably eliminated.

In some embodiments, the elastic restoring force can be exceeded or pressed over by vertical displacement of an actuating element or by displacement of an actuating element in a direction perpendicular thereto, i.e. in particular by displacing the actuating element parallel to a plane spanned by the carrier of the holding structure, for transferring the holding devices in a coordinated manner from the open insertion position into the closed holding position and/or from the closed holding position into the open insertion position.

Conveniently, the actuating element is an external control device which can be adjusted to displace the holding devices of at least one opening or receptacle of the holding structure from one end position to the other end position. Conveniently, this control device is configured to adjust the holding devices of a plurality of openings or receptacles of the holding structure concurrently, for example the holding devices of a plurality of openings or receptacles arranged one behind the other in alignment along a row, or even the holding devices of all openings or receptacles of the holding structure. For this purpose, the control device acts appropriately in the manner of a control cam in order to adjust the holding devices in a suitable manner by contact with an actuating element and further adjustment of the control device. In particular, a displacement of the control device in a direction perpendicular or parallel to the carrier of the holding structure, but also an adjustment of elements of such a control device, for example of one or more control cams of such a control device, is suitable for this purpose.

In some embodiments, the actuating element comprises at least two beveled projections so that, by abutment of the projections against the neck portions of the containers or against the holding devices and by pressing the projections down towards the carrier or by displacing the projections in a direction perpendicular thereto, the holding devices can be transferred in a coordinated manner from the open insertion position to the closed holding position and/or from the closed holding position to the open insertion position. Conveniently, the actuating element is an external actuating element separate from the carrier and can be displaced perpendicular to the carrier in order to suitably control the position of the holding devices. Such an actuating element can be arranged on a robot, gripper or the like in order to enable automated processing of the containers in a processing plant in a simple manner.

In some embodiments, the angle of inclination of the bevels of the aforementioned projections is matched to the angle of inclination of a neck portion of the containers, with deviations of only a few degrees. The bevels may therefore contact the corresponding neck portions of the containers, which extend inclined in sections and at an approximately constant angle, not only selectively but also over a larger area, which allows in particular better guidance or centering of the containers in the openings or receptacles of the holding structure when adjusting the holding devices.

In some embodiments, the holding arms are pivotally mounted on the carrier by hinges, in particular by film hinges of the aforementioned type, whereby the holding arms are pressed apart elastically in the open insertion position by an elastic restoring force exerted by the hinges. An unhindered and frictionless insertion of the containers into the openings or receptacles of the carrier is thus easily possible without active adjustment of the holding devices. The actuating element only needs to push the holding devices apart for removal of the containers.

In some embodiments, elastic portions are additionally formed at the front ends of the holding arms, which contact each other in the closed holding position. In this way, the holding arms are elastically biased against each other even in the closed holding position of the holding arms, whereby the closed holding position of the holding arms is also secured against accidental opening of the holding arms. The holding arms are therefore also configured to be bi-stable and are arranged either in the open insertion position or in the closed holding position, wherein the holding arms can be transferred to the respective other end position only by applying a force which exceeds a certain threshold value which is sufficiently higher than the forces normally occurring during further processing of the containers due to displacement or handling (lifting, lowering, turning, tilting, vibrating) of the holding structure. An inadvertent adjustment of the holding devices to the other end position can thus be reliably eliminated.

In some embodiments, stops are formed at the rear ends of the holding arms which, cooperate with an edge of the respective opening or receptacle in the closed holding position of the holding arms for preventing that the holding arms are pressed down further. The closed holding position of the holding arms can thus be secured in a simple, cost-effective manner, which in particular also prevents the containers from slipping accidentally, especially in the event of any deformation or twisting of the carrier.

In some embodiments, the holding devices are formed as pairs of foldable or collapsible holding plates which are disposed diametrically opposite to each other at the edge of the respective opening or receptacle, wherein inwardly folded portions of the holding plates hold the containers in the closed holding position clamped in the region of a cylindrical side wall or of a constricted neck portion or engage behind a widened upper rim for holding the containers axially secured to the carrier. This geometry is particularly suitable for holding containers having a profile deviating from a circular shape, for example having a polygonal profile, for example having a square-shaped or rectangular profile. However, if the material of the holding plates and the material of the containers are friction matched, which may also be accomplished by coating the holding plates accordingly, containers with any profile can always be reliably held.

In some embodiments, the actuating element may further comprise an intermediate plate spaced from the carrier, having a plurality of openings corresponding to the openings or receptacles of the carrier and being adjustable by being pressed down towards the carrier to thereby transfer the holding devices in a coordinated manner from the open insertion position to the closed holding position and/or from the closed holding position to the open insertion position. The intermediate plate thus acts as a control device for controlling the position of the holding devices and allows all the holding devices of a holding structure to be actuated concurrently in order to adjust them appropriately in a simple manner.

In some embodiments, the holding devices are mounted on the carrier so that they can pivot about a pivot axis, whereby an elastic restorer on the pivot axis or the holding devices, for example a torsion spring, which elastically biases the holding devices into the open insertion position or into the closed holding position. Alternatively, the elastic restorer may be formed integral with the carrier, in particular by plastic injection molding or 3D printing. For adjusting the holding arms, practically only forces within the plane spanned by the carrier are required, but not forces which would act vertically on the carrier and deform it, e.g. twist it. According to the present invention this makes it possible to maintain even tight tolerances in the holding structure.

In some embodiments, the holding devices are formed as pivoting holding arms having holding claws at their front free ends, wherein the holding arms are arranged in a multiple point symmetry distributed along the edge of the respective opening or receiving of the carrier and wherein the holding arms are elastically biased into the closed holding position. The containers are thus automatically held in the normal end position of the holding arms. The holding arms need to be actively transferred from the closed holding position to the open insertion position for inserting the containers into the openings or receptacles or removing them.

For this purpose, the front free ends of the holding arms may be disposed on a first side of the pivot axis and rear free ends of the holding arms may be disposed on a second side of the pivot axis opposite to the first side, the rear free ends being acted upon by actuating the actuating device in order to pivot them about the pivot axis and to transfer the holding arms in a coordinated manner from the open insertion position into the closed holding position and/or from the closed holding position into the open insertion position. The actuating element may be adjusted in a direction perpendicular to the carrier or in a radial direction in order to act on the rear free ends of the pivoting holding arms.

A further aspect of the present invention relates to the combination of a holding structure, as set out above, and an external actuating device, formed as a separate element, by which a suitable adjustment of the holding devices, in particular a coordinated synchronous adjustment of the holding devices, can be effected for inserting the containers into the openings or receptacles of the carrier or for removing the containers, as disclosed in this application.

In some embodiments, there is provided a combination of a transport or packaging container and of a holding structure concurrently holding a plurality of containers for substances for pharmaceutical, medical or cosmetic applications, wherein the containers are cylindrical and open at least at one end, the transport or packaging container is box-shaped, and the holding structure is accommodated in the box-shaped transport or packaging container, for holding the plurality of containers in the transport or packaging container. The holding structure comprises a planar carrier having a plurality of openings or receptacles, wherein the openings or receptacles are formed and arranged in a regular arrangement and are each configured for accommodating a container, and at least two holding devices are each assigned to the openings or receptacles for holding the plurality of containers on the carrier by frictional engagement or by positive locking. The holding devices are configured to selectively assume two different stable positions, wherein, in a first stable position, the distance between the holding devices is sufficiently large so that in the first stable position of the holding devices the containers can be inserted into or removed from the respective opening or receptacle; and, in a second stable position of the holding devices, the distance between the holding devices is sufficiently small so that in the second stable position the containers are held by the holding devices in the respective opening or receptacle by frictional engagement or by positive locking.

In some embodiments, there is provided a combination of a transport or packaging container and of a holding structure concurrently holding a plurality of containers for substances for pharmaceutical, medical or cosmetic applications, wherein the containers are cylindrical and open at least at one end, the transport or packaging container is box-shaped, and the holding structure is accommodated in the box-shaped transport or packaging container, for holding the plurality of containers in the transport or packaging container. The holding structure comprises a planar carrier having a plurality of openings or receptacles, the openings or receptacles are formed and arranged in a regular arrangement and are each configured for accommodating a container, and at least two holding devices are each assigned to the openings or receptacles for holding the plurality of containers on the carrier by frictional engagement or by positive locking. The holding devices are biased by an elastic restoring force into an open insertion position, in which the containers can be inserted axially between or removed from the holding devices, or into a closed holding position, in which the containers are held by the holding devices by frictional engagement or by positive locking, wherein, in the open insertion position, the distance between the holding devices is sufficiently large so that the containers can be inserted into or removed from the respective opening or receptacle in the open insertion position of the holding devices, in the closed holding position, the distance between the holding devices is sufficiently small so that in the closed holding position the containers are held in the respective opening or receptacle by the holding devices by frictional engagement or by positive locking, and the holding devices of a respective opening or can be transferred in a coordinated manner by an actuating device from the open insertion position into the closed holding position and/or from the closed holding position into the open insertion position.

A further aspect of the present invention relates to a transport or packaging container for a plurality of containers for substances for pharmaceutical, medical or cosmetic applications, comprising a box-shaped container in which a holding structure as disclosed in the present application is accommodated for concurrently holding the plurality of containers. The transport or packaging container may be sealed by a protective or packaging film bonded to an edge of the transport container. This protective film may be a gas-permeable plastic film, such as a braid of plastic fibers, for example polypropylene fibers (PP), or a TYVEK® protective film, which enables sterilization of the containers held by the holding structure through the protective film.

A further aspect of the present invention relates to a process for the treatment or processing of containers which serve for the storage of substances for pharmaceutical, medical or cosmetic applications or contain them, wherein the containers are automatically guided past or pass through at least one processing station by a conveyor device for the treatment or processing, in which process a plurality of containers are conveyed by the conveyor device while all of them together are held on a carrier in a regular arrangement. The treatment or further processing of the containers may take place while they are held on the carrier, i.e. in the closed holding position of the holding devices. For treatment or processing at or in a processing station, the containers may also be temporarily removed from the openings or receptacles in the holding structure and then reinserted therein, wherein the holding devices are adjusted for this purpose, as disclosed herein, so that the containers may be inserted into and/or removed from the openings or receptacles in the open insertion position of the holding devices.

A further aspect of the present invention relates to a computer- or processor-readable data file, also for transmission over networks, such as an internal computer network of a company or over the Internet, comprising instructions or control commands, which, if loaded by a computer or a processor, cause a 3D printer, under the control of the computer or processor, to print a holding structure, as disclosed herein, from a suitable material in three-dimensional form, in particular from a suitable plastic material, as disclosed herein.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 1I shows in a perspective plan view an exemplary embodiment of a holding structure provided according to the present invention;

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1A:
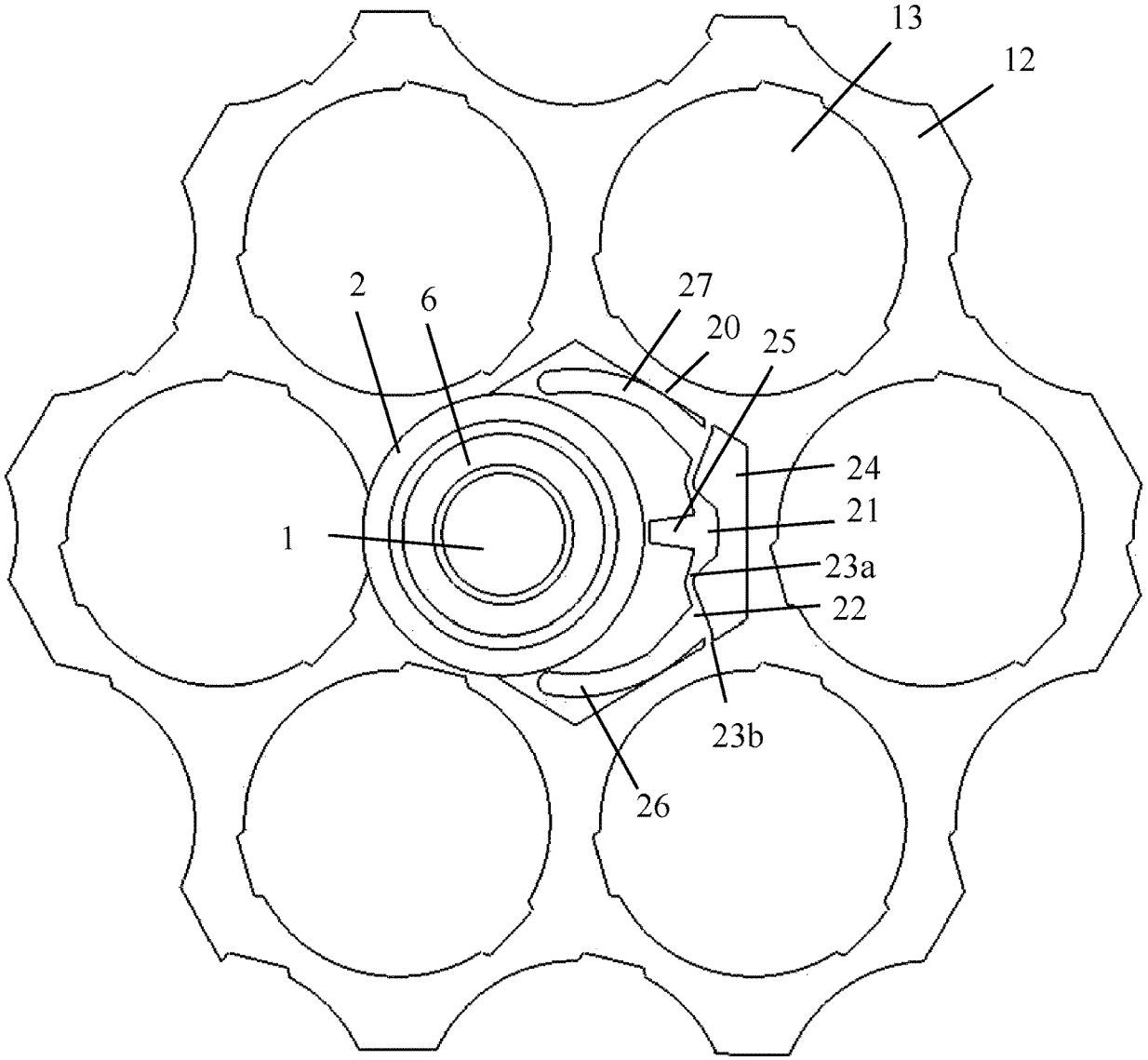
FIGS. 1A-1H show a detail of an exemplary embodiment of a subunit of a holding structure provided according to the present invention in different stages of insertion, holding and removal of a vial, each in a plan view and in a partial perspective view.
Figure 1B:
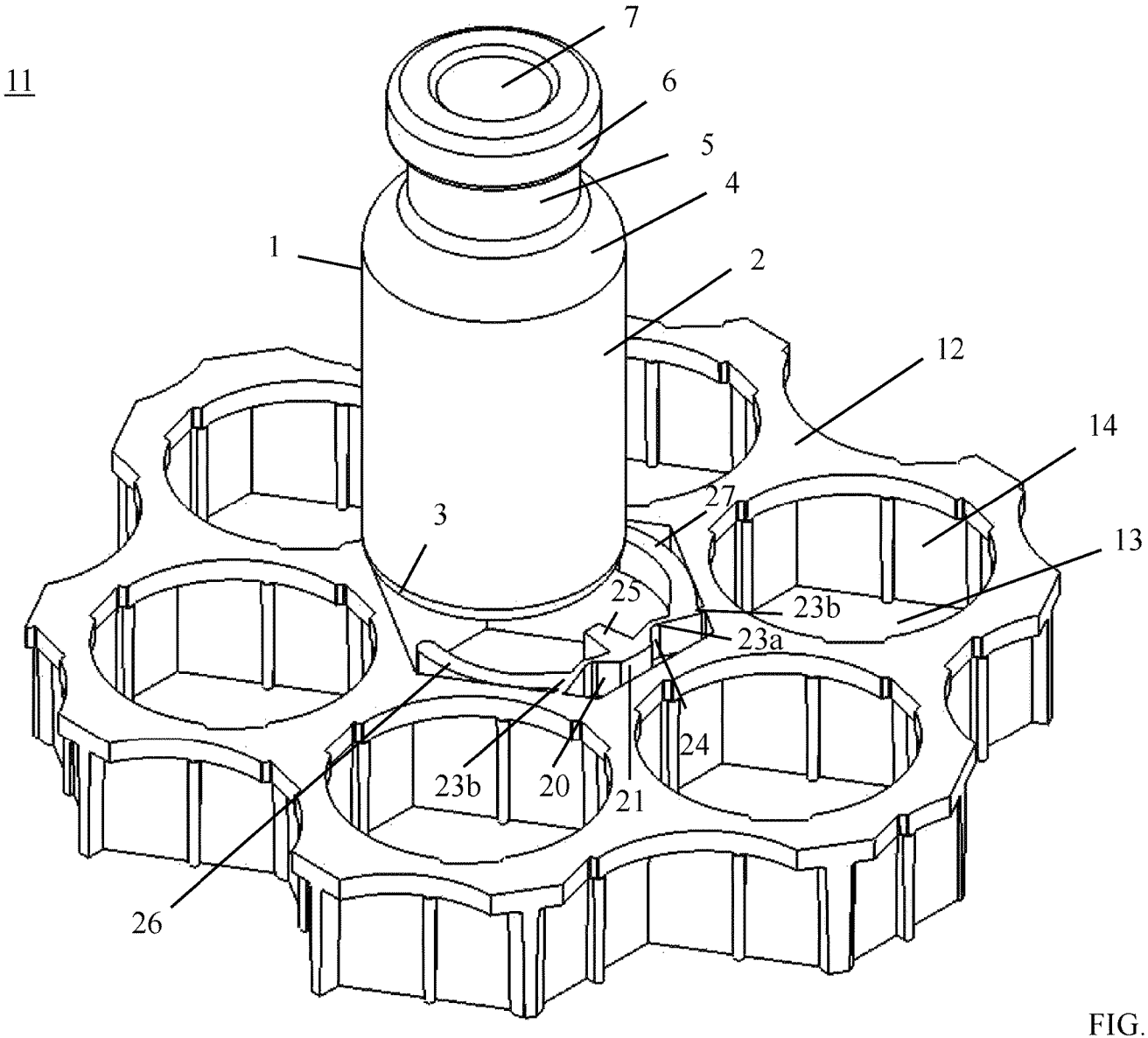

FIGS. 1A-1H show a schematic detail of an exemplary embodiment of a holding structure provided according to the present invention in different stages of insertion, holding and removal of a vial, each in a plan view and in a partial perspective view. For reasons of simplification, only one subunit 11 of the holding structure is shown in the drawings, consisting of a central opening 12 and six openings 13 surrounding it, each of which is surrounded by a peripheral web 12, which forms the actual holding structure. Further details of holding of the vials 1 are shown for reasons of simplification only for the central opening 13. However, the remaining openings of the holding structure are also configured correspondingly.

According to FIG. 1A, two curved holding arms 26, 27 are each pivotally and movably supported in opening 13. To be more precise, the holding arms 26, 27 are supported on a base body 21 so that they can be displaced or adjusted, which base body is of mirror-symmetrical design and has a central projection 25 radially protruding into opening 13. The holding arms 26, 27 are connected to the base body 21 by first film hinges 23*a*. Furthermore, the holding arms 26, 27 are connected by second film hinges 23*b* to the holding bar 12 at the edge of the opening 13 so that they can be flapped or pivoted. The film hinges 23*a*, 23*b* are formed as elastic, flexible webs of relatively small thickness and are warped and deformed in each of the two stable end positions of the holding arms 26, 27 in order to secure the respective end position by elastic biasing. In the open insertion position of the holding arms 26, 27, shown in FIG. 1A, the distance between the holding arms 26, 27 is sufficiently large so that the containers 1 can be inserted into or removed from the respective opening 13. In the first insertion position, the film hinges 23*a*, 23*b* push the holding arms 26, 27 apart by an elastic restoring force, so that the insertion position shown in the drawing represents a stable end position of the holding arms 26, 27. As shown in the corresponding perspective view of FIG. 1B, the vial 1 is inserted from above by lowering into opening 13.

Figure 1C:
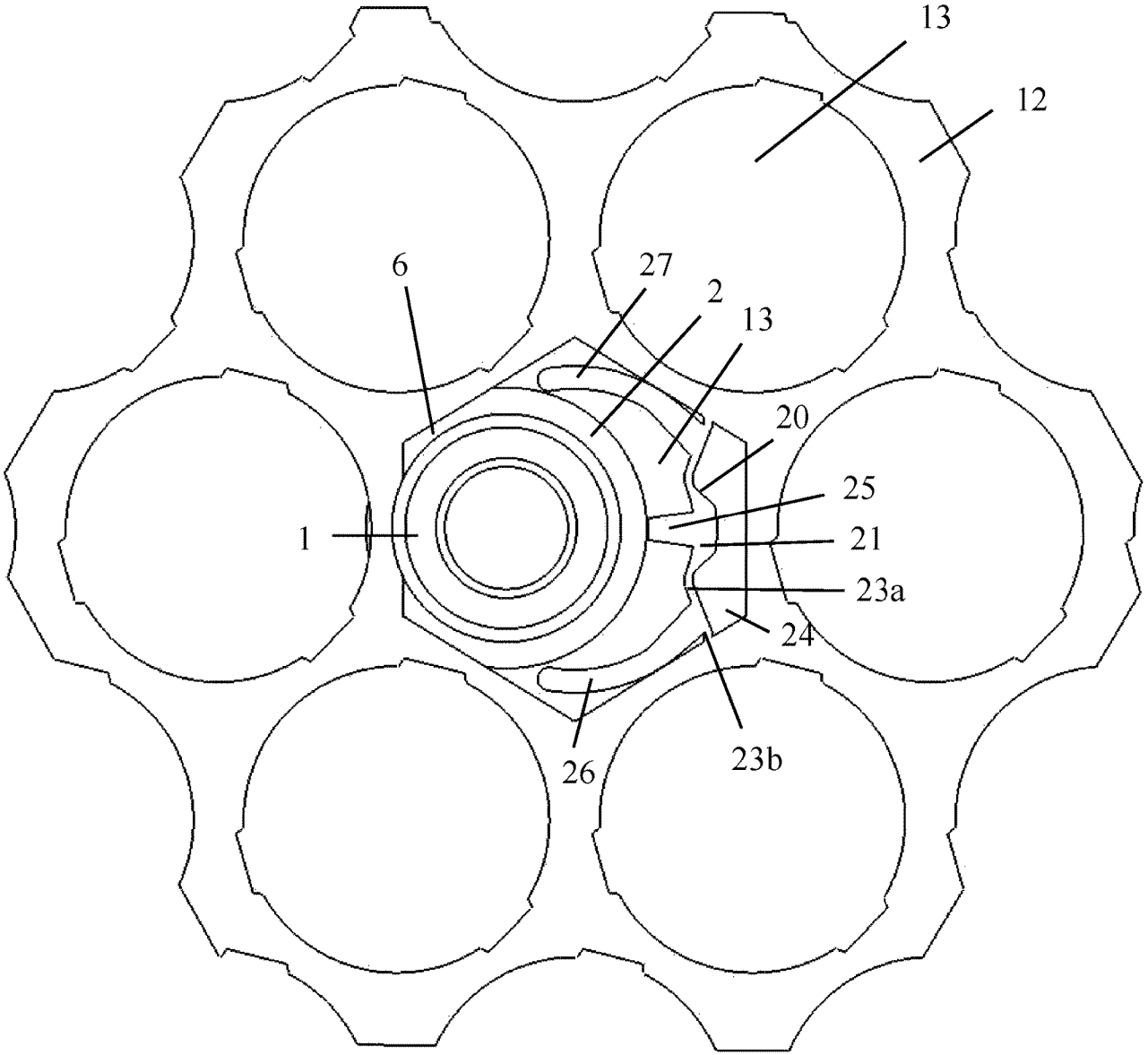
Figure 1D:
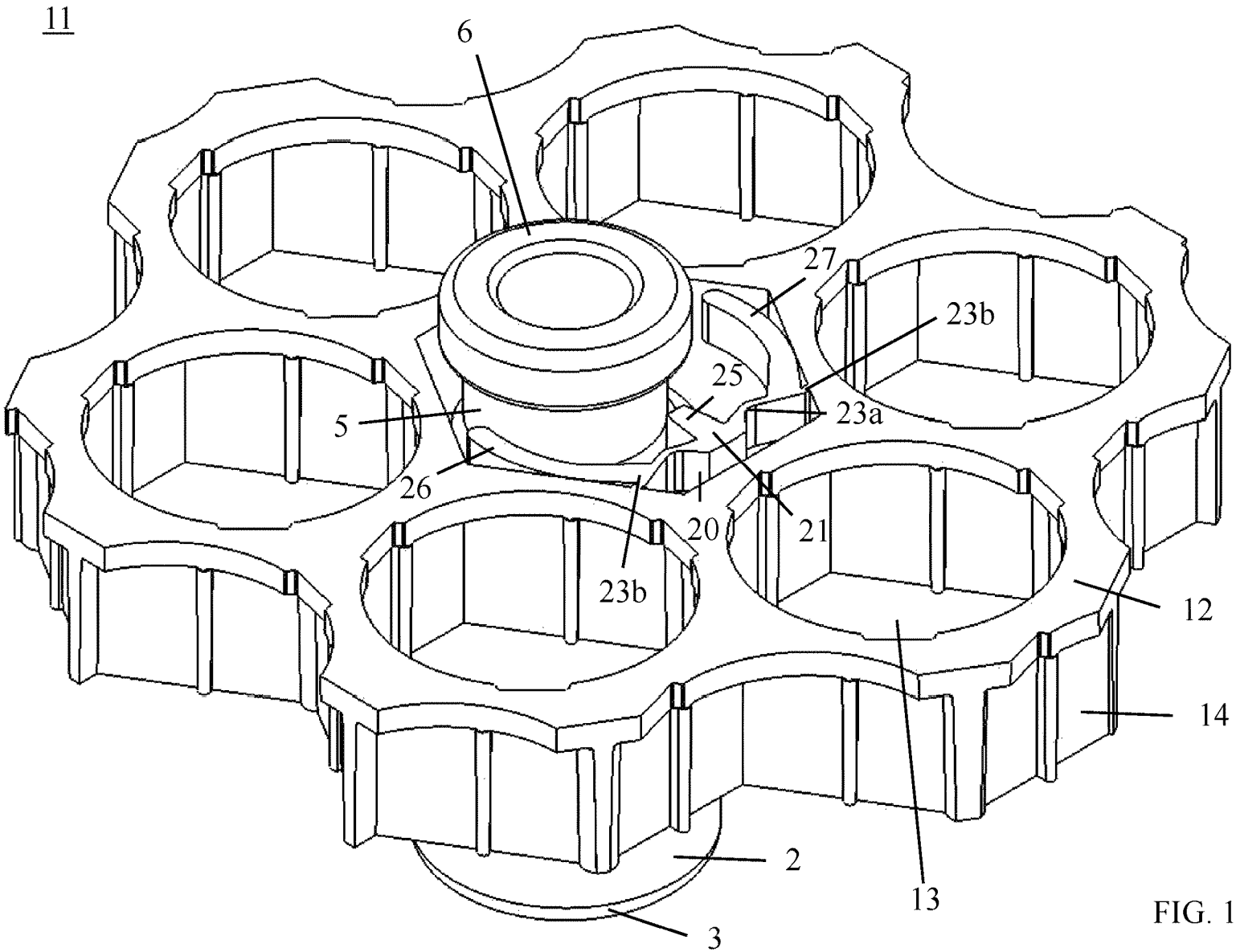

As shown in FIGS. 1C and 1D, in the open insertion position of the holding arms 26, 27, the vial 1 is lowered further into opening 13 until the constricted neck portion 5 of vial 1 has finally reached the level of the projection 25, as shown in FIG. 1D.

Figure 1E:
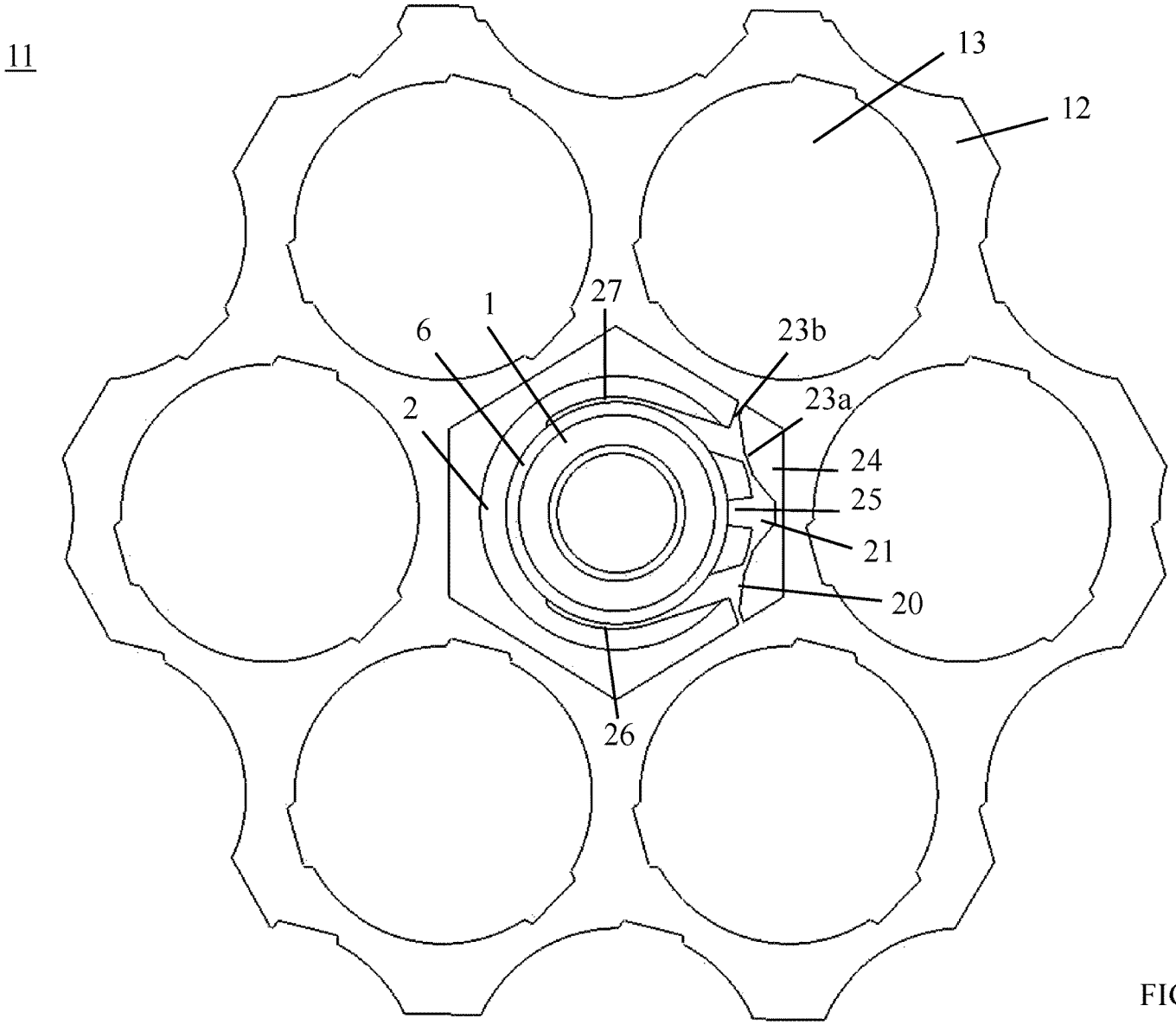
Figure 1F:
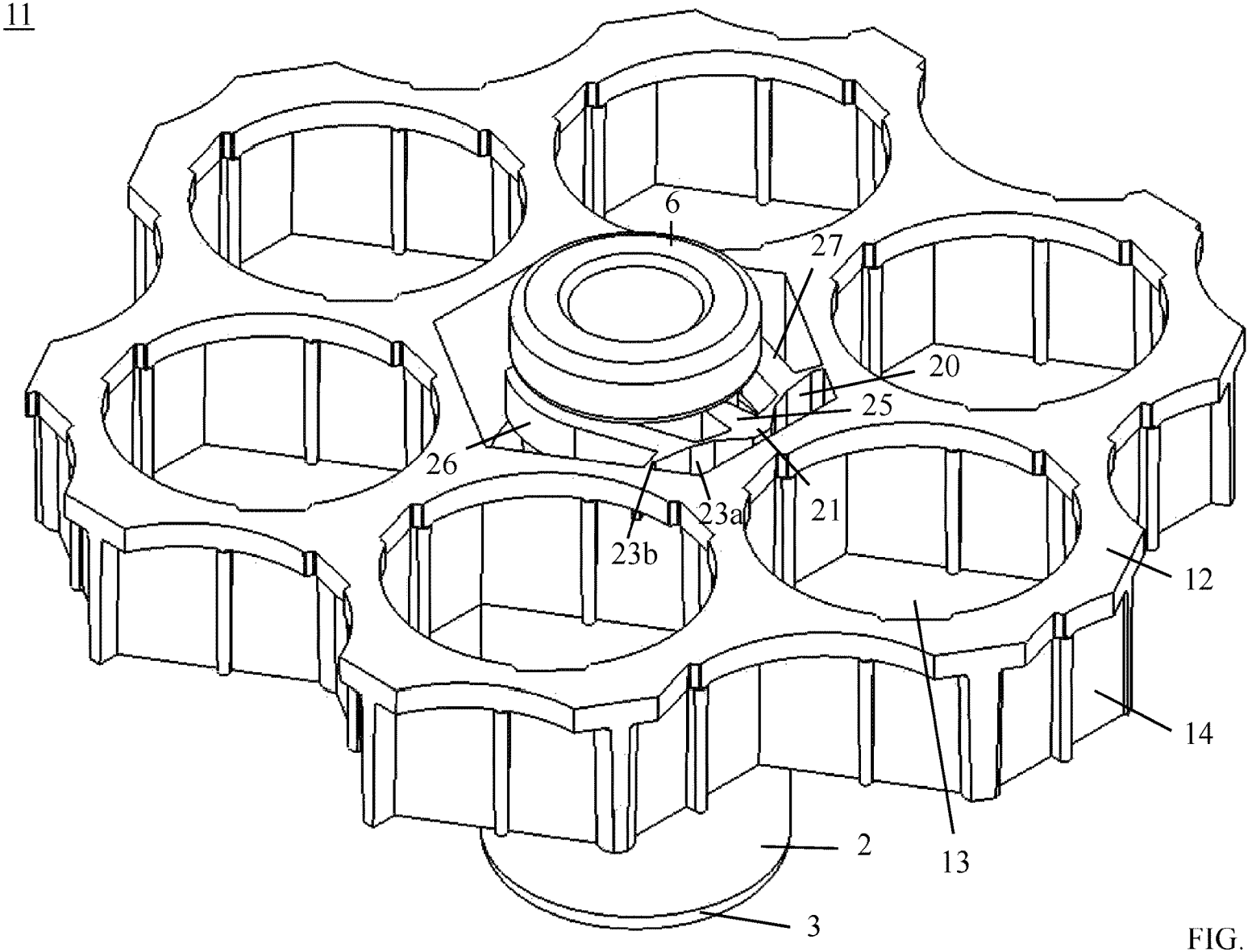
Figure 1G:
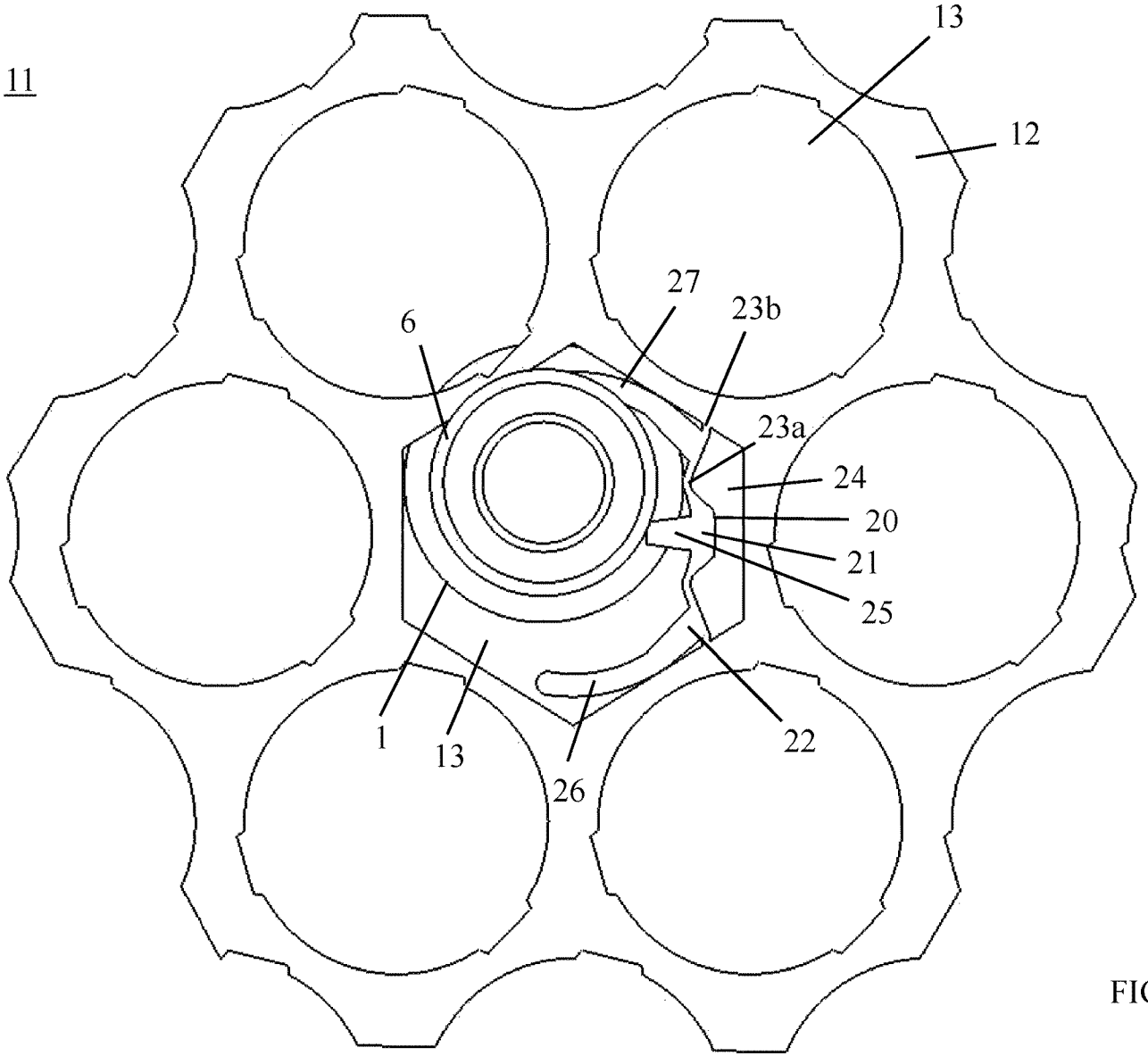
Figure 1H:
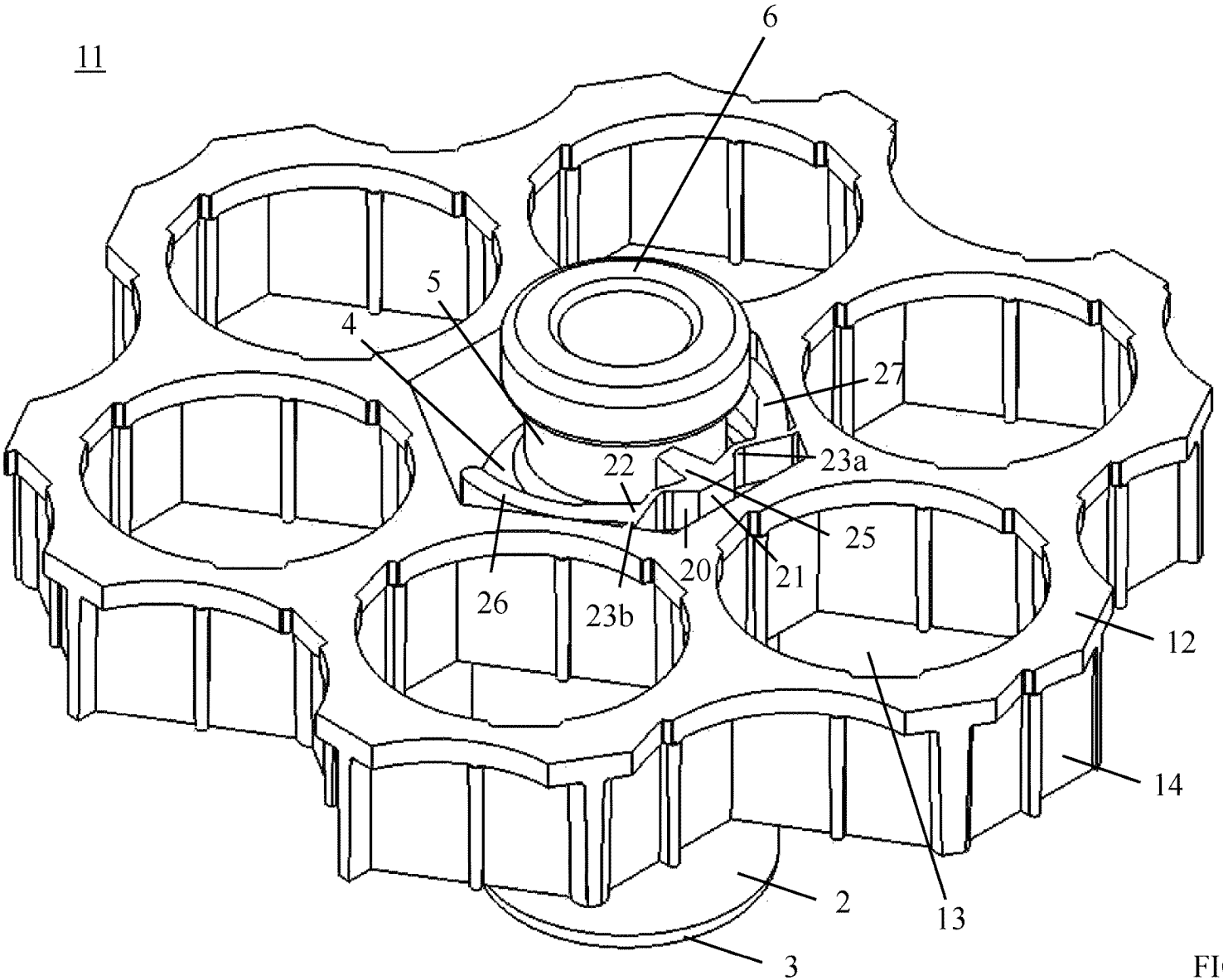
Figure 11:
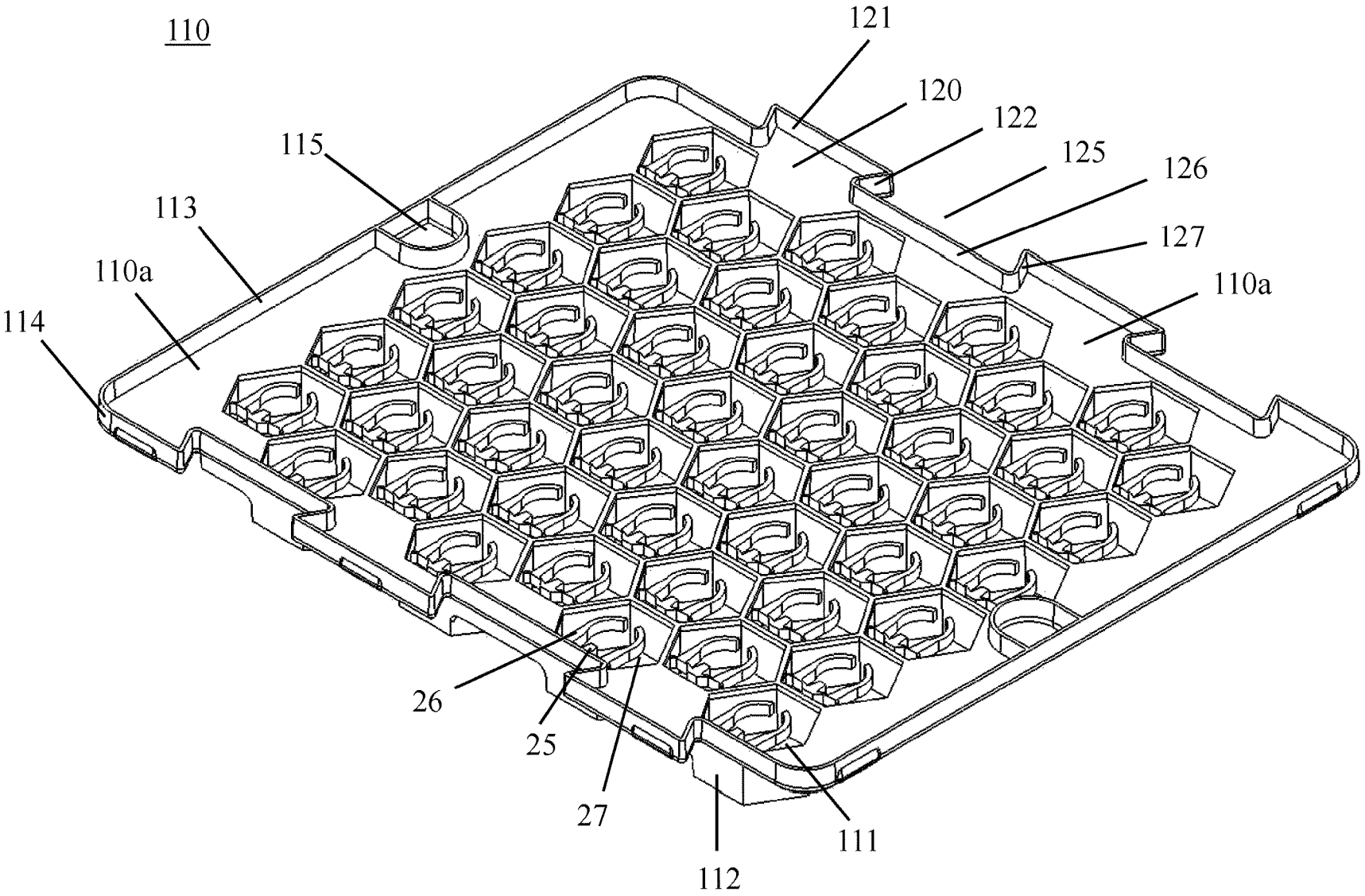

In this position the vial 1 is now displaced radially outwards in the direction of the projection 25 until the constricted neck portion 5 comes in contact with the projection 25 and adjusts this further radially outwards towards the edge of the opening 13. Here, the base body 21 is carried along and the film hinges 23*a*, 23*b* are actuated in order to transfer the holding arms 26, 27 from the open insertion position (first stable end position of the holding arms 26, 27) into the closed holding position (second stable end position of the holding arms 26, 27), in which the constricted neck portion 5 of the vial 1 is clamped by the holding arms 26, 27 and the widened upper rim 6 of the vial 1 can also be positively engaged behind by the holding arms 26, 27, whereby the vial 1 is held axially secured by friction or positive locking in the receptacle 13 of the holding structure. This closed holding position is shown in FIGS. 1E and 1F. According to FIG. 1E, even in the closed holding position there is a gap 24 between the base body 21 and the edge of the opening 13, which does not impede the displacement of the base body 21. In principle, by engaging a control cam in this gap and by adjusting the control cam, the base body may also be displaced in the reverse direction and the holding arms 26, 27 pressed apart back into the open insertion position. According to FIG. 1A, the edge of the opening 13 does not impede the position of the holding arms 26, 27 may be in the open insertion position. For changing into the other stable end position, the elastic restoring force exerted by the film hinges 23*a*, 23*b* must be overcome, which is achieved by overpressing by radially adjusting the projection 25 of the base body 21, which acts as an actuating element.

For changing back from the closed holding position as shown in FIG. 1E into the open holding position, the vial 1 is displaced radially outwards and away from the projection 25 to pivot one of the holding arms 26, 27 outwards relative to the base body 21 until the elastic restoring force exerted by the film hinges 23*a*, 23*b*, which secures the closed holding position, is overcome so that the holding arms 26, 27 then return to the open insertion position. In this open insertion position, the vial 1 can be removed from opening 13 vertically upwards without friction.

FIG. 1I shows a specific example of a holding structure 110 using the principle described above in FIGS. 1A-1A. According to FIG. 1I, the holding structure 110 is formed by a planar carrier 110*a*, in which the openings 111 are arranged in a regular arrangement. A circumferential side wall 113 extends along the edge of the carrier 110*a* and perpendicular to the carrier 110*a*. The carrier 110*a* can be gripped and handled via access openings 115 by a gripper or robot. On the underside of the carrier 110*a*, the openings 111 are limited by side walls 112, which are formed circumferential. Holding devices are provided in the openings 111, the operation of which has been described above with reference to FIGS. 1A-1H. The holding structure may be made of plastic material, for example by injection molding or 3D printing.

A plurality of projections 120 and recesses 125 are formed alternately and at regular intervals to each other along the two longitudinal sides of the carrier 110*a*. These have an overall triangular or polyhedral base area if viewed from above and are formed corresponding to each other so that the projections 120 and recesses 125 of such a holding structure 110 can be hooked in the manner of a dovetail joint directly with projections and recesses of a holding structure (not shown) of a similar configuration. Along the edges 121, 122 of the projections 120 and along the edges 126, 127 of the recesses 125, the upright side wall 113 of the carrier 110*a* follows the contour of the associated projection 120 and of the associated recess 125, respectively, whereby sliding of a carrier 110*a* over or onto another carrier 110*a* of the same design (not shown) can be prevented when two carriers are hooked together.

Figure 1J:
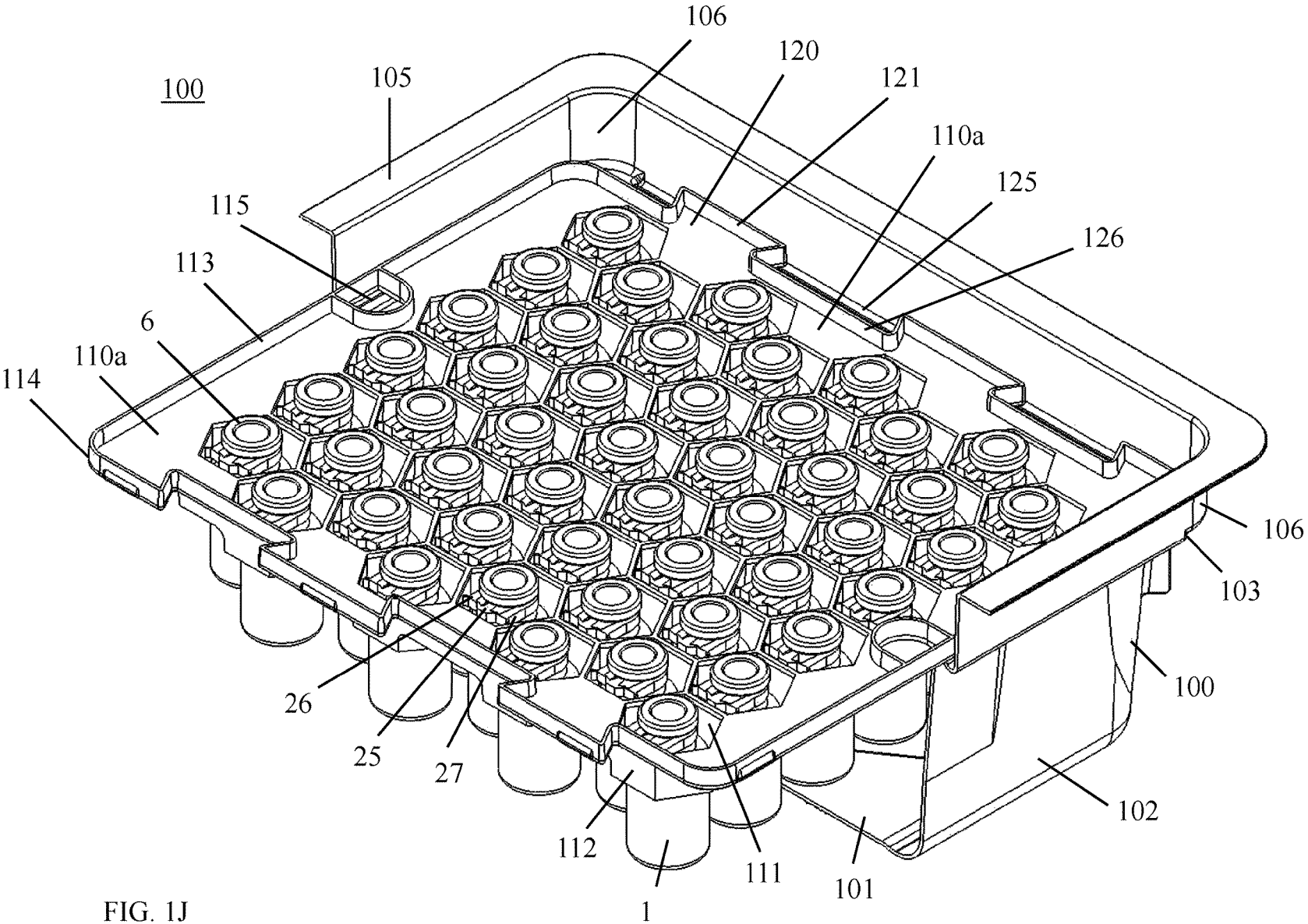
FIG. 1J shows in a perspective representation and in a partial section, a transport and packaging container comprising the holding structure illustrated in FIG. 1I and containers held thereon.

A transport and packaging container (also referred to as a 'tub') as shown in FIG. 1J may be used to accommodate such a holding structure 110 (also referred to as a 'nest') with or without containers held thereon. According to FIG. 1J, the transport and packaging container 100 is substantially box-shaped or trough-shaped and has a closed bottom 101, a circumferential side wall 102 projecting perpendicularly therefrom, a step 103 projecting substantially at a right angle therefrom, a circumferential upper side wall 104 and an upper rim 105 which is formed like a flange. The corners 106 of the transport and packaging container 100 are appropriately rounded. The top sidewall 104 may be inclined at a slight angle relative to a line perpendicular to the bottom 101 to facilitate insertion of the holding structure 110. Such a transport and packaging container 100 may be made of a clear, transparent plastic material, in particular by plastic injection molding or 3D printing, in order to enable an optical visual inspection of the holding structure 110 accommodated in the transport and packaging container 100 and of the containers 1 held by it.

In principle, also the lower end of the transport and packaging container 100 may be open in the manner of the upper end, in particular it may be provided with a flange-like lower edge in the manner of the upper rim 105, so that the bottoms of the vials 120 are freely accessible from the underside of the transport and packaging container 100, for example for processing steps carried out in a sterile tunnel or in a freezer-dryer.

For the transport or storage of the containers 1, the transport or packaging container 100 is closed by a protective film or packaging film (not shown) adhered to the upper rim 105, for example by a gas-permeable plastic film, in particular by a TYVEK® protective film, which enables sterilization of the containers 1 held by the holding structure 110 also through the protective film.

Figure 2A:
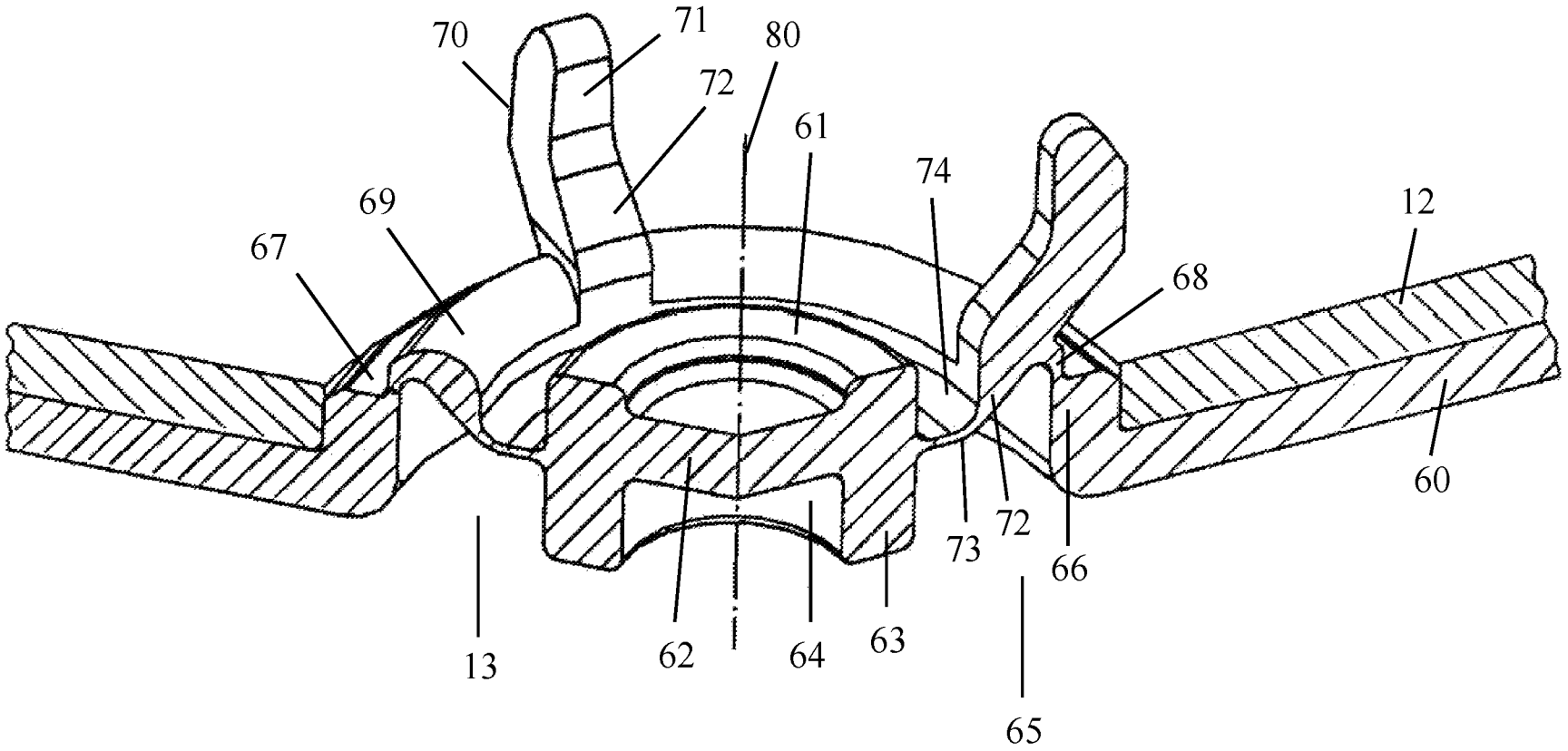
FIGS. 2A-2B show a detail of another exemplary embodiment of a holding structure provided according to the present invention in an open insertion position and in a closed holding position.
Figure 2B:
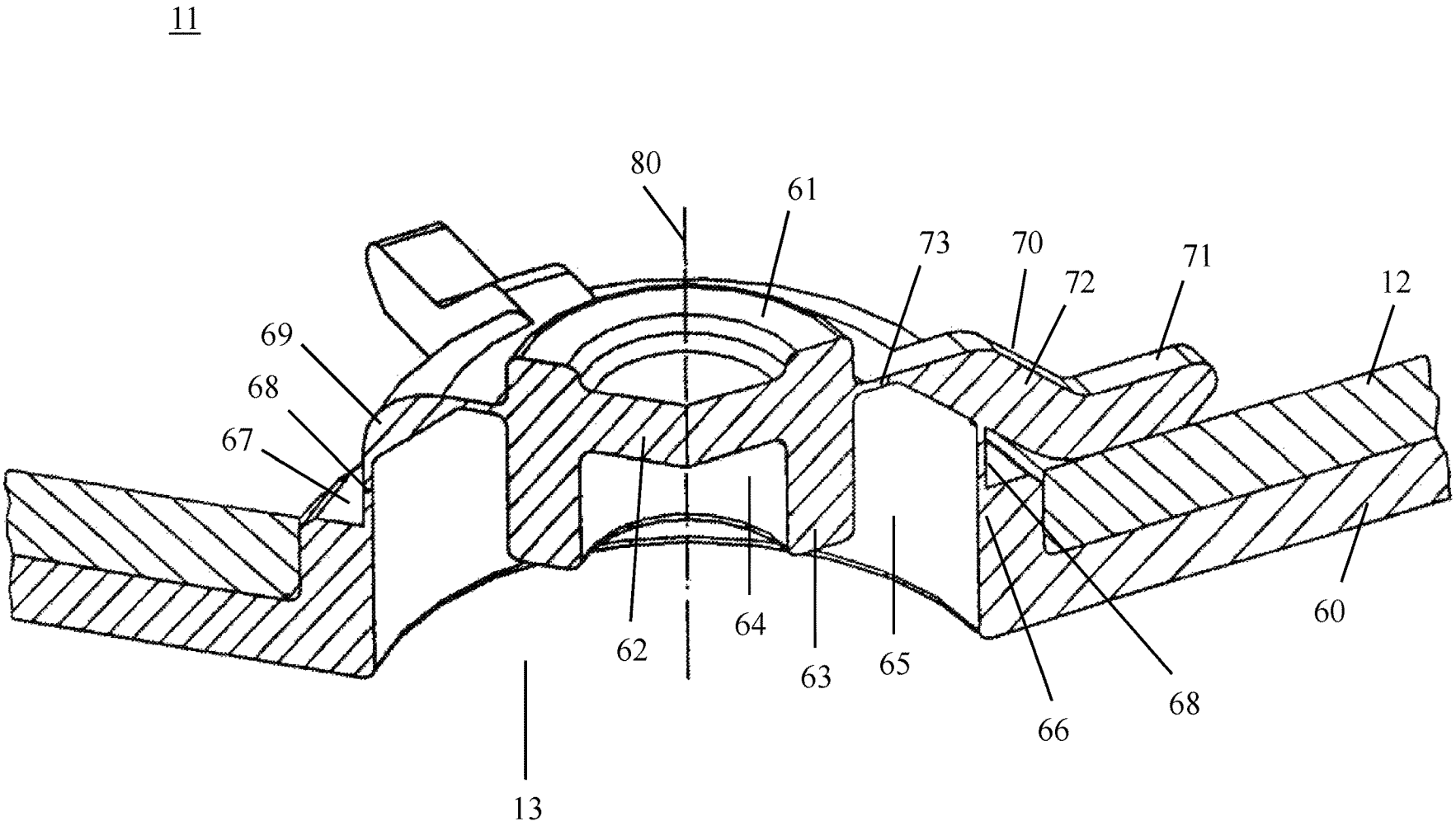

Referring to FIGS. 2A and 2B, another exemplary embodiment according to the present invention is illustrated. In these drawings again only a subunit 11 of the holding structure is shown, which may be incorporated in the holding structure 110 of FIG. 1I in place of the subunit 11 illustrated in FIGS. 1A-1H, wherein the vial to be held is not shown for reasons of simplification. According to FIG. 2A, an additional layer 60 of an elastic, flexible plastic material is injected in the region of opening 13 onto the peripheral web 12 of the holding structure using a two-component injection molding technology (2K injection molding technology), which is made of a plastic material and forms an actuating element 61 and a plurality of holding arms 70. According to FIG. 2A, the actuating element 61 is formed as a cylindrical body having a closed top surface 62, wherein an annular gap 65 is formed between an edge of the respective opening 13 of the holding structure and the actuating element 61, which is bridged by the first film hinge 73, by a portion 72 of the holding arms 70 and by a second film hinge 68. The actuating element 61 is configured and arranged in such a manner that it can be adjusted in the respective opening 13 perpendicularly to a plane spanned by the holding structure, i.e. in a direction parallel to the axis of symmetry 80. The holding arms 70 are each pivotably connected to the actuating element 61 by a first film hinge 73 and are each connected to the carrier 11 by a second film hinge 68, so that the holding arms 70 can be transferred from the first stable end position of the holding arms 70 into the second stable end position of the holding arms 70 by adjusting the actuating element 61 perpendicularly to the holding structure.

FIG. 2A shows the closed holding position of the holding arms 70, in which the holding claws 71 at their front free ends either clamp the vial (not shown) or hold it axially secured by a positive locking, in particular by engaging behind a widened upper rim of the vial. For this purpose, the holding claws 71 may also project further radially inwards into the opening 13.

According to FIG. 2A, the first film hinge 73 is configured to be circumferential, but this is not absolutely necessary. In this manner the entire opening 13 is closed. The position of the upper side 62 of the actuating element 61 is only schematically shown. The actuating element 61 may also be arranged far below the peripheral web 12 in order to enable the vials to be accommodated in the openings of the holding structure.

FIG. 2B shows the open holding position of the holding arms 70, in which the holding claws 71 are spread apart to such an extent that a container can be inserted into or removed from the respective opening 13. As one can easily conclude from a comparison of the drawings, there is a clear height offset of the actuating element 61 between the two end positions, which corresponds to the movement path of the holding arms 70 during their pivoting movement.

Figure 3A:
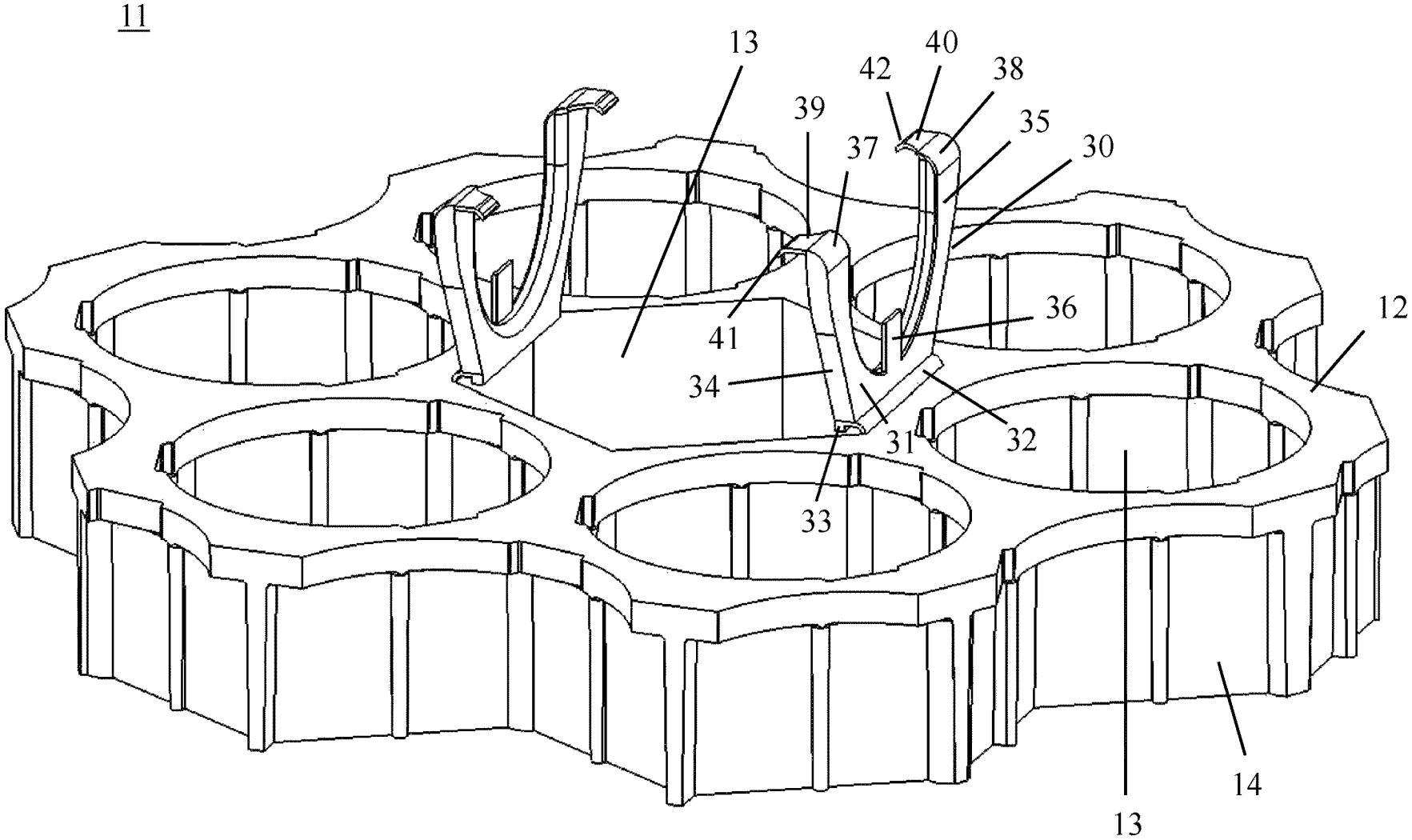
FIGS. 3A-3N show a detail of another exemplary embodiment of a holding structure provided according to the present invention in different stages of insertion and holding of a vial.
Figure 3B:
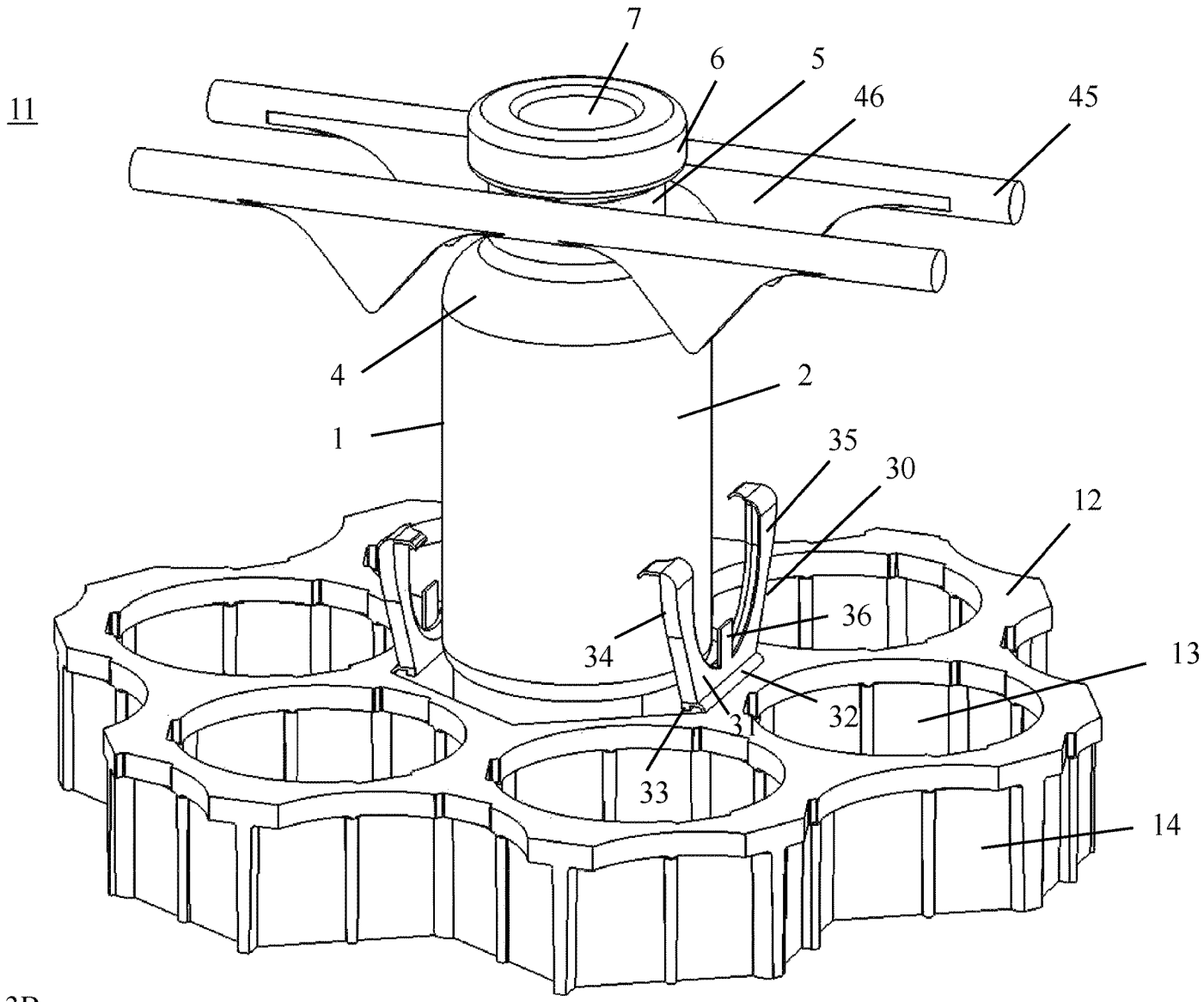
FIG. 3O shows in a perspective plan view the holding structure illustrated in FIGS. 3A-3N.
FIG. 3P shows in a perspective representation and in a partial detail a transport and packaging container with the holding structure illustrated in FIGS. 3A-3O and containers held thereon.
Figure 3C:
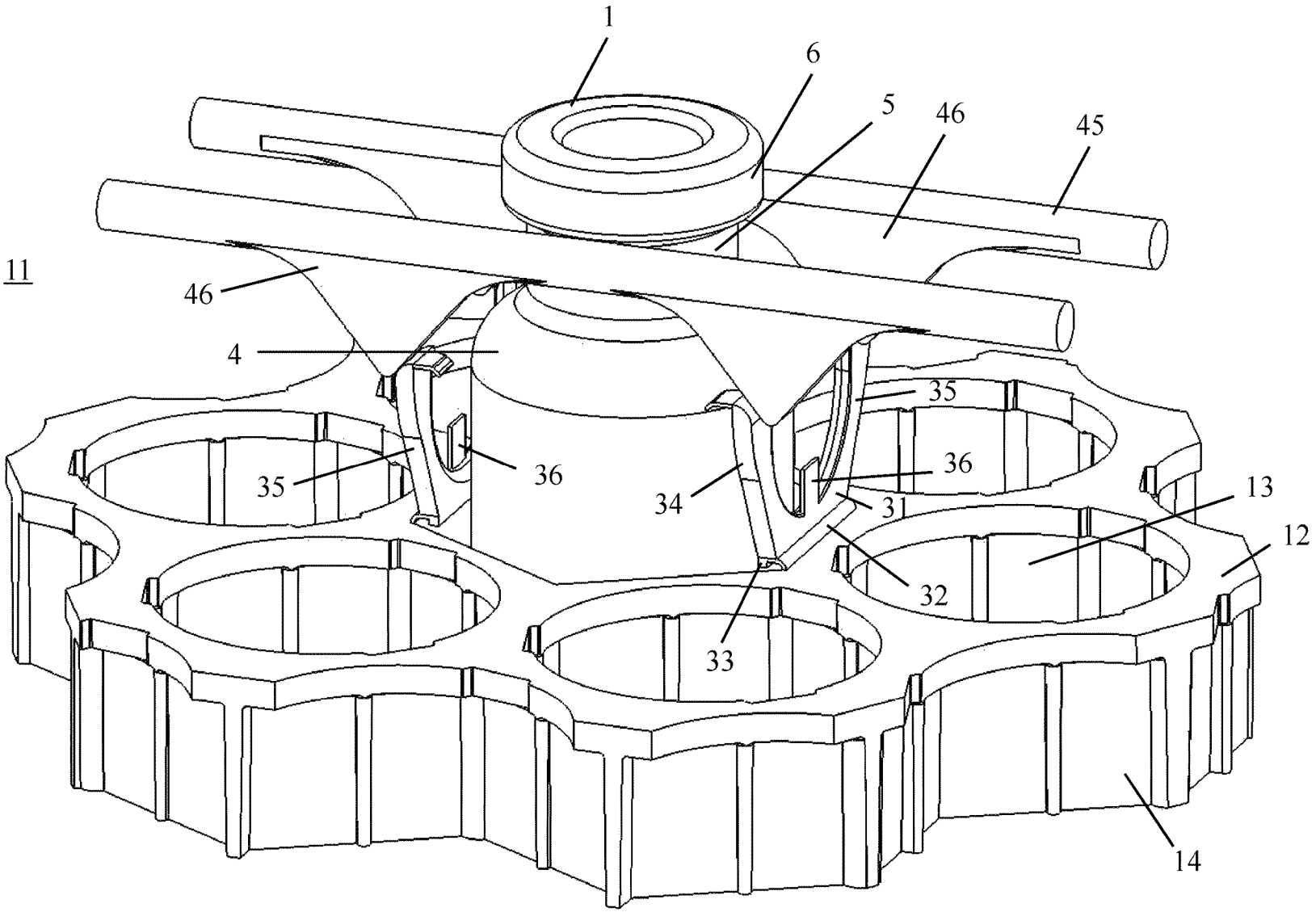
Figure 3D:
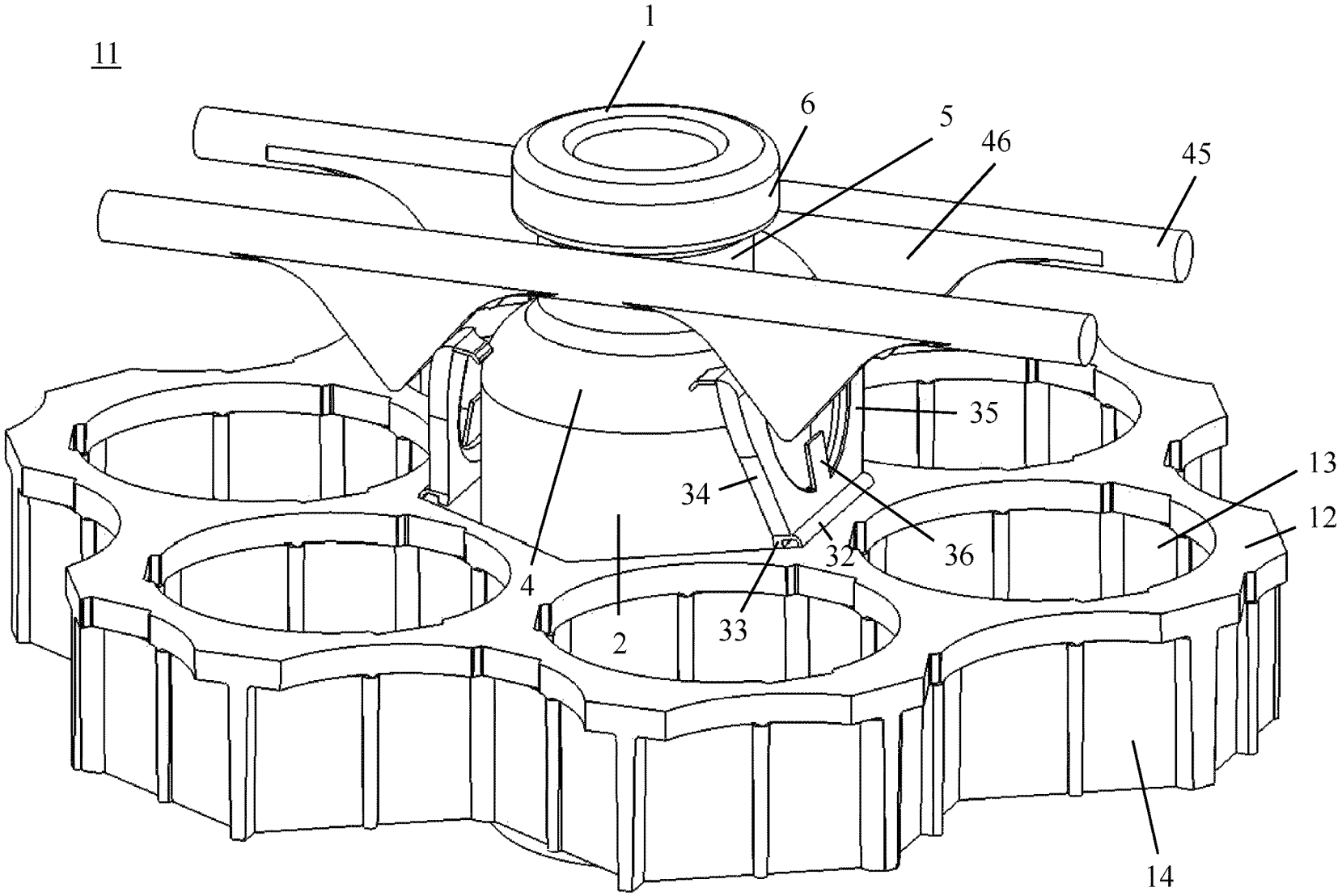
Figure 3E:
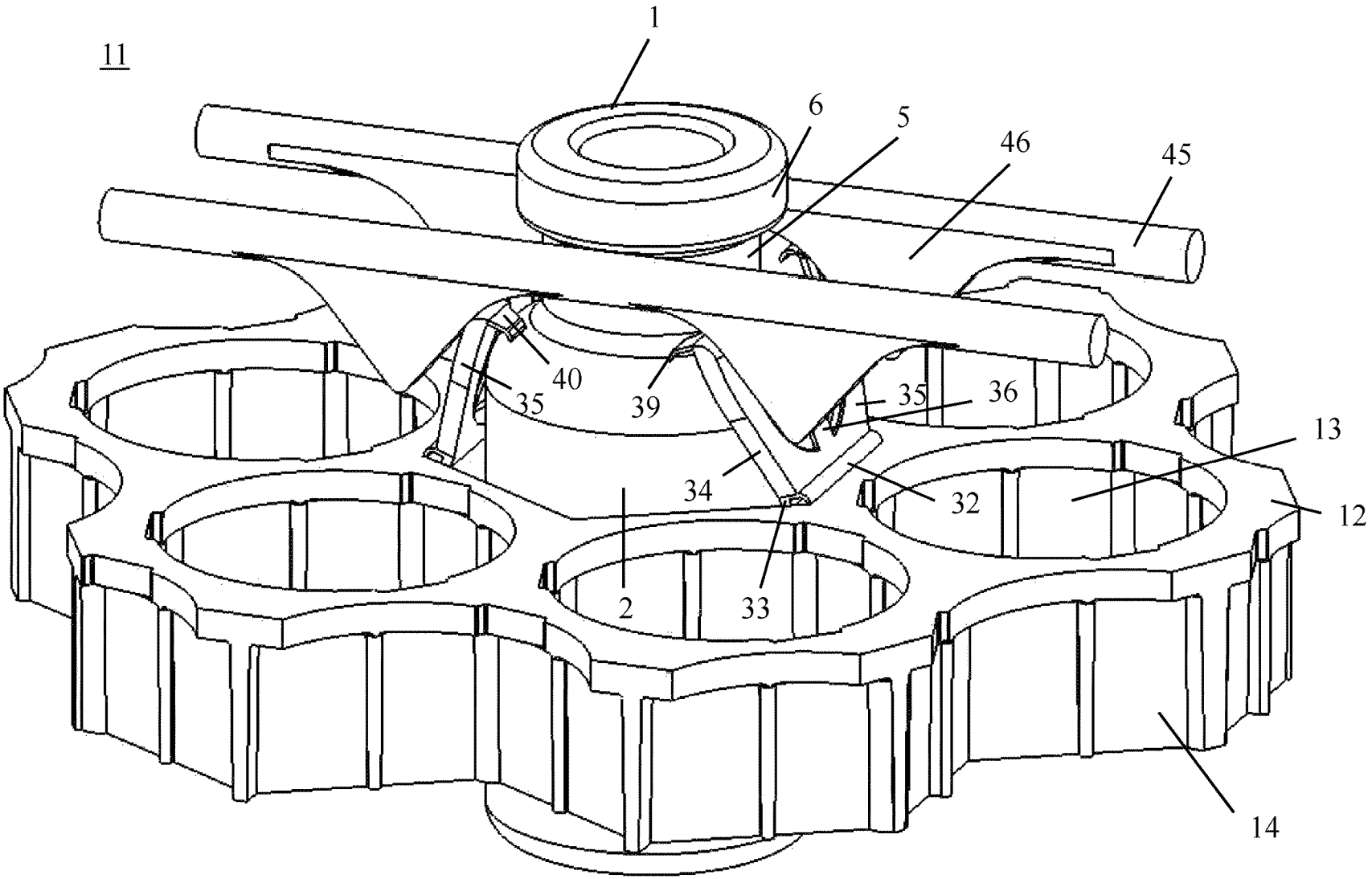
Figure 3F:
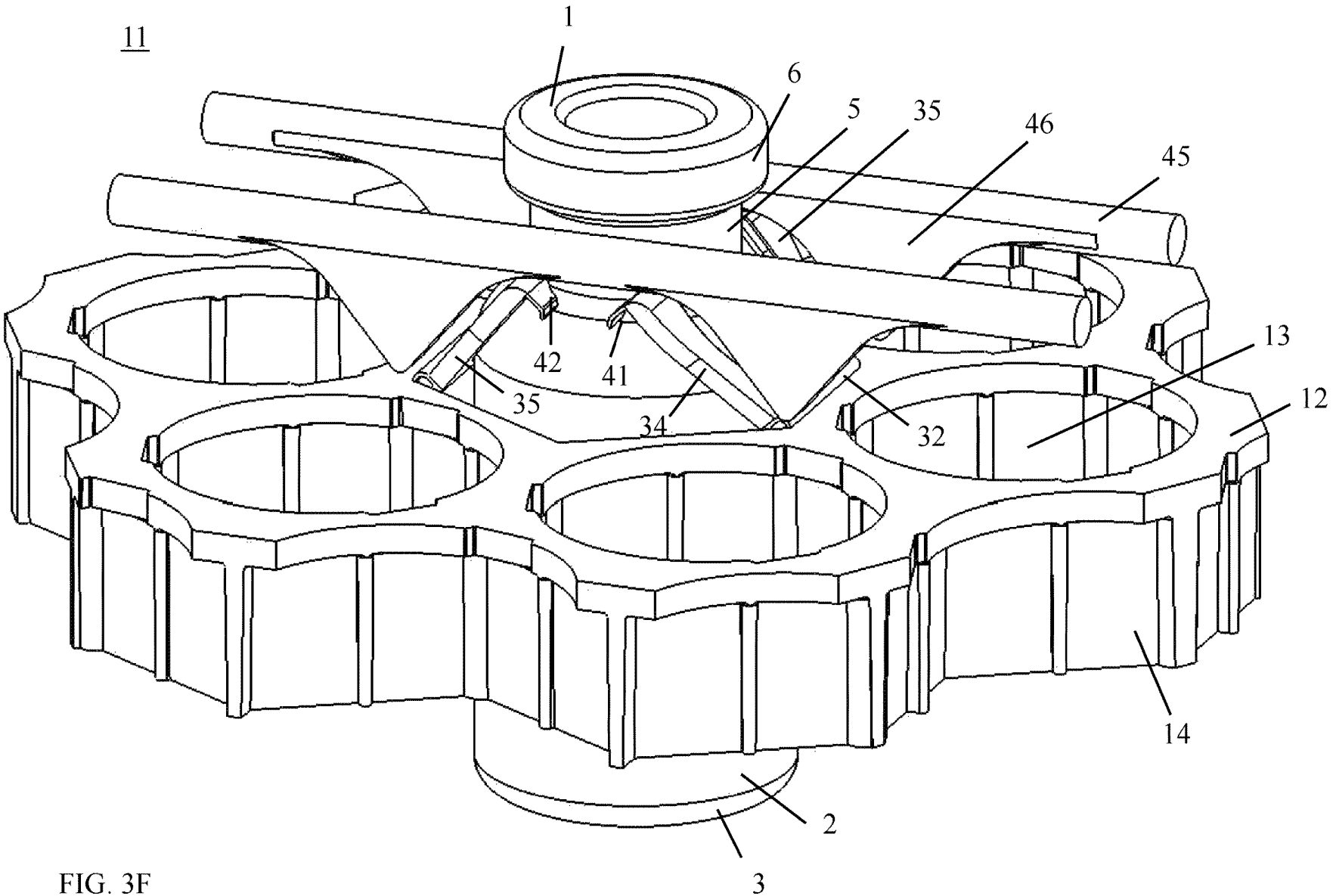
Figure 3G:
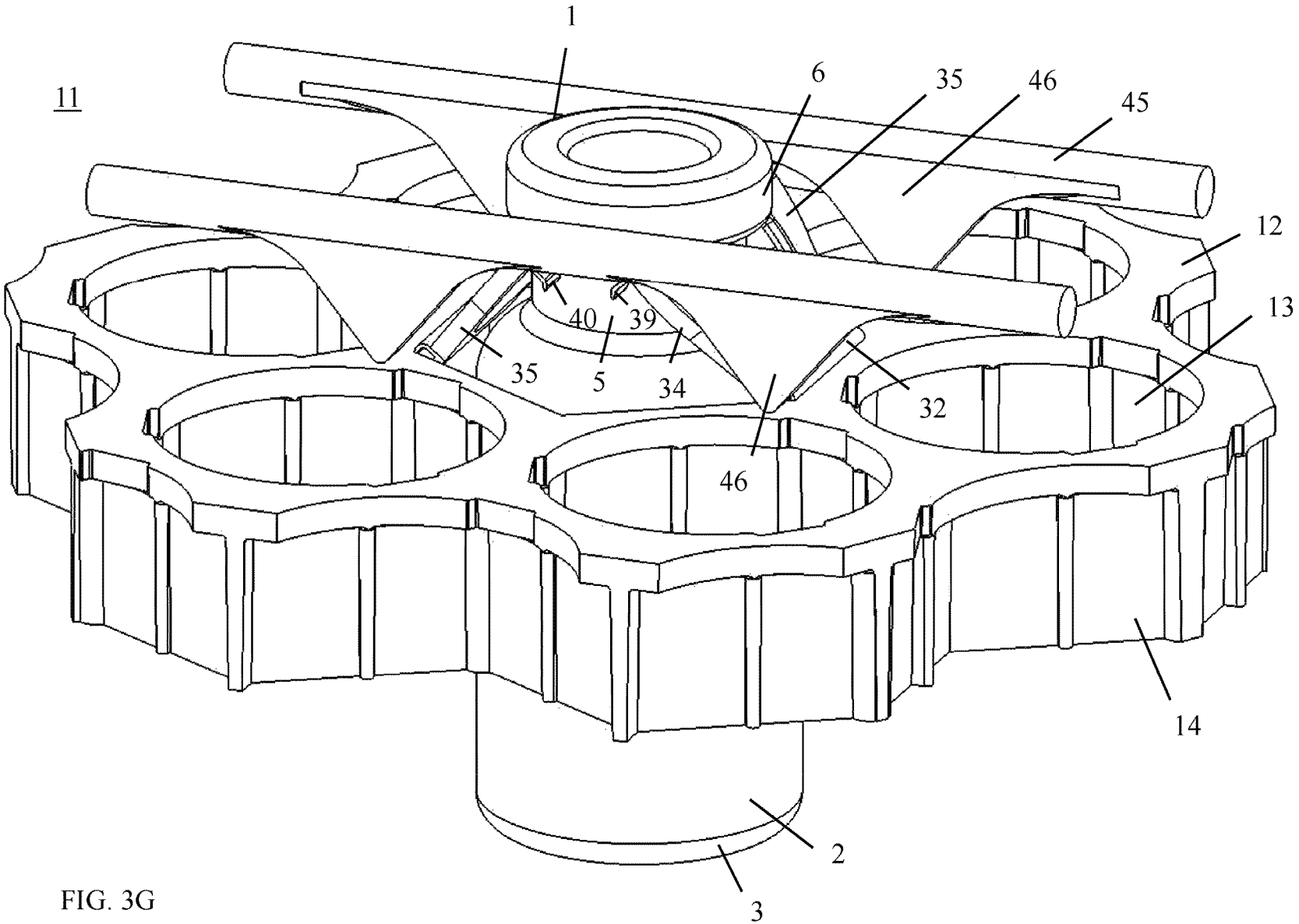
Figure 3H:
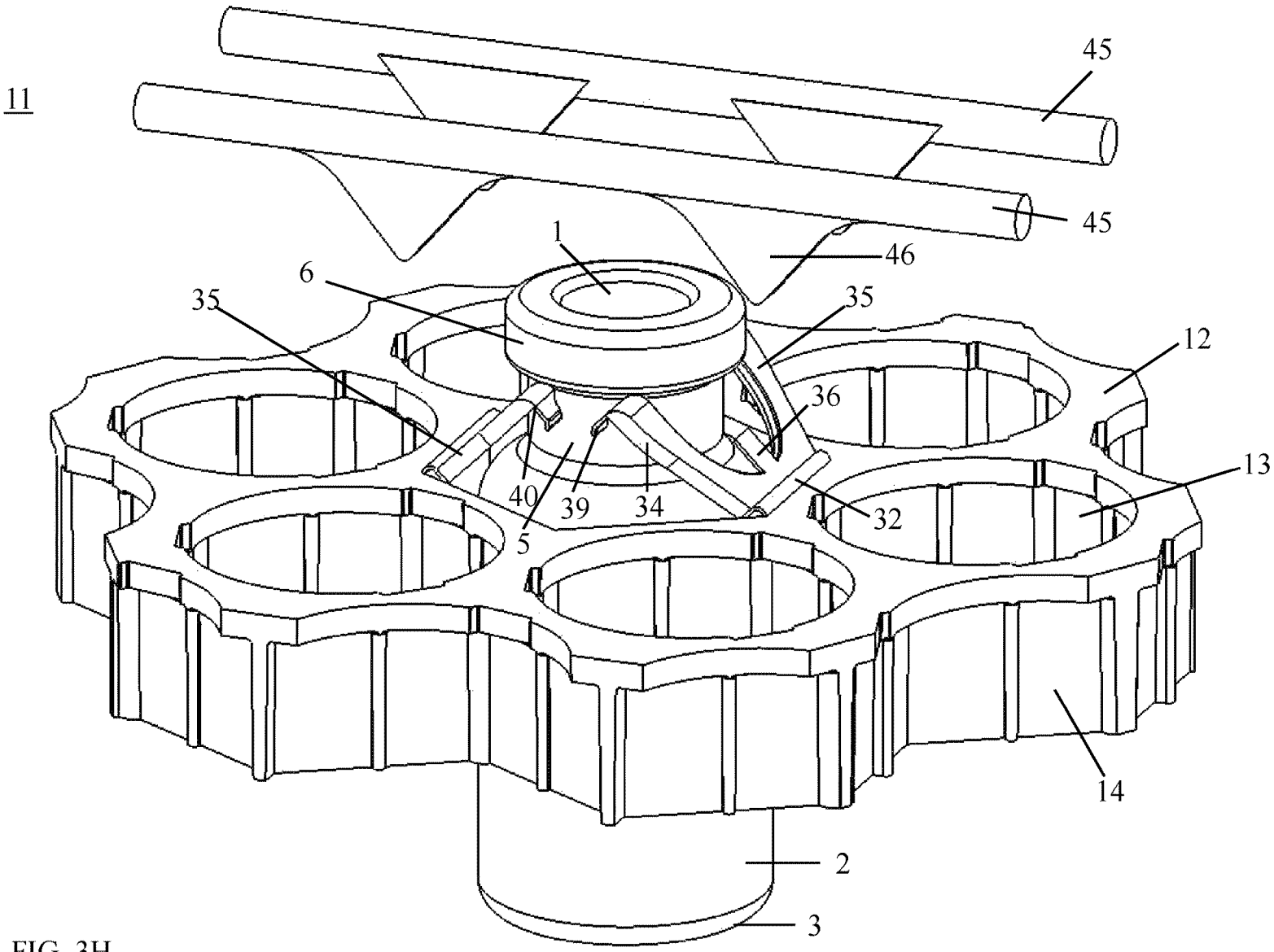
Figure 3I:
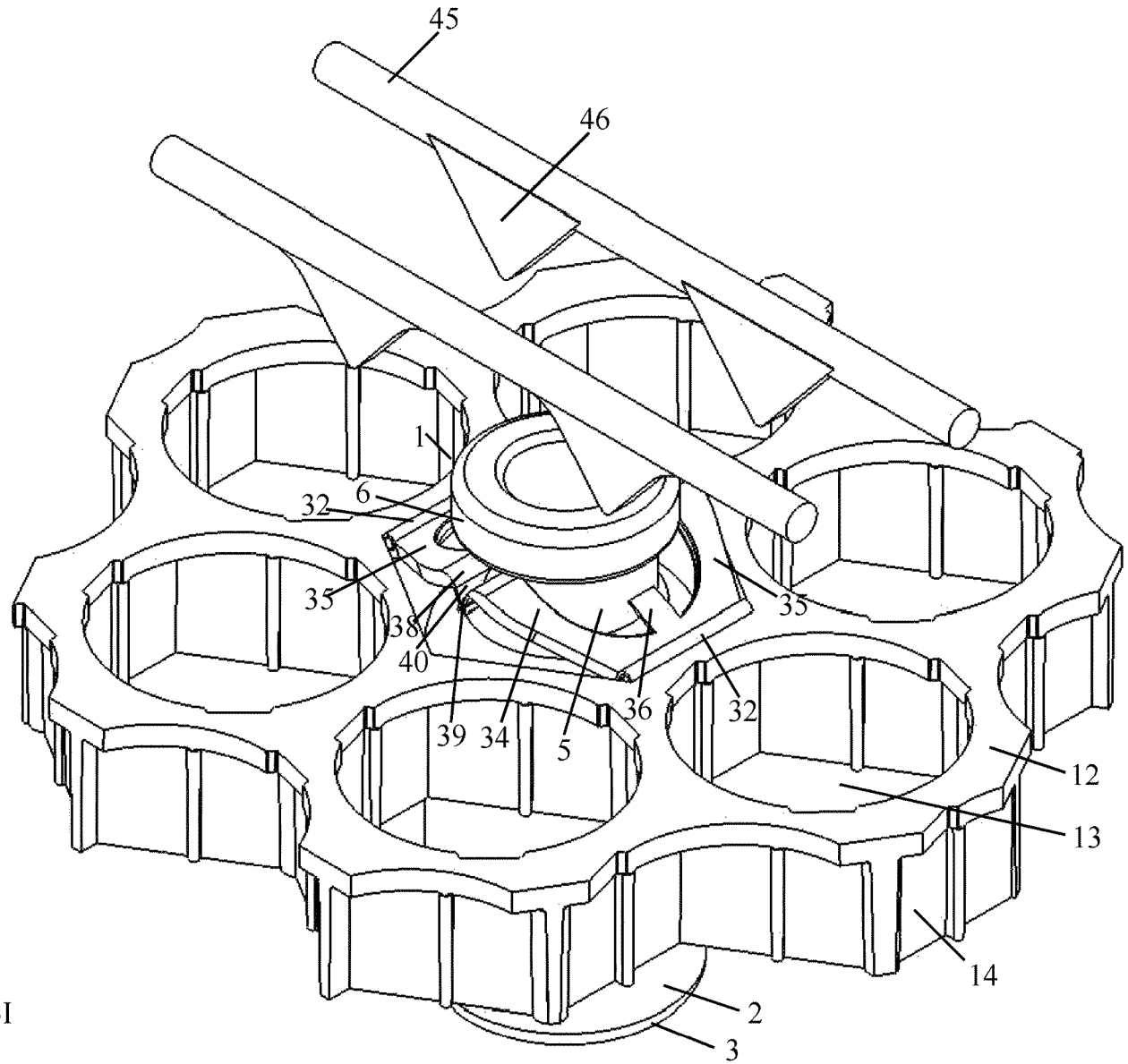
Figure 3J:
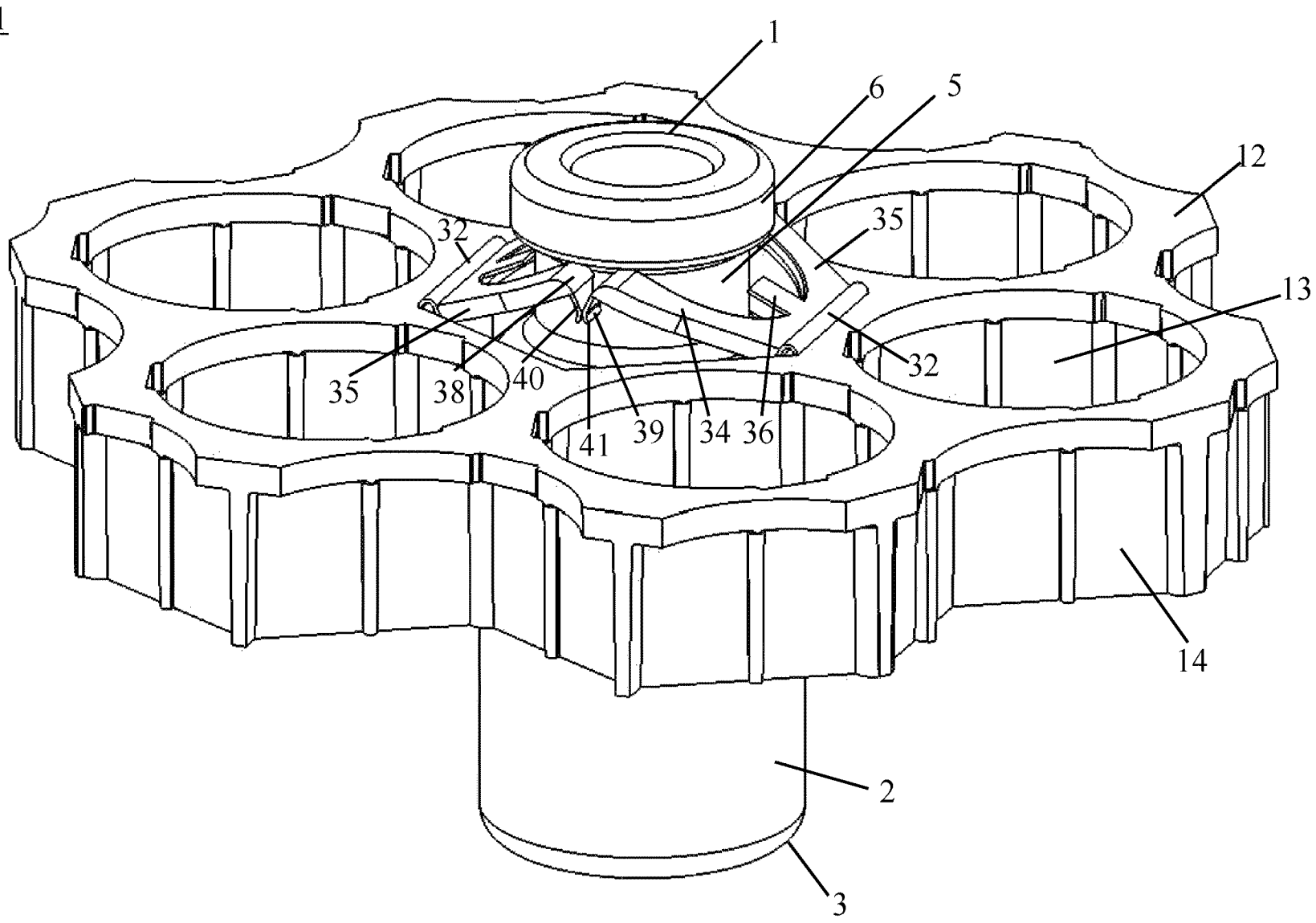
Figure 3K:
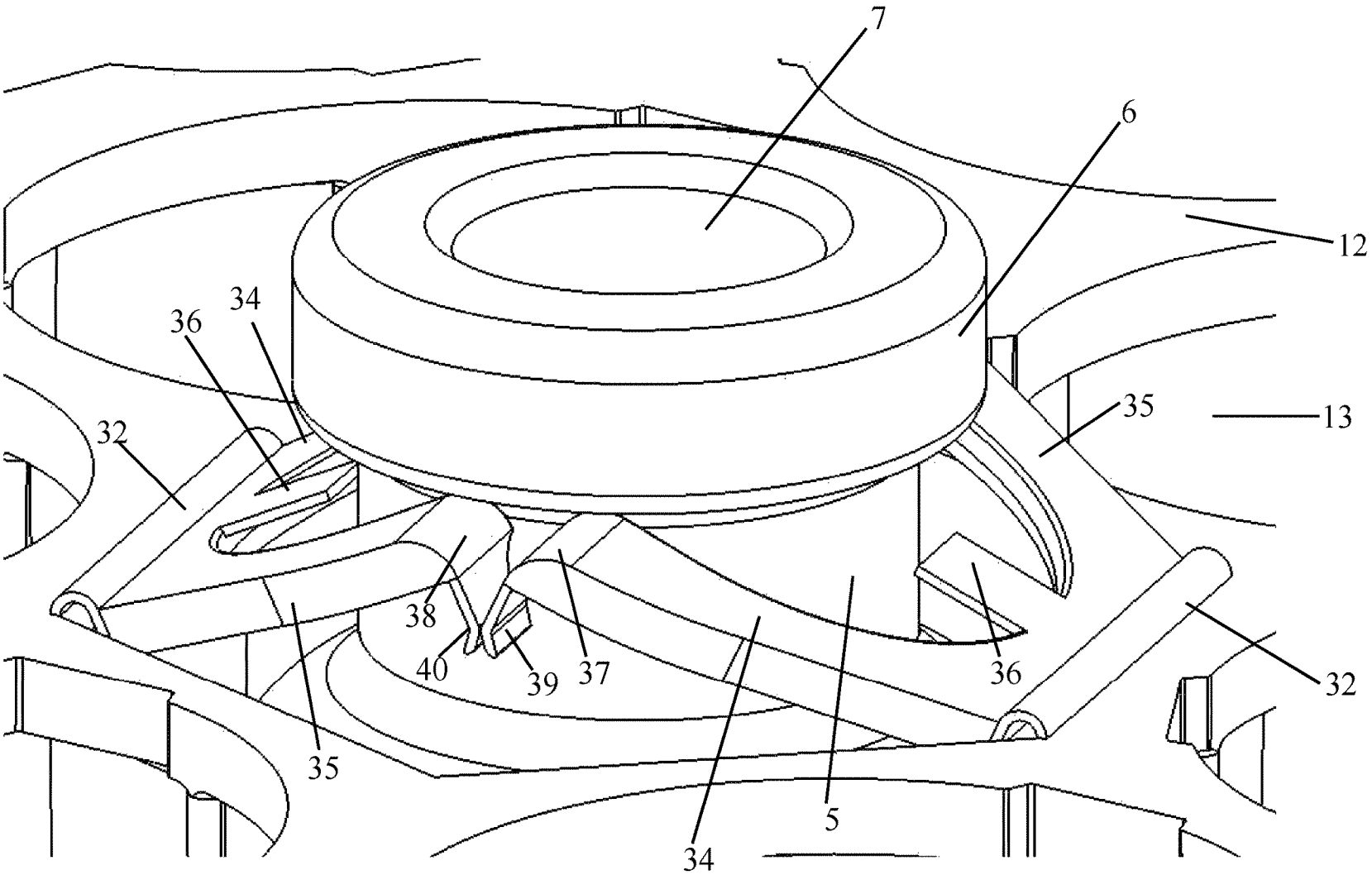
Figure 3L:
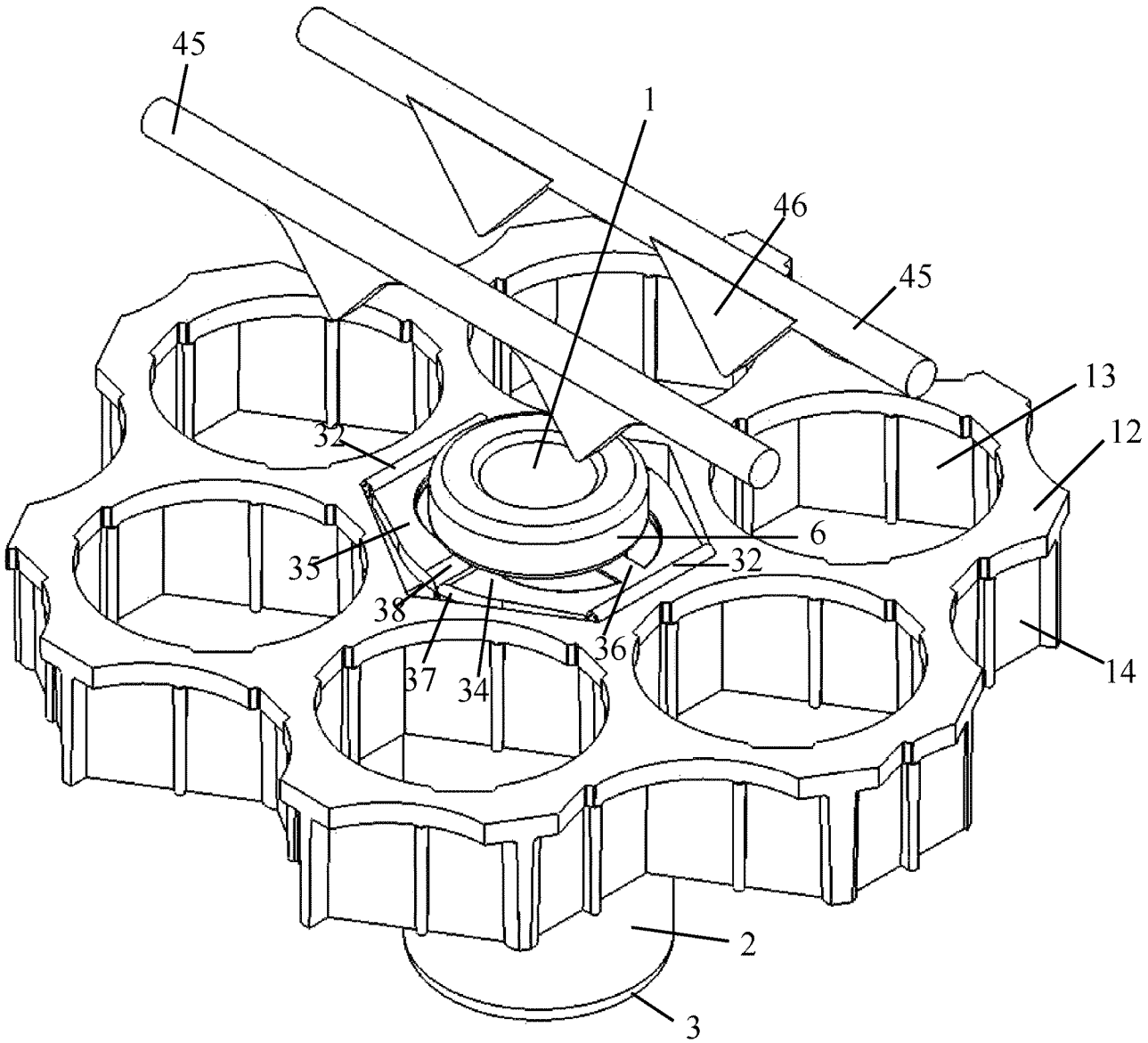
Figure 3M:
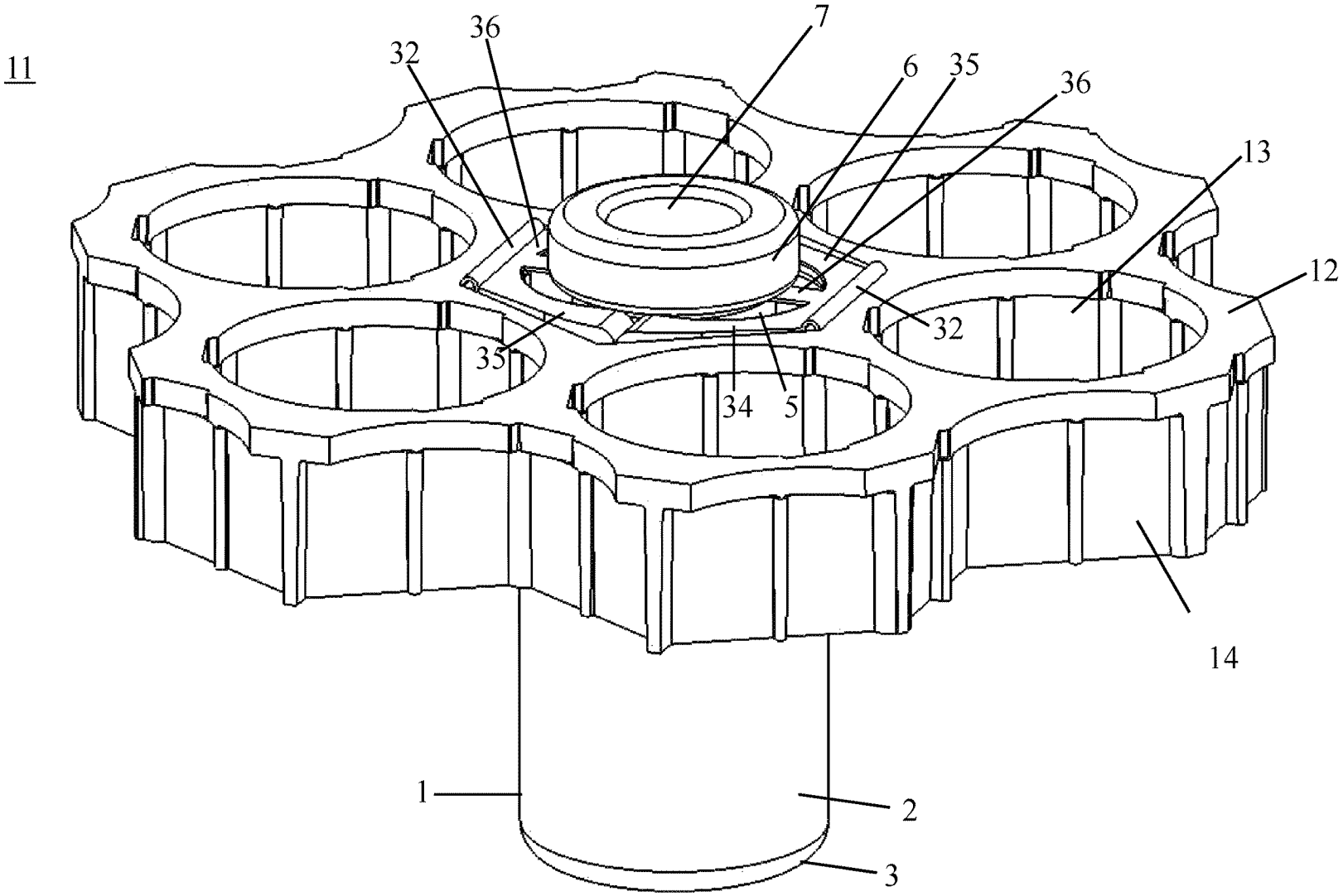
Figure 3N:
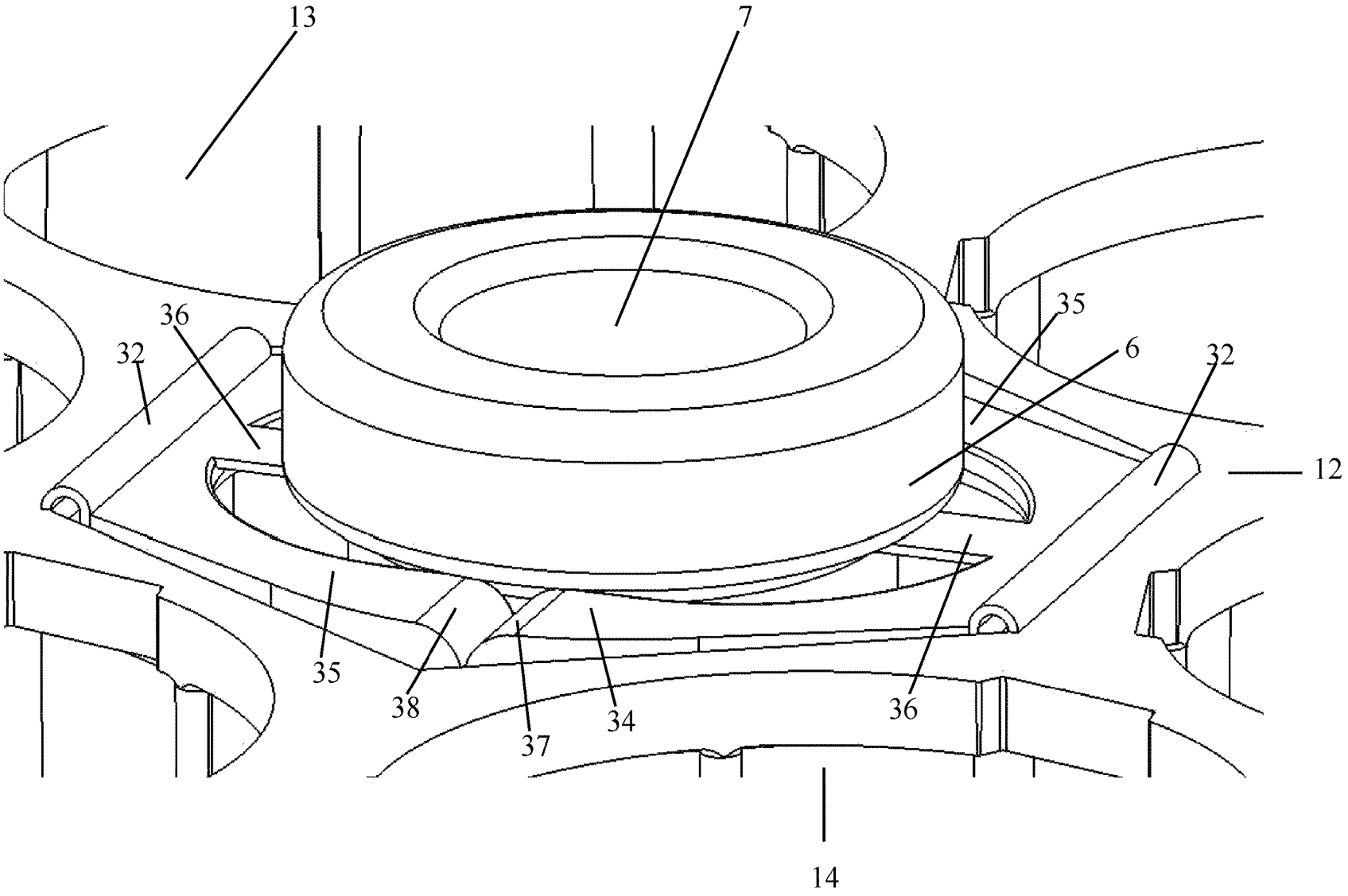

FIGS. 3A-3N show a section of a holding structure according to another exemplary embodiment provided according to the present invention in different stages of insertion and holding of a vial.

According to FIG. 3A, diametrically opposite holding devices are provided at the edge of the openings 13, which are each formed by two C-shaped holding arms 34, 35 and each form a semi-circular receptacle. The holding arms 34, 35 are elastically biased into the insertion position shown in FIG. 3A by film hinges 32. In the insertion position, the distance between the holding arms 34, 35 is sufficiently large so that a container can be inserted vertically from above or below into the opening 13 of the holding structure and into the receptacle formed by the two pairs of holding arms 34, 35, or removed from it again. The holding arms 34, 35 are pivotally supported on the peripheral webs 12 of the holding structure 11 and can be pivoted down to the closed holding position shown in FIG. 3M. In the closed holding position, the distance between the holding arms 34, 35 is sufficiently small so that the containers are held in the respective opening 13 of the holding structure 11 and in the circular receptacle formed by both pairs of holding arms 34, 35 by friction or positive locking. More specifically, the holding arms 34, 35 are configured to hold the containers clamped in the region of a cylindrical side wall or of a constricted neck portion or to engage positively behind a widened upper rim to hold the containers axially secured on the holding structure.

According to FIG. 3A, the two holding arms 34, 35 are connected to each other by a web-shaped base 31. At the base 31 a projection 36 is formed between the two holding arms 34, 35, which projects in the radial direction to such an extent that, in the closed holding position, the projection 36 abuts directly against the cylindrical side wall or against the constricted neck portion of the respective container or engages behind a widened upper rim of the respective container. The projection 36 thus serves as an additional holding device, but also controls a centered positioning of the containers in the openings 13 of the holding structure 11 in the closed holding position of the holding arms 34, 35.

According to FIG. 3A, elastic portions 39, 40 are formed at the front free ends of the holding arms 34, 35, which are in particular made of relatively thin plastic portions. The elastic portions 39, 40 touch each other directly in the closed holding position (see FIG. 3M) under elastic deformation of these portions 39, 40, so that the holding arms 34, 35 are elastically biased against each other in the closed holding position and thus the closed holding position of the holding arms 34, 35 is secured against accidental release of the containers.

According to FIG. 3A, block-shaped stops 33 are formed at the rear ends of the holding arms 34, 35 on their underside, which cooperate with the edge of the respective opening or receptacle 13 of the holding structure in the closed holding position of the holding arms 34, 35 in order to prevent further pressing down of the holding arms 34, 35 and thus to limit the closed holding position of the holding arms 34, 35. To be more precise, the shape of the elastic portions 39, 40 allows a downward force component to be generated in the closed holding position, which acts on the holding arms 34, 35 and causes the holding arms 34, 35 to be permanently pressed downwards even in the closed holding position, this elastic biasing force acting against the stops 33 at the rear ends of the holding arms 34, 35. Thus, in the closed holding position, the holding arms 34, 35 assume a stable end position from which the holding arms 34, 35 can only be returned to the other end position (the open insertion position) by applying a predetermined minimum force which exceeds a certain threshold value which is sufficiently higher than the forces normally occurring during further processing of the containers due to displacement or handling (raising, lowering, rotating, tilting, vibrating) of the holding structure. An accidental adjustment of the holding arms 34, 35 from the closed holding position into the open insertion position can thus be reliably eliminated.

For controlling the position of the holding arms 34, 35 and pivoting the holding arms 34, 35 in a coordinated manner into the closed holding position, an external actuating device is used, as shown schematically in FIG. 3B. This actuating device has a total of four triangular projections 46 provided on actuating rods 45 which are vertically adjustable relative to the holding structure 11, the distance between the projections 46 being matched to the distance between the holding arms 34, 35 of a respective opening 13 of the holding structure 11. When the actuating device is adjusted perpendicular to the holding structure, the inner bevels of the projections 46 first come in contact with the outer sides of the holding arms 34, 35 as shown in FIG. 3C. When the actuating device is lowered further, these bevels slide along the outer sides of the holding arms 34, 35 and thus swing or pivot the holding arms 34, 35 gradually towards the peripheral webs 12 of the holding structure 11, as can be seen from the sequence of FIGS. 3C to 3G. Finally the condition according to FIG. 3H is reached in which the widened upper rim 6 of the container 1 rests directly on the rounded portions 37, 38 at the front free ends of the holding arms 34, 35.

In this position the actuating device can now be removed, as shown in FIG. 3H. In this position, the self weight of the containers 1 may be sufficient to pivot the holding arms 34, 35 further downwards towards the peripheral webs 12 of the holding structure 11. Or the containers 1 are pressed further down towards the holding structure, for example by a plate (not shown). When the containers 1 are pressed down, the holding arms 34, 35 are carried along and thus swiveled further downwards towards the holding structure 11. This further adjustment of the holding arms 34, 35 towards the closed holding position is shown in the sequence of FIGS. 3H to 3I. The widened upper rim 6 of the container 1 slides along the rounded portions 37, 38 at the front free ends of the holding arms 34, 35 until finally the closed holding position according to FIG. 3M is reached, in which the widened upper rim 6 of the container 1 rests both on the holding arms 34, 35 and on the radial projection 36. This closed holding position is shown in a greatly enlarged view in FIG. 3N.

To release the containers 1 from the closed holding position, the containers 1 simply need to be adjusted vertically upwards and perpendicular to the holding structure 11, for example by pressing the bottoms 3 of container 1 upwards, for example by a plate. The holding arms 34, 35 are automatically swiveled upwards from the neck portions of the containers. After removing the containers 1 vertically upwards from the openings 13 of the holding structure 11, the holding arms 34, 35 are again automatically biased elastically into the open insertion position according to FIG. 3A by the restoring force exerted by the film hinges 32.

Figure 3O:
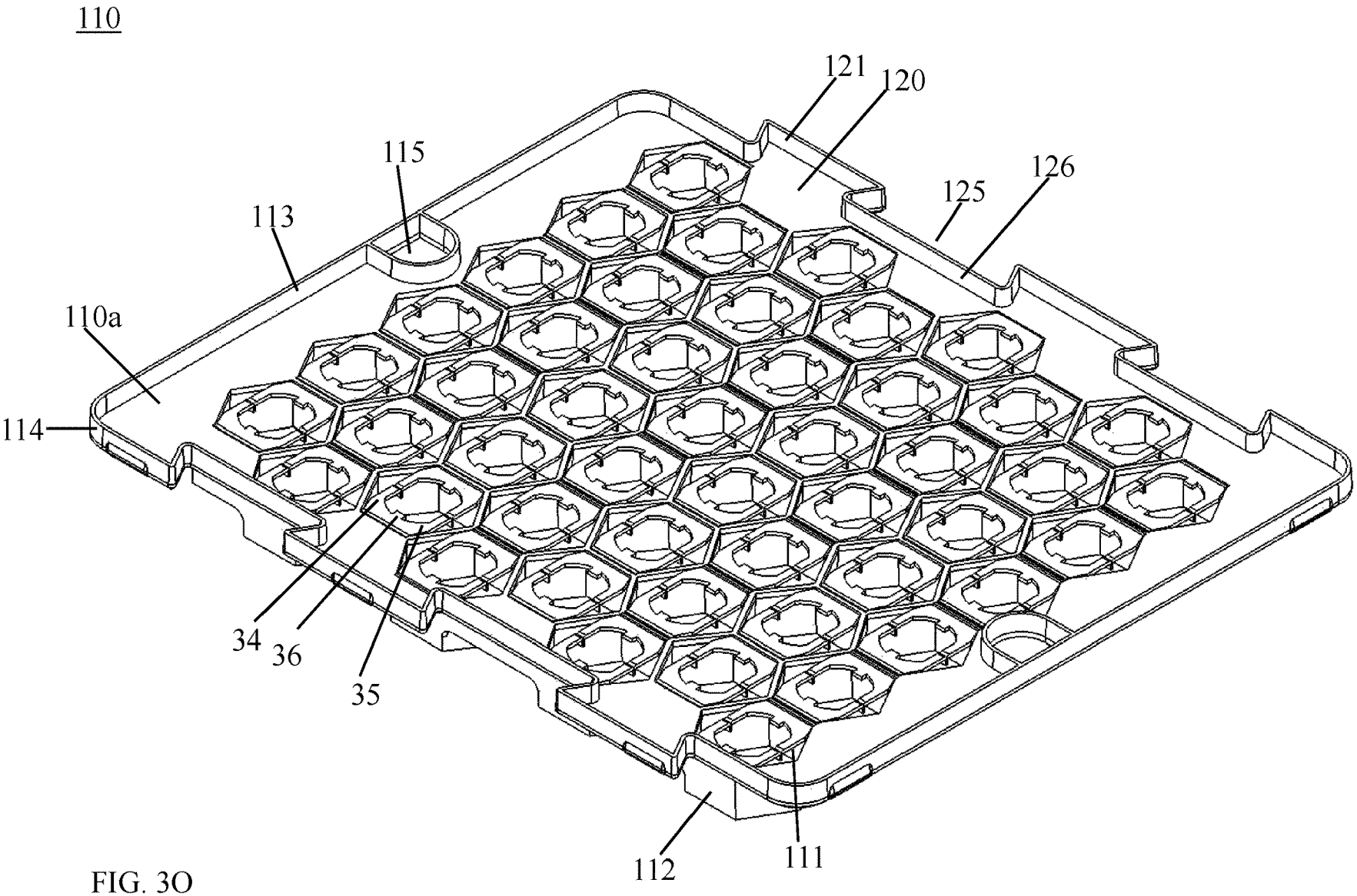
Figure 3P:
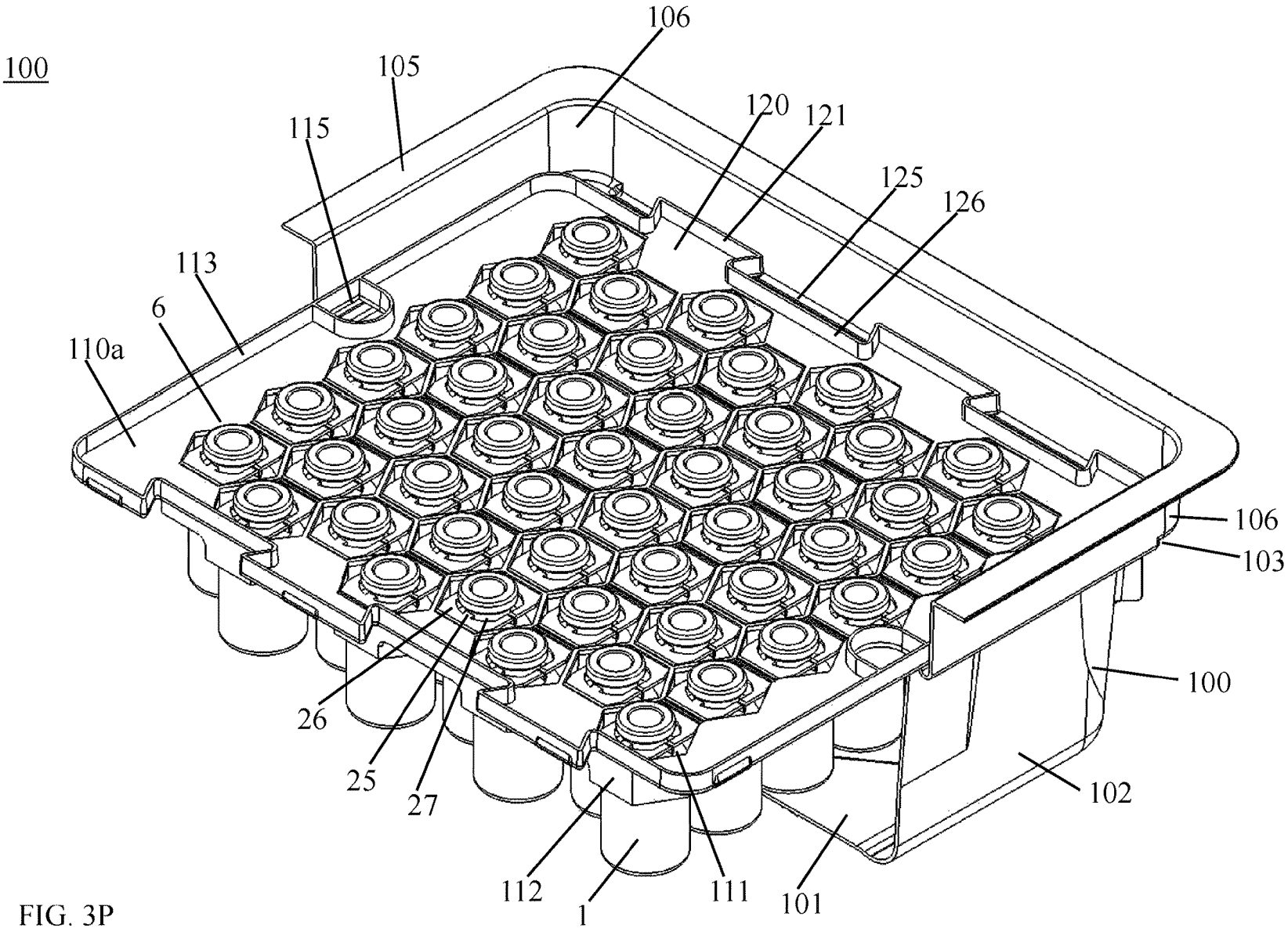

FIG. 3O shows a specific example of a holding structure 110 configured according to the operation described with reference to FIGS. 3A-3N. FIG. 3P shows in a perspective partial sectional view a transport and packaging container 100 together with such a holding structure 110 accommodated in it.

FIGS. 4A-4F show a section of an exemplary embodiment of a holding structure 11 provided according to the present invention at different stages of insertion and holding of a vial. According to FIG. 4A, the holding devices are formed as pairs of foldable or collapsible holding plates 93 which lie diametrically opposite one another at the edge of the respective opening or receptacle 13 of the holding structure 11, wherein portions of the holding plates 93 folded or clapped inwardly clamp the containers 1, in the closed holding position (cf. FIG. 4F), in the region of a cylindrical side wall 2 or of a constricted neck portion 5 or engage behind a widened upper rim 6 in a positive-locking manner in order to secure the containers 1 axially to the holding structure 11. According to FIG. 4A, material weakening regions 94 are formed at the centre of the holding plates 93, which serve as folding lines and along which the holding plates 93 can be folded or collapsed.

For actuating the holding plates 93, an intermediate plate 90 is further provided, which is initially arranged at a distance from the holding structure 11, has a plurality of openings 92 corresponding to the openings or receptacles 13 of the holding structure 11 and is adjusted towards the holding structure 11 by being pressed down in order to transfer the holding plates 93 in a coordinated manner from the open insertion position into the closed holding position and/or from the closed holding position into the open insertion position. Conveniently, the intermediate plate 90 is formed separately from the holding structure 11 and can be adjusted or displaced relative to it.

Figure 4A:
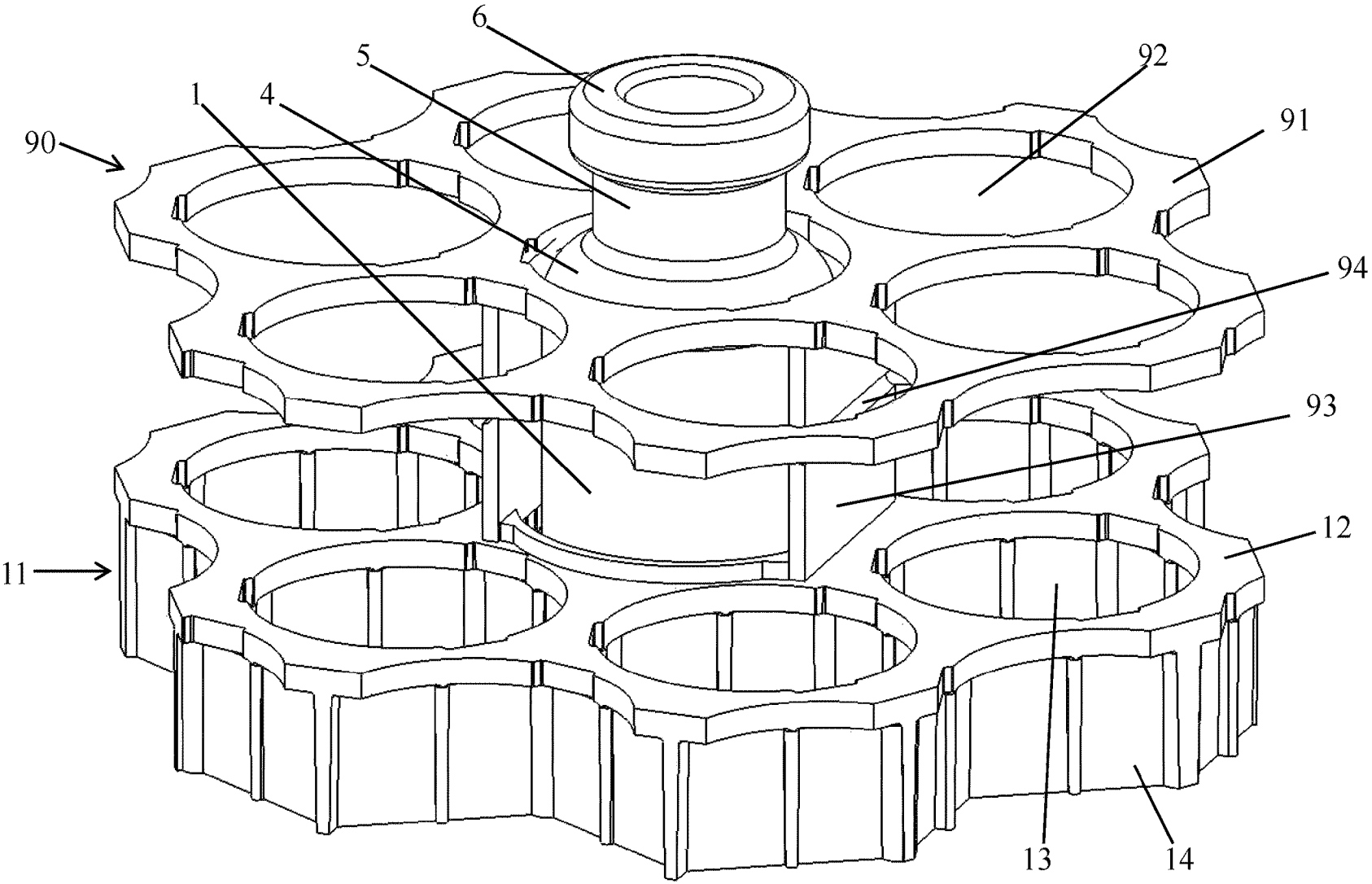
FIGS. 4A-4F show a detail of another exemplary embodiment of a holding structure provided according to the present invention at different stages of insertion and holding of a vial.
Figure 4C:
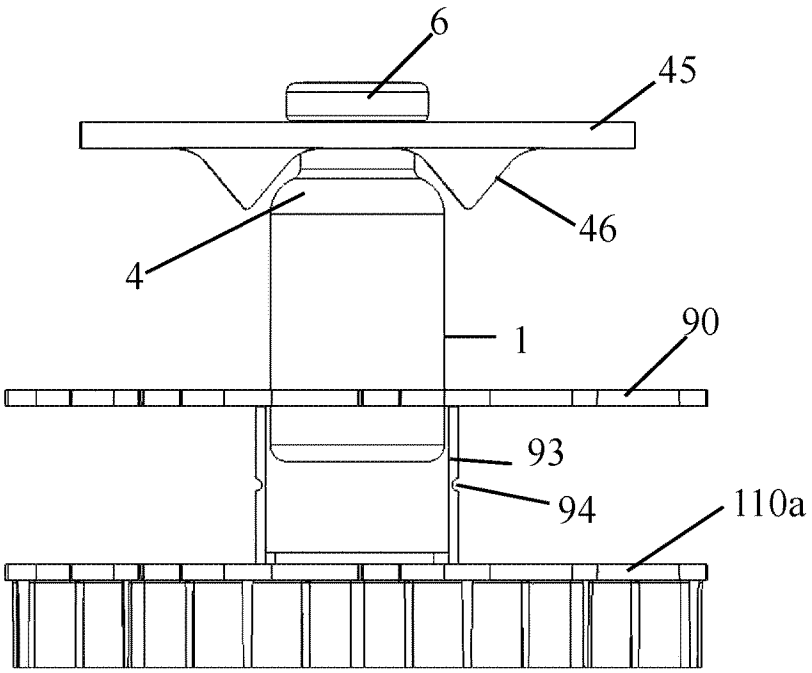
Figure 4B:
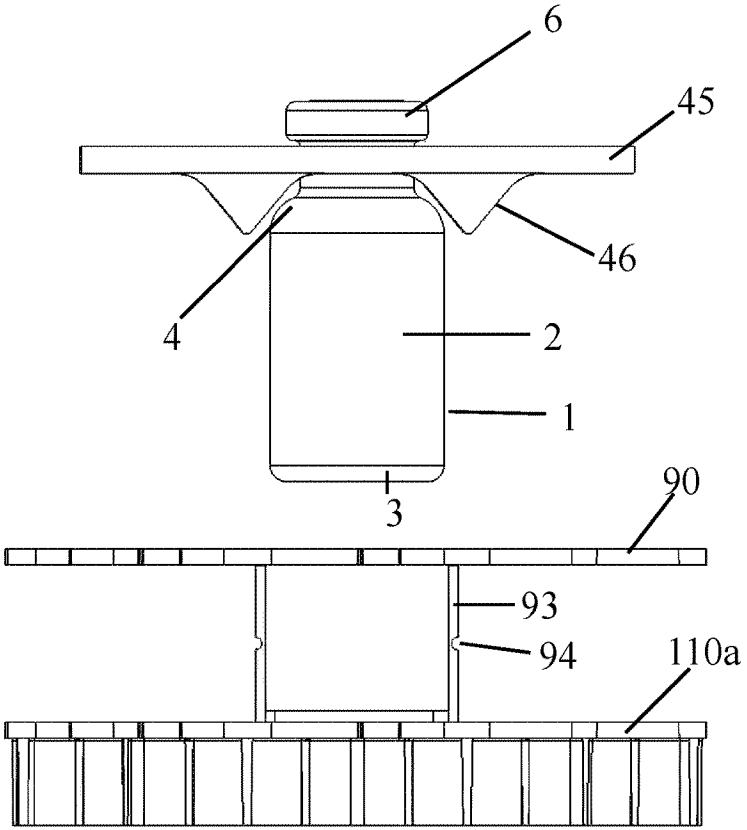
Figure 4E:
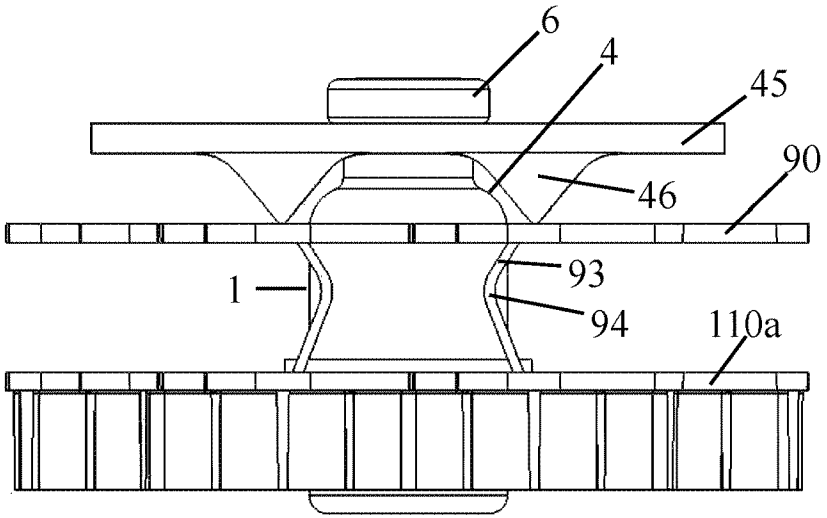
Figure 4D:
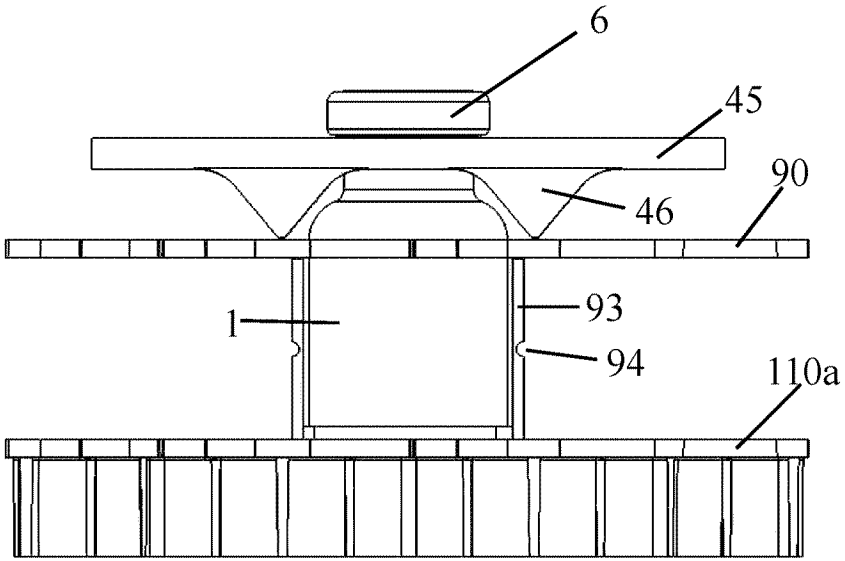
Figure 4F:
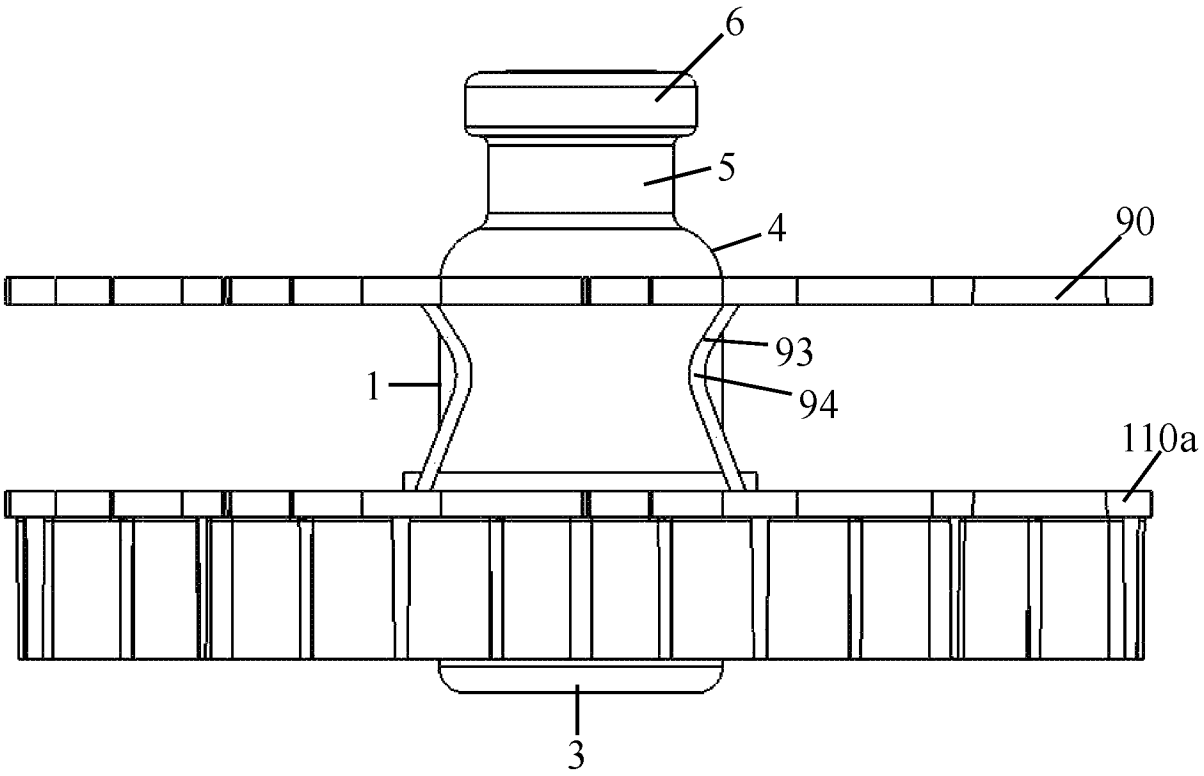

According to FIG. 4B, for insertion into the openings of the carrier 110*a* the widened upper rims 6 of the containers 1 rest on the rods 45 of an external control device used to control the position of the holding devices of the holding structure 11. By lowering the actuating device or the rods 45, the lower ends of the containers 1 are finally inserted into the openings of the intermediate plate 90 and into the openings formed by the holding plates 93 of the carrier 110*a*, as shown in FIG. 4C. As the rods 45 are lowered further, the front ends of the triangular projections 46 of the actuating device, which act as control cams, finally come in contact with the intermediate plate 90. As the actuating device and rods 45 are lowered further, the containers 1 are inserted further into the openings of the carrier 110*a* and at the same time the intermediate plate 90 is moved vertically towards the carrier 110*a*. The pressure exerted by the intermediate plate 90 on the holding plates 93 results in an elastic deformation of the holding plates 93, namely in a folding along the folding lines 94, as shown in FIG. 4F. Finally the containers 1 are held on the holding structure as shown in FIG. 4F. The self weight of the containers 1 and the weight of the intermediate plate 90 may be sufficient to elastically bias the holding plates 93 to a sufficient extent into the closed holding position.

To release and remove the containers 1 from the closed holding position, the containers 1 simply need to be adjusted vertically upwards, perpendicular to the carrier 110*a*, for example by pushing the bottoms 3 of the containers 1 upwards, for example by a plate, or also by the aforementioned actuating device. The holding plates 93 are automatically swiveled upwards. After removing the containers 1 vertically upwards from the openings 13 of the carrier 110*a*, the holding plates 93 are automatically elastically biased back into the open insertion position according to FIG. 4A by the restoring force exerted by the material weakening portions 94, which act as film hinges.

Figure 4G:
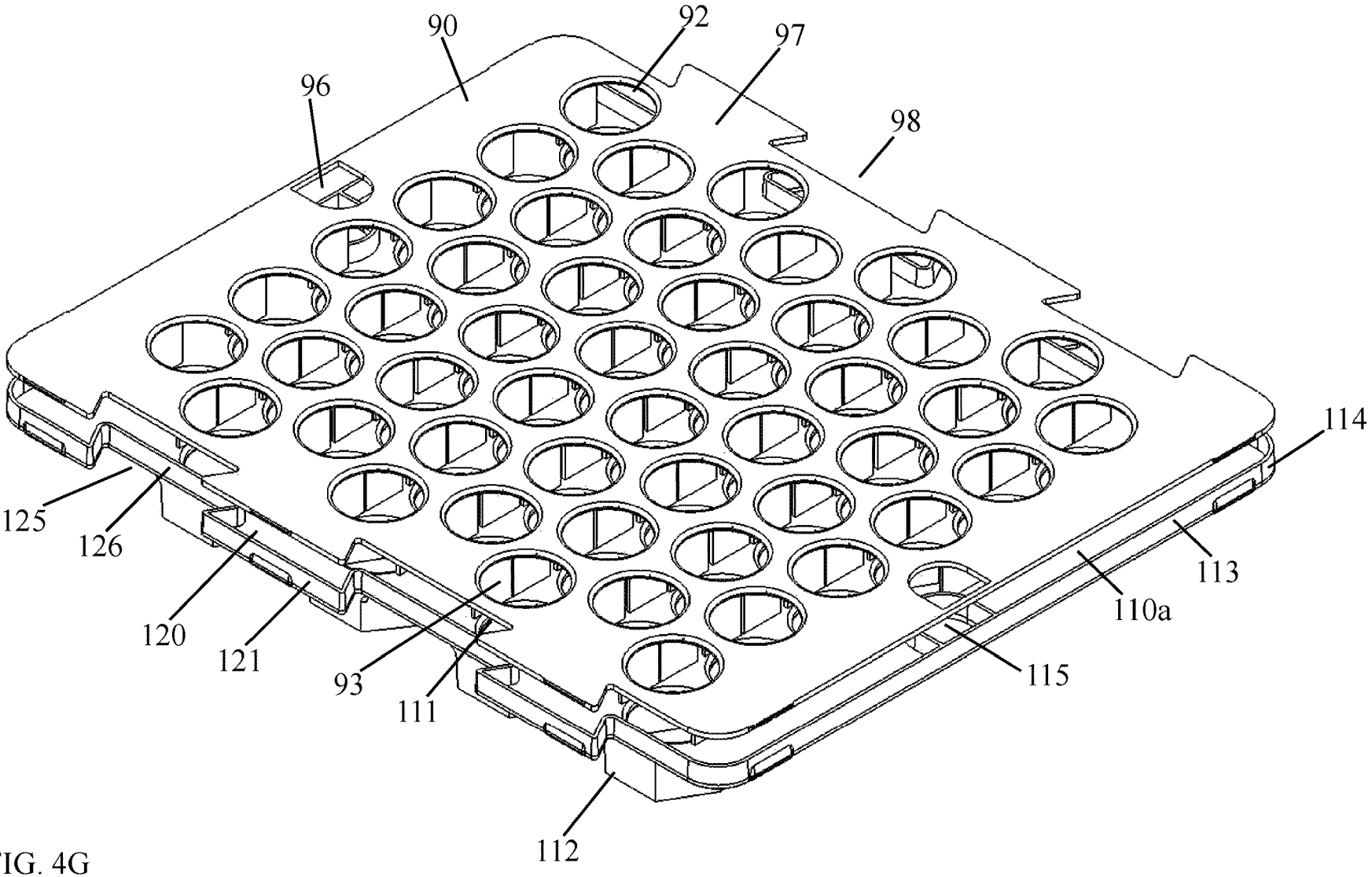
FIG. 4G shows in a perspective top view the holding structure illustrated in FIGS. 4A-4F.
Figure 4H:
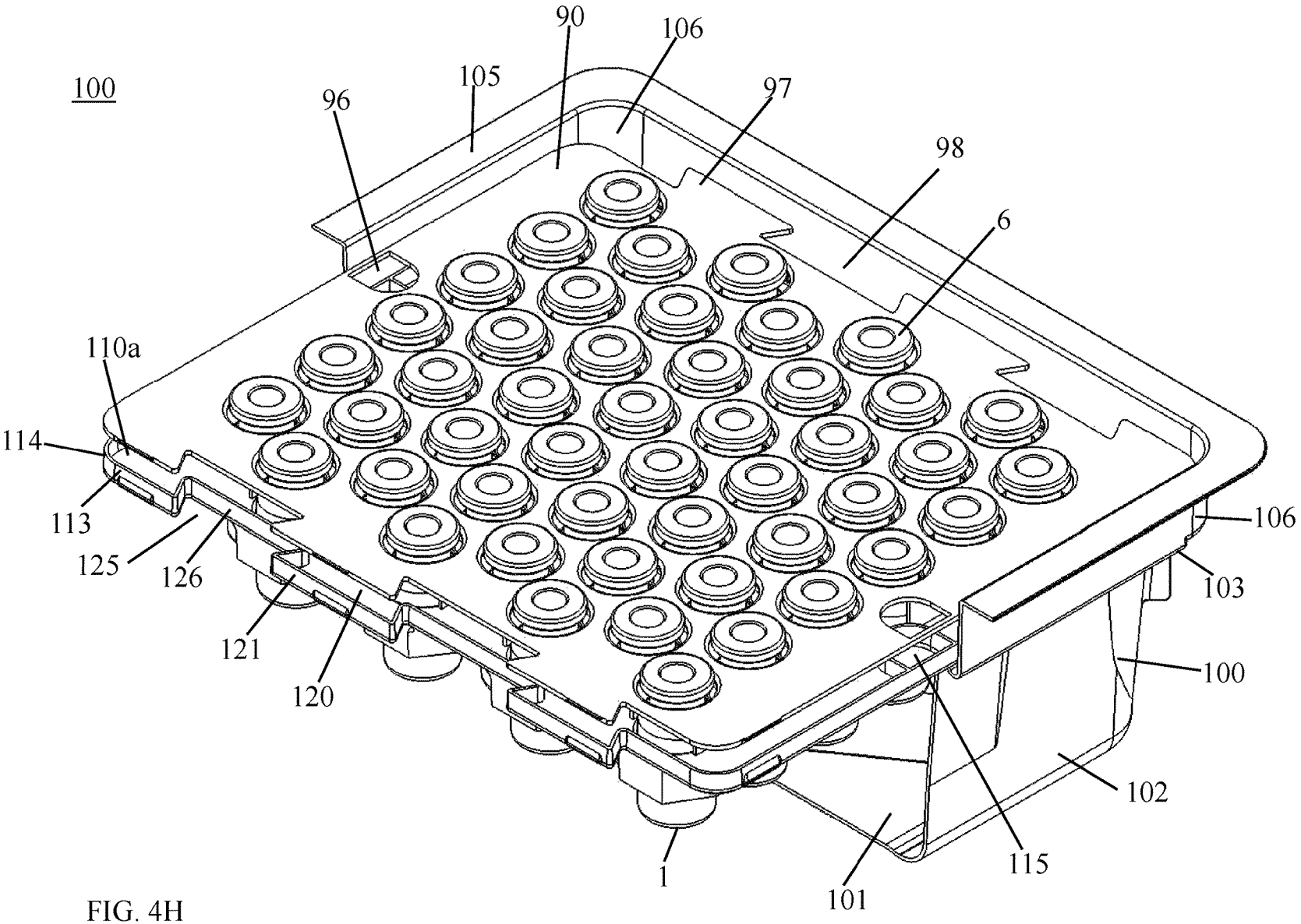
FIG. 4H shows in a perspective representation and in a partial detail a transport and packaging container with the holding structure illustrated in FIGS. 4A-4G and containers held thereon.

FIG. 4G shows a specific example of a holding structure 110 configured according to the operation described with reference to FIGS. 4A-4F. FIG. 4H shows in a perspective partial section a transport and packaging container 100 together with such a holding structure 110 accommodated in it.

Figure 5A:
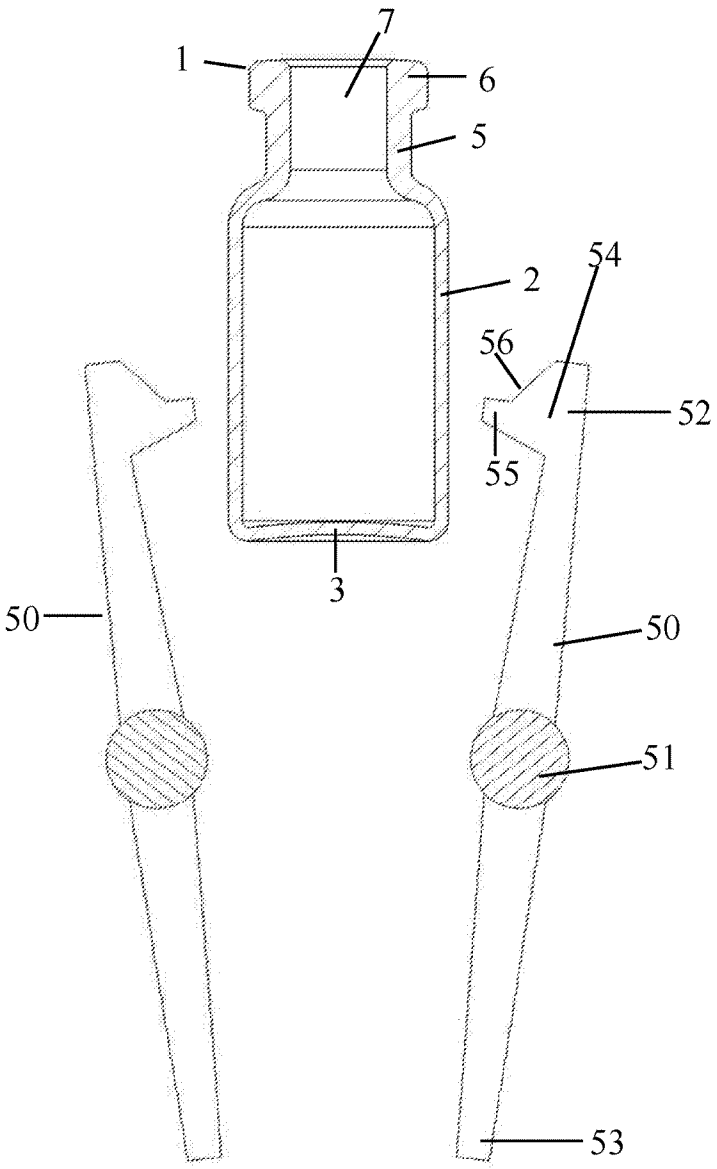
FIGS. 5A-5C show in schematic sectional views of three stages of inserting and holding a vial between pivotally supported holding arms for explaining an exemplary embodiment provided according to the present invention.
Figure 5B:
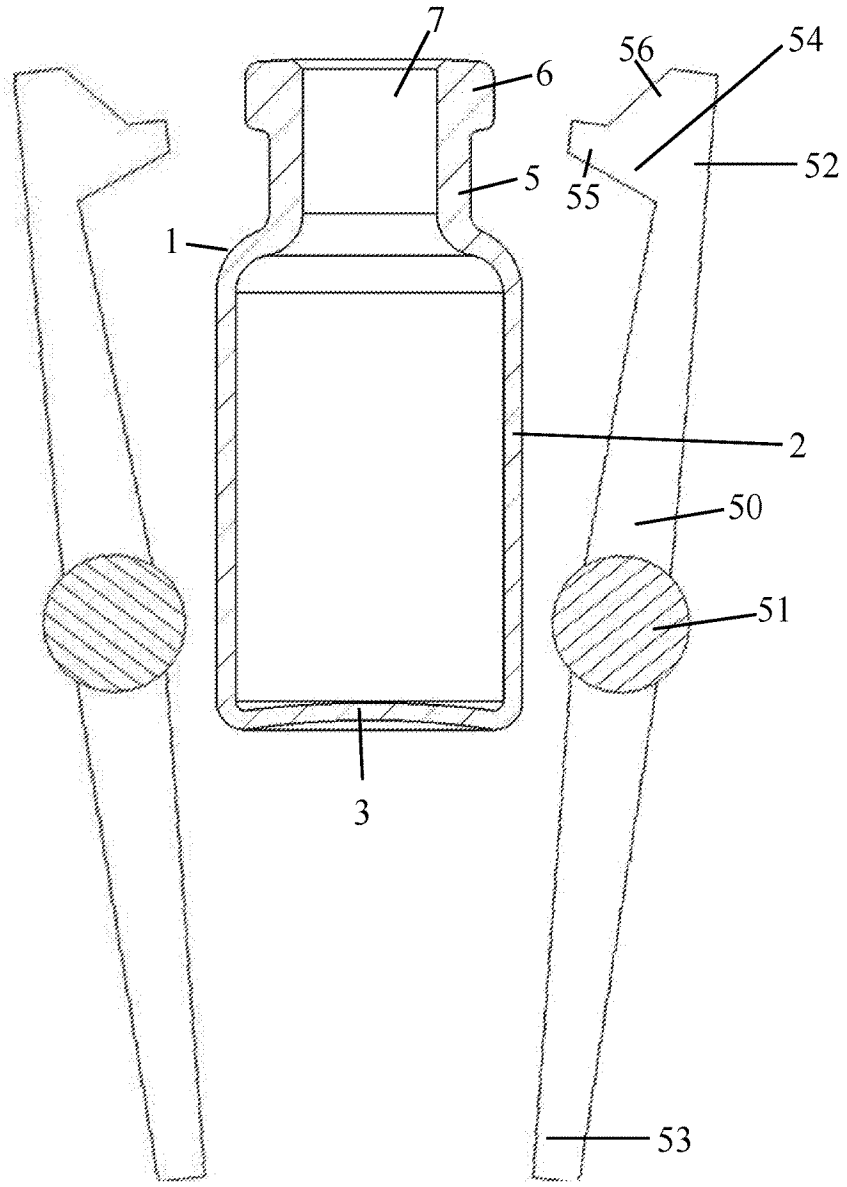
Figure 5C:
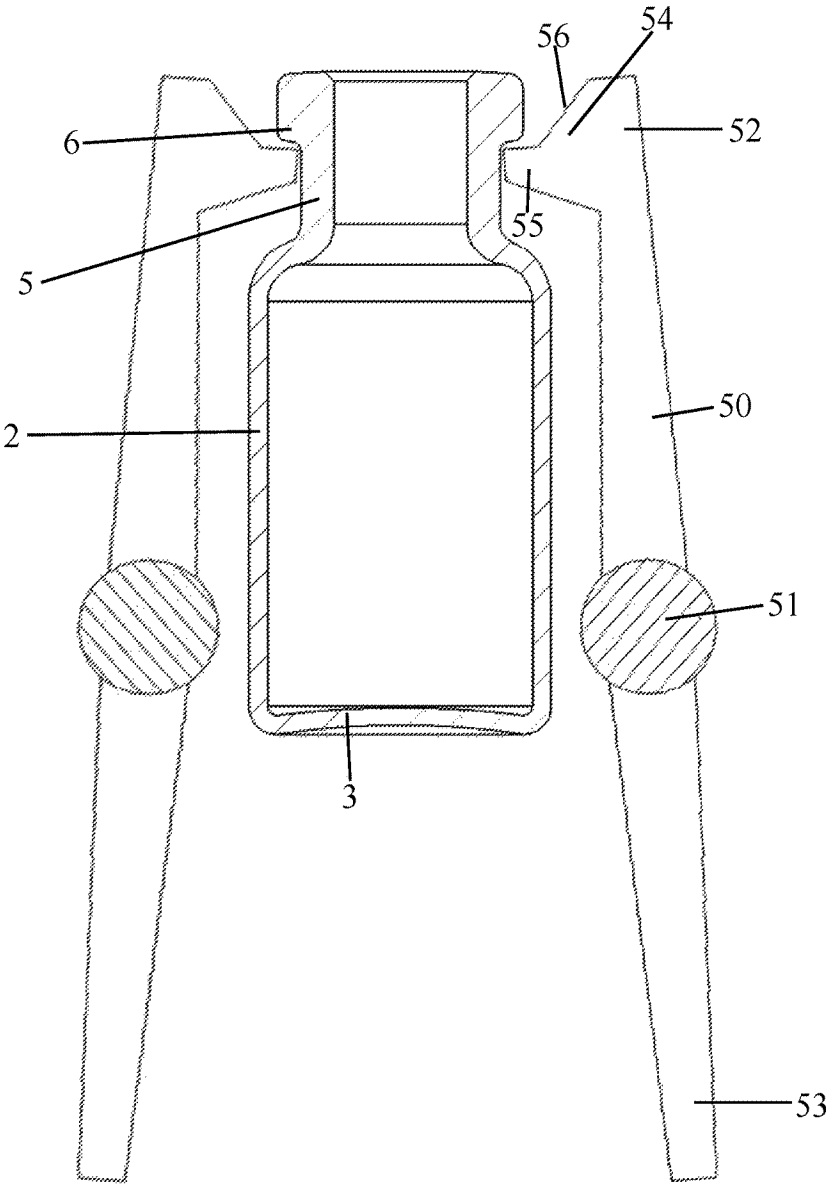

FIGS. 5A-5C show three stages of inserting and holding a vial 3 between holding arms 50, which are pivotally mounted on a holding structure, in order to explain an exemplary embodiment provided according to the present invention in schematic sectional views. According to FIG. 5A, a plurality of holding arms 50 is arranged at the edge of a respective opening of the holding structure, such as at uniform angular distances from each other. While FIG. 5A shows two holding arms 50 arranged diametrically opposite each other, three holding arms (to achieve a three-point support of the containers) or more holding arms are also possible. The holding arms 50 are pivotally mounted on the holding structure, which can be achieved by a suitable integral design of the holding arms 50 with the holding structure, for example in the form of integral rotary axes 51 acting as torsion springs and produced by a plastic injection molding process, or by torsion springs made of metal or plastic. The holding arms are thus permanently biased by an elastic restoring force into a stable end position, such as into a closed holding position, as shown below, or alternatively into an open insertion position, as shown in FIG. 5A, in which the containers 1 can be inserted vertically from above into the gap or the receptacle between the holding arms 50 without friction.

The holding arms 50 each have a front free end 52, on which a holding claw 54 is formed, on which a supporting nose 55 is formed projecting radially inward. In the closed holding position with the front ends 52 of the holding arms 50 swiveled radially inwards (see FIG. 5C), the plurality of supporting noses 55 is arranged at the same distance with respect to the holding structure so that the supporting noses 55 together span a plane. In the closed holding position of the holding arms 50, the widened upper rims 6 of the containers 1 rest on these supporting noses 55, so that the containers 1 are axially secured to the holding structure by positive locking with the supporting noses 55. At the front free ends 52 of the holding arms 50 bevels 56 are formed which allow the widened upper rim not to be clamped by portions of the holding claw 54 above the respective supporting nose 55 even in the inwardly pivoted holding position of the holding arms 50 when the holding arms 50 are inclined inwardly with respect to a perpendicular bisector onto the opening of the holding structure, which further avoids undesirable friction effects during removal or insertion of the containers 1 into the openings of the holding structure.

According to FIG. 5A, the rear free ends 53 of the holding arms 50 are arranged in relation to the axis of rotation 51 on the opposite side of the front free ends 52. When the holding arms 50 are swiveled around the rotary axes 51, the front and rear ends 52, 53 of the holding arms 50 are thus moved in opposite directions.

The holding arms 50 are pivoted by a control device, not shown here, which acts, for example in the manner of a control cam, on the rear free ends 53 of the holding arms 50 in order to move them together in a coordinated manner radially inwards or outwards and thus to adjust the front free ends 52 of the holding arms 50 in opposite directions. The actuating device may, for example, be formed as a plate having a plurality of conical recesses aligned with the apertures of the holding structure and whose diameter at its upper end corresponds to the distance between the rear free ends 53 of the holding arms 50 in the closed holding position of the holding arms 50 and whose diameter at its lower end corresponds to the distance between the rear free ends 53 of the holding arms 50 in the open insertion position of the holding arms 50. If such an actuating device is now moved vertically upwards from below in the direction of the holding structure, the rear free ends of the holding arms 50 first come in contact with the upper rim of these conical recesses. As the actuating device continues to move vertically upwards towards the holding structure, the rear free ends 53 of the holding arms 50 slide along the side wall of the conical recesses of the actuating device and are adjusted radially inwards, causing the front free ends 52 of the holding arms 50 to pivot gradually radially outwards. Finally, the open insertion position of the holding arms 50 shown in FIG. 5A is reached, in which the distance between the supporting noses 55 of the holding arms 50 is greater than the maximum outer diameter of the containers 1.

In this open insertion position of the holding arms 50, the containers 1 can be inserted from above into the openings of the holding structure as well as into the space between the holding arms 50 without friction. FIG. 5B shows the containers 1 in a position in which the containers 1 are inserted vertically into the openings of the holding structure to such an extent that the underside of the widened upper rim 6 of the containers 1 is at the height of the supporting noses 55 of the holding arms 50.

If in this position of the holding arms the actuating device is now moved in the opposite direction, i.e. vertically downwards and away from the holding structure, the holding arms 50, controlled by the cooperation of the rear free ends 53 of the holding arms 50 with the inner wall of the conical recesses of the actuating device, are moved in the opposite direction, i.e. radially outwards, which requires a corresponding coordinated, synchronous pivoting of the holding arms 50 around the axes of rotation 51 radially inwards. When further adjusting the actuating device, the closed holding position of the holding arms 50 shown in FIG. 5C is finally reached, in which the widened upper rim 6 of the containers 1 rests on the supporting noses 55 at the front free ends 52 of the holding arms 50 and in which the constricted neck portion 5 of the containers 1 is clamped by the front ends of the supporting noses 55.

In order to prevent the containers 1 from falling uncontrollably into the openings of the holding structure, the containers 1 need to be held or supported during their insertion into the openings of the holding structure and during their removal therefrom, which can be achieved, for example, from above the holding structure by grippers or robot arms of a process equipment or from below the holding structure by cylindrical projections or by the bottoms of the aforementioned conical recesses of the actuating device, on which the bottoms 3 of the containers 1 are temporarily supported and which are aligned with the openings of the holding structure. The cylindrical projections may also be formed within the abovementioned conical recesses of the actuating device.

Alternative actuating devices can also be used which enable a coordinated, synchronous adjustment of the holding arms 50 in an appropriate manner, such as a simultaneous synchronous adjustment of all holding arms 50 of the holding structure. This coordinated adjustment may be controlled in an appropriate manner by control cams or the like which cooperate mechanically with the rear or front ends 53, 52 of the holding arms 50 or with other portions of the holding arms 50 to effect their synchronous adjustment. Mechanical adjustment devices, such as grippers or robot arms, can also be used to act on portions of the holding arms 50, in particular the rear or front ends 53, 52 of the holding arms 50, in such a way that the holding arms 50 are adjusted synchronously and in a coordinated manner.

Figure 5D:
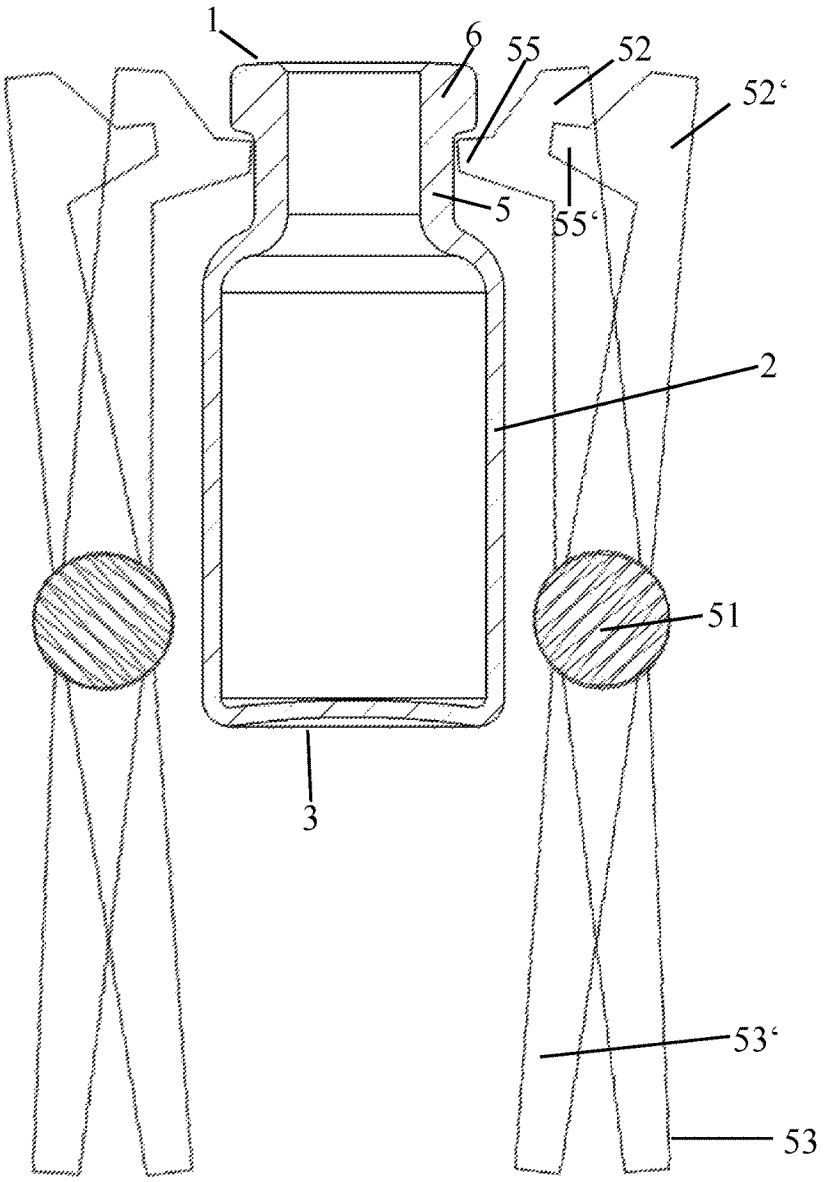
FIG. 5D shows in an overall view the pivotally supported holding arms in the two extreme positions illustrated in FIGS. 5B and 5C.

FIG. 5D shows an overall view of the pivotally mounted holding arms 50 in the two extreme positions of FIGS. 5B and 5C, namely in the open insertion position (reference numeral without apostrophe) and in the closed holding position (reference numeral with apostrophe).

Figure 6A:
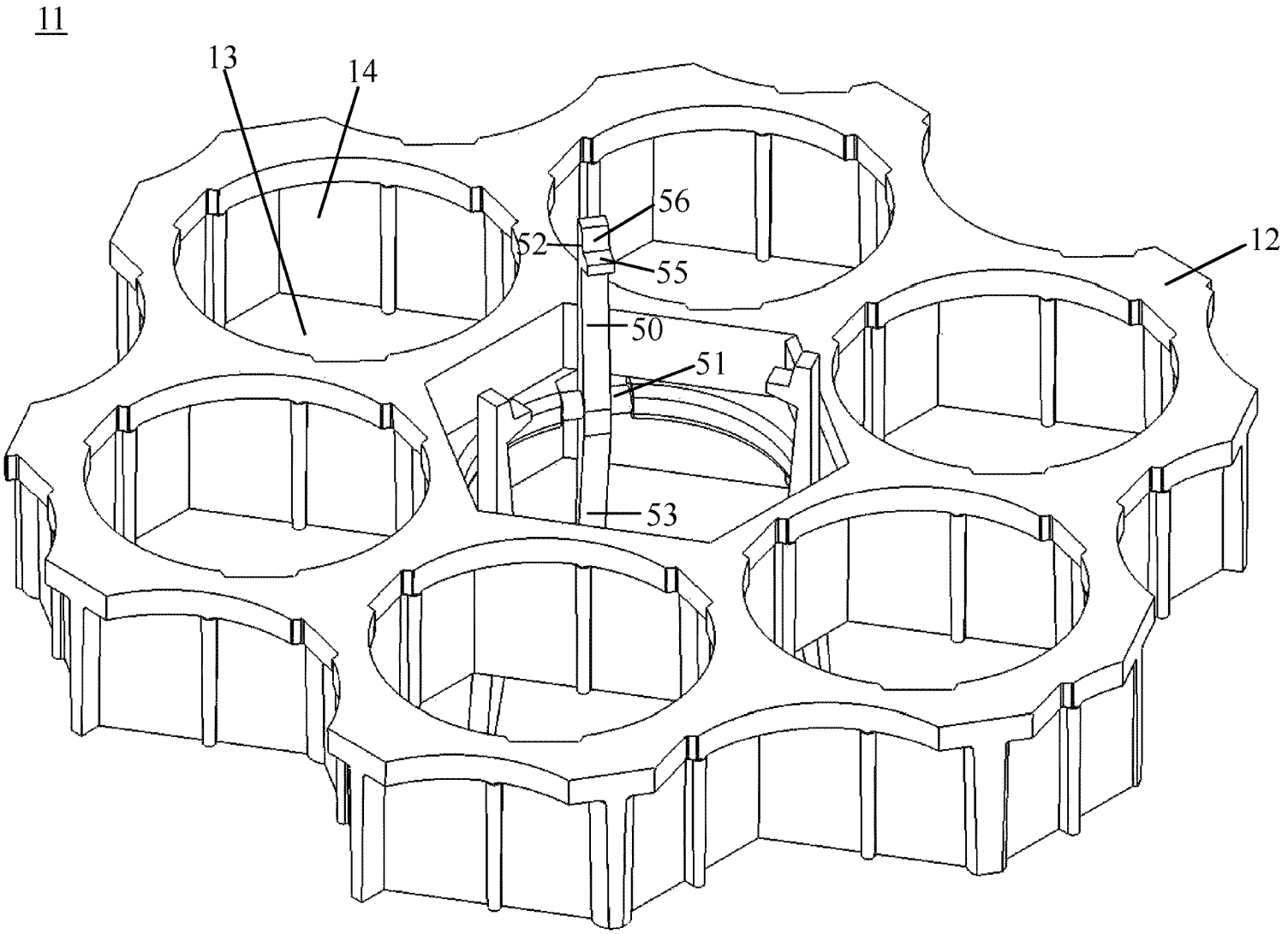
FIGS. 6A-6B show a section of an exemplary embodiment of a holding structure provided according to the present invention, comprising pivotally movable, bi-stably supported holding arms, and a strongly enlarged representation thereof.
Figure 6B:
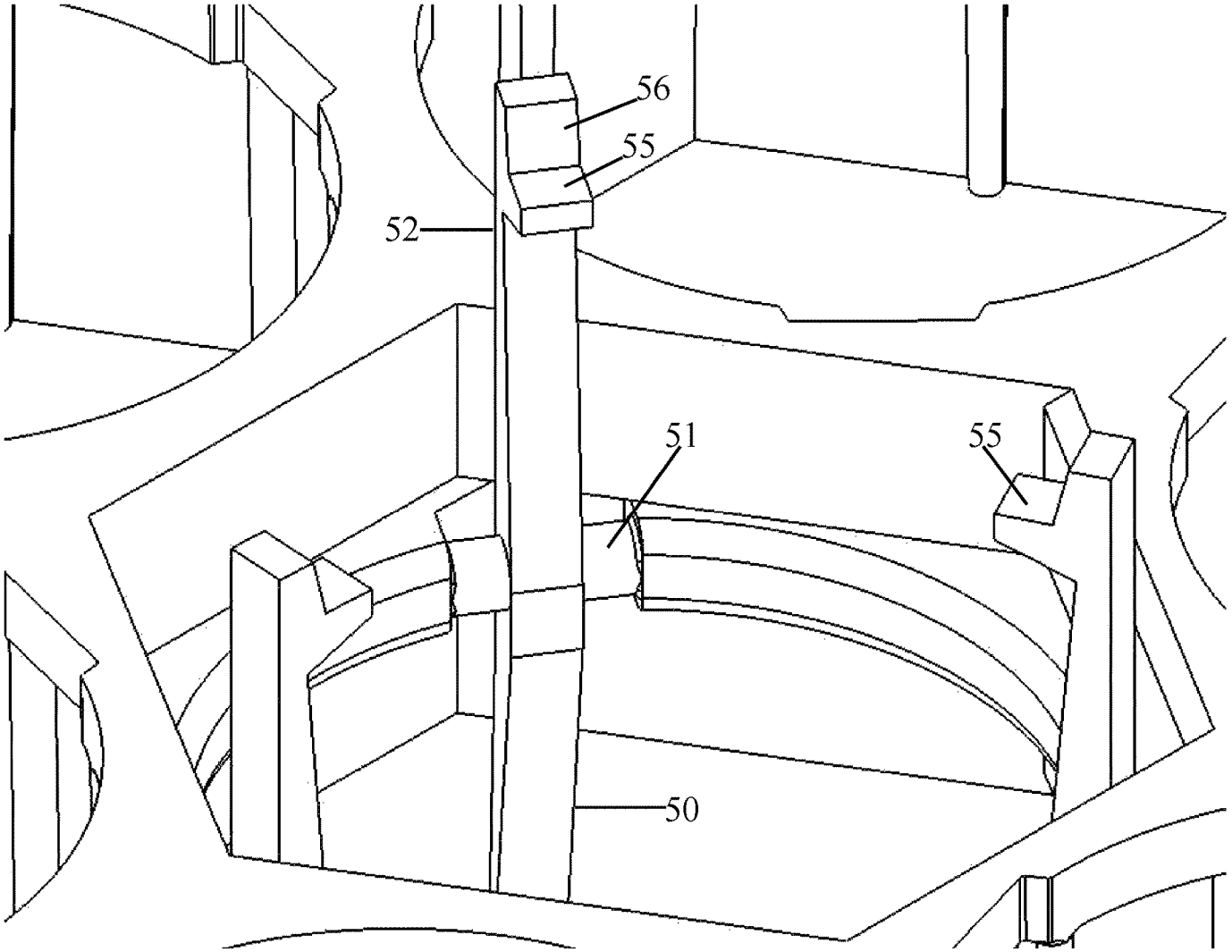

FIG. 6A shows a section of an embodiment of a holding structure provided according to the present invention, having pivotable, bi-stable holding arms which are adjusted according to the operation described above with reference to FIGS. 5A-5C. In this embodiment, the holding arms 50 are pivotally mounted on the inside of the side walls 14 of the openings 13 of the holding structure 11. The front free ends 52 of the holding arms 50 project from the plane spanned by the peripheral webs 12 of the holding structure, while the rear free ends 53 of the holding arms project beyond the lower edges of the side walls 14 of the holding structure so that these are freely accessible for an external actuating device for adjusting the holding arms 50. FIG. 6B shows a strongly enlarged representation of the embodiment according to FIG. 6A. The rotary axes 51 of the holding arms 50 may be formed in one piece with the lower side walls 14 of the holding structure, for example by a plastic injection molding process. However, the axes of rotation 51 may also be separate from and clipped into the side walls 14 of the holding structure and then, for example, elastically biased into any of the two end positions of the holding arms 50 by an elastic tab on the side wall 14 or by torsion springs or the like.

Figure 6C:
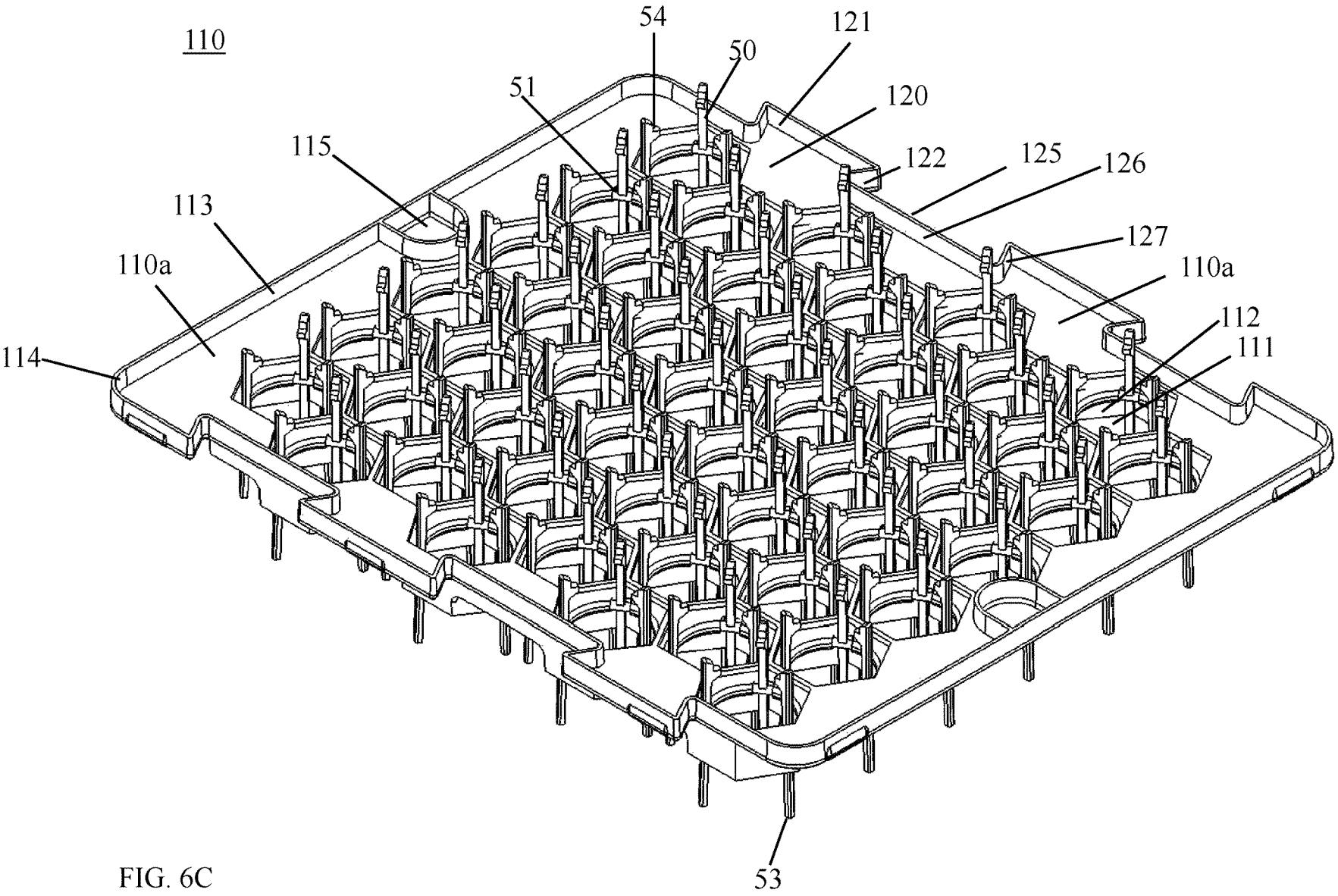
FIG. 6C shows in a perspective top view the holding structure illustrated in FIGS. 6A-6B.
Figure 6D:
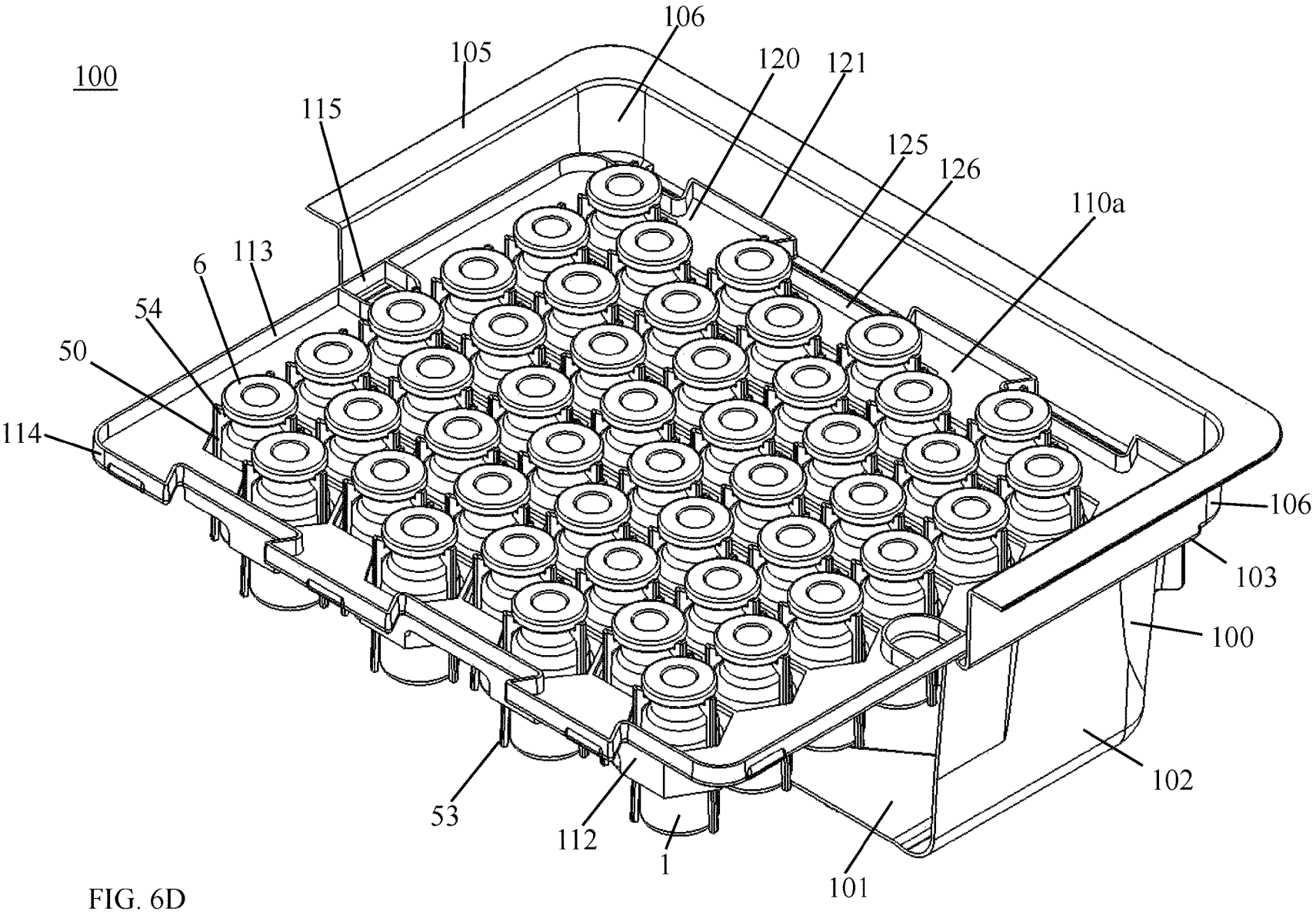
FIG. 6D shows in a perspective representation and in a partial section, a transport and packaging container with the holding structure illustrated in FIGS. 6A-6C and containers held thereon.
Figure 7A:
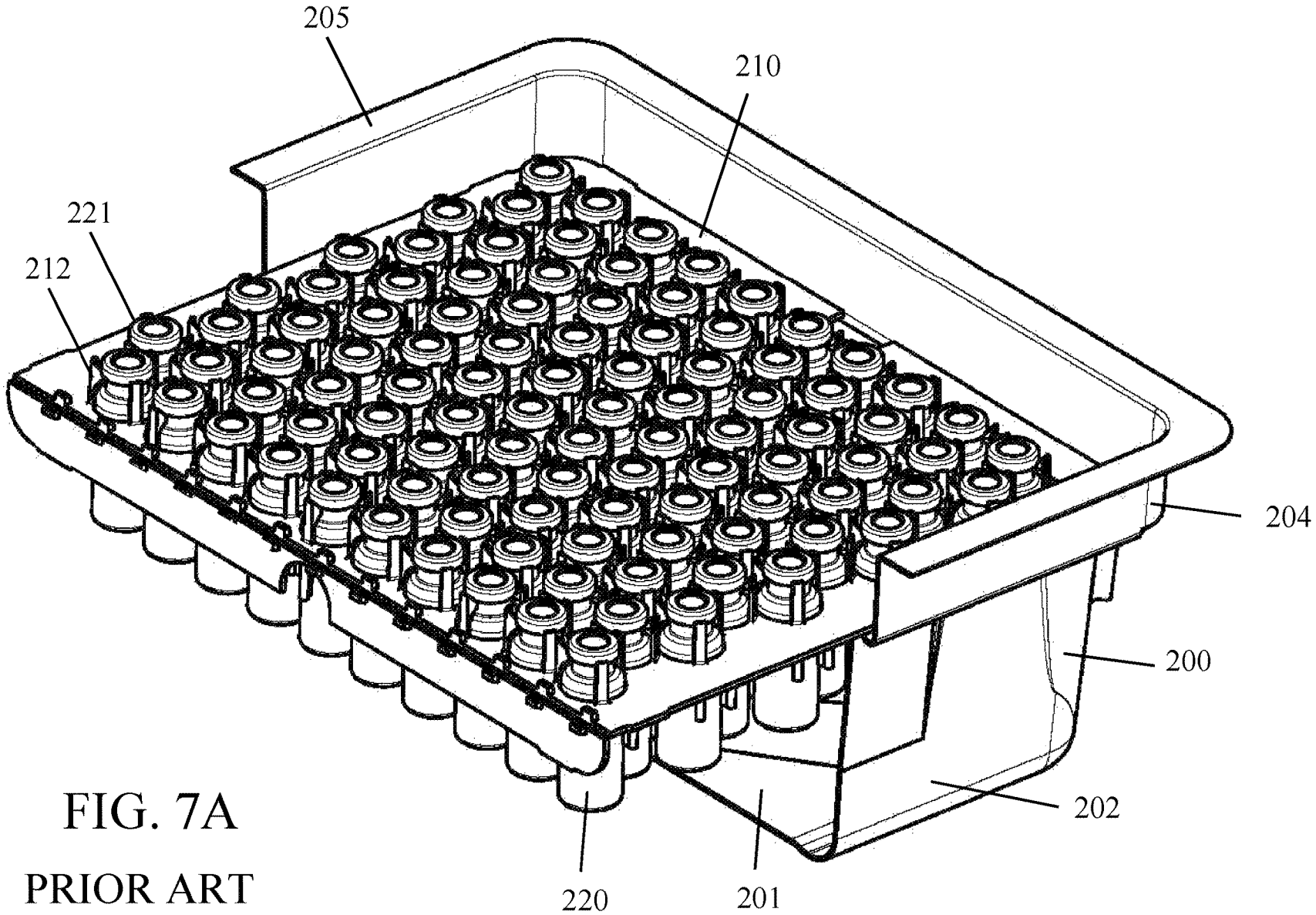
FIG. 7A PRIOR ART
FIG. 7A shows in a partial perspective representation, a known transport and packaging container with a holding structure.
Figure 7B:
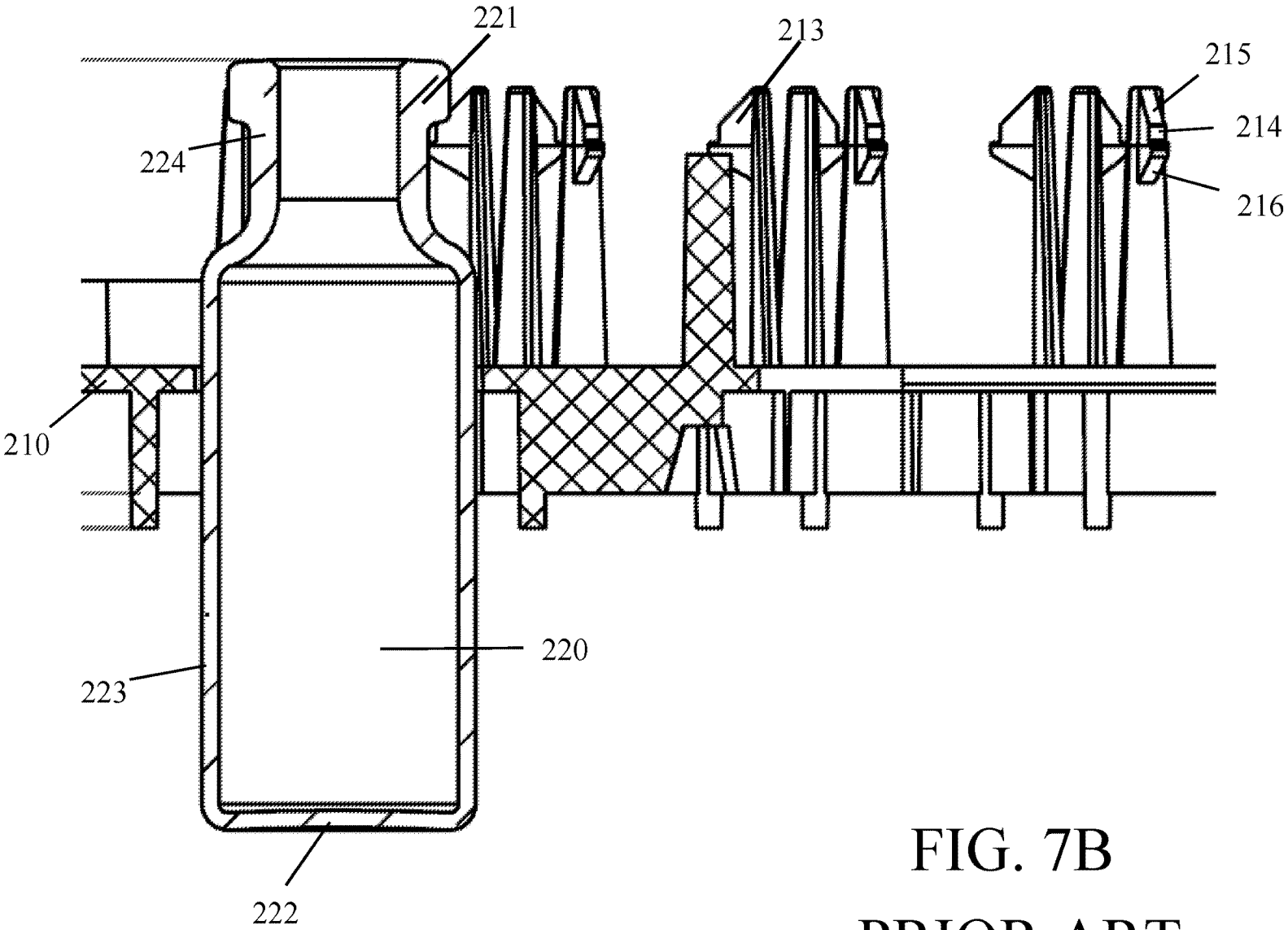
FIG. 7B PRIOR ART
FIG. 7B shows in an enlarged partial section the known holding structure illustrated in FIG. 7A with a vial held on it.

FIG. 6C shows a specific example of a holding structure 110 configured according to the operation described with reference to FIGS. 6A-6B. FIG. 6D shows in a perspective partial sectional view a transport and packaging container 100 together with such a holding structure 110 accommodated in it.

Another aspect of the present invention relates to a combination of a holding structure, as disclosed above, and a plurality of containers 1 for substances for pharmaceutical, medical or cosmetic applications held thereon, in particular vials or cartridges.

The containers may be inserted and removed from the openings or receptacles of a holding structure even if the holding structure is already accommodated in a transport and packaging container, as described above. The adjustment of the holding devices may also take place in this state, because they can be adjusted between the two stable end positions either directly by the containers themselves or by an external control device having control cams or the like. This does not require access from the underside of the carrier. In the open insertion position of the holding devices, the containers can be inserted into the openings or receptacles practically without friction.

Although exemplary embodiments provided according to the present invention have been explained above with reference to holding structures for holding vials, it should be noted that embodiments provided according to the present invention may also be used in a similar way for any other container for storing substances for pharmaceutical, medical or cosmetic applications, in particular for cartridges or syringes. For this purpose, the containers to be held are conveniently provided with an end having a widened rim, which is followed by a constricted neck portion and a neck portion or container body which has a larger outer dimension (width or outer diameter) than at least the neck portion. Conveniently, such containers are made of glass, but they may also be made of plastic material. Generally, for producing a holding structure in the sense of the present application plastic injection molding techniques are suitable, in particular so-called two-component (2K) injection molding techniques, by which plastics with different properties, in particular of different elasticity, are injection molded. In principle, however, other plastics processing techniques may also be considered, in particular the production using 3D-printers.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

1 vial/glass bottle
2 cylindrical side wall
3 bottom
4 neck portion
5 constricted neck portion
6 upper rim
7 filling opening
11 subunit of a carrier
12 peripheral web
13 opening/receptacle
14 side wall on the underside of the carrier
20 adjustable element

21 basis
22 connecting web
23*a* first film hinge
23*b* second film hinge
24 gap
25 control cam
26 left holding arm
27 right holding arm
30 adjustable element
31 basis
32 film hinge
33 stop
34 left holding arm
35 right holding arm
36 spacer
37 rounding of left holding arm
38 rounding of right holding arm
39 elastic portion of left holding arm
40 elastic portion of right holding arm
41 front end of left holding arm
42 front end of right holding arm
45 rod
46 projection
50 pivotable holding arm
51 axis of rotation with torsion spring
52 front free end of pivotable holding arm 50
53 rear free end of pivotable holding arm 50
54 holding projection
55 supporting nose
56 bevel
60 elastic insert
61 actuating device
62 bottom
63 rear side wall
64 cylindrical cavity
65 lower annular gap
66 circumferential projection
67 step
68 second film hinge
69 circumferential bead
70 clamping lever
71 holding claw
72 connecting web
73 first film hinge
74 upper annular gap
80 symmetry axis
90 pressure plate
91 peripheral web
92 opening
93 adjustable holding element
94 articulated joint
96 access opening
97 projection
98 recess
100 transport and packaging container
101 bottom
102 lower side wall
103 projection
104 upper side wall
105 upper rim
106 rounded corner
110 holding structure
110*a* carrier
111 opening
112 side wall
113 raised edge
114 rounded corner
115 access opening
120 projection
121 front side wall in the region of projection 120
122 side wall in the region of projection 120
125 recess
126 front side wall in the region of recess 125
127 side wall in the region of recess 125
200 transport and packaging container
201 bottom
202 lower side wall
204 upper side wall
205 upper rim
210 holding structure/carrier
212 holding arm
213 holding projection
214 supporting nose
215 upper bevel
216 lower bevel
220 vial/glass bottle
221 upper rim of vial 220
222 bottom of vial 220
223 side wall of vial 220
224 constricted neck portion of vial 220

What is claimed is:

1. A combination, comprising:

a transport or packaging container that is box-shaped;

a plurality of containers for substances for pharmaceutical, medical or cosmetic applications, the containers being cylindrical and open at least at one end; and a holding structure accommodated in the box-shaped transport or packaging container and concurrently holding the plurality of containers, the holding structure comprising:

a planar carrier having a plurality of openings or receptacles that are formed and arranged in a regular arrangement and are each holding a respective one of the containers; and at least two holding devices assigned to each of the openings or receptacles for holding the plurality of containers on the carrier by frictional engagement or by positive locking; the holding devices being configured to selectively assume two different stable positions, wherein, in a first stable position, the distance between the holding devices is sufficiently large so that in the first stable position of the holding devices the containers can be inserted into or removed from a respective opening or receptacle, and, in a second stable position of the holding devices, the distance between the holding devices is sufficiently small so that in the second stable position the containers are held by the holding devices in the respective opening or receptacle by frictional engagement or by positive locking.

2. The combination of claim 1, wherein the holding devices are configured to be bi-stable and are elastically biased into the first stable position and into the second stable position which is different from the first stable position, in order to be able to selectively assume the first stable position or the second stable position.

3. The combination of claim 1, further comprising an actuating element connected to the holding devices by film hinges, wherein in the first stable position the film hinges press the holding devices apart by an elastic restoring force, wherein the film hinges are configured to be pressed over by actuating the actuating element for transferring the holding devices into the second stable position.

4. The combination of claim 3, wherein the holding devices are each pivotably connected to the actuating element by a first hinge and are each connected to the carrier by a second hinge, so that the holding devices are transferred from the first stable position into the second stable position by adjusting the actuating element relative to the carrier.

5. The combination of claim 4, wherein the actuating element is formed and arranged to be adjustable in a radial direction of the respective opening or receptacle and within a plane spanned by the carrier for transferring the holding devices from the first stable position into the second stable position.

6. The combination of claim 5, wherein the actuating element comprises a base body having a projection projecting radially therefrom and two holding arms connected to the base body that are moved towards one another from the first stable position and transferred into the second stable position by radial adjustment of the base body, wherein a gap is formed between the base body and an edge of the respective opening or receptacle both in the first stable position and in the second stable position.

7. The combination of claim 6, wherein the actuating element is mirror-symmetrical and the holding arms are arranged in the respective opening or receptacle mirror-symmetrically with respect to the actuating element.

8. The combination of claim 6, wherein the projection projects radially from the base body to such an extent that in the second stable position the projection directly abuts a cylindrical side wall or a constricted neck portion of a respective container so that the projection acts as a control cam for controlling the position of the holding arms.

9. The combination of claim 5, wherein the actuating element comprises a base body having a projection projecting radially therefrom and two holding arms connected to the base body that are moved towards one another from the first stable position and transferred into the second stable position by radial adjustment of the base body, the holding arms being concavely curved in sections and having a radius of curvature which is matched to a radius of a respective container in a region of a cylindrical side wall or of a constricted neck portion.

10. The combination of claim 5, wherein, in the second stable position, the holding devices are elastically biased against each other by an elastic restoring force exerted by the hinges, wherein the hinges are configured be pressed over by displacement of the respective container in a direction perpendicular to the direction of extension of the projection for transferring the holding devices back to the first stable position.

11. The combination of claim 5, wherein the actuating element, the holding devices and the hinges are formed integrally with the carrier.

12. The combination of claim 1, wherein the holding devices are formed as holding arms projecting from the carrier and holding the containers in the second stable position clamped in a region of a cylindrical side wall or of a constricted neck portion or engaging behind a widened upper rim in order to hold the containers axially secured on the carrier.

13. The combination of claim 1, further comprising an actuating element connected to the holding devices by a first hinge and a second hinge, the actuating element being formed and arranged so as to be adjustable in the respective opening or receptacle perpendicular to a plane spanned by the carrier for transferring the holding devices from the first stable position into the second stable position.

14. The combination of claim 13, wherein the actuating element is formed as a cylindrical body having a closed top, wherein an annular gap, which is bridged by the first hinge, by a portion of the holding devices and by the second hinge, is formed between an edge of the respective opening or receptacle and the actuating element.

15. The combination of claim 14, wherein the cylindrical body is centered with respect to an axis of symmetry of the respective opening or receptacle of the carrier.

16. The combination of claim 13, wherein the holding devices are formed as holding arms having holding claws, a length of the holding arms being matched to an axial length of the containers in such a manner that, in the second stable position, the containers are held clamped at an upper end of a cylindrical side wall or at a constricted neck portion or that a widened upper rim is engaged behind, for holding the containers axially secured to the carrier.

17. The combination of claim 1, wherein the carrier includes a side wall provided at least in sections on a rear side of the carrier along an edge of the respective opening or receptacle, for preventing a collision of containers which are accommodated in directly adjacent openings or receptacles of the carrier.

18. The combination of claim 1, wherein the plurality of openings or receptacles comprises at least three openings or receptacles.

* * * * *